US011369841B2

(12) United States Patent
Lind et al.

(10) Patent No.: US 11,369,841 B2
(45) Date of Patent: Jun. 28, 2022

(54) MULTI-DEGREE OF FREEDOM RESISTANCE EXERCISE DEVICE

(71) Applicants: Peter Lind, Salem, OR (US); Kenneth Courian, Portland, OR (US); Andrew Sorg, Portland, OR (US)

(72) Inventors: Peter Lind, Salem, OR (US); Kenneth Courian, Portland, OR (US); Andrew Sorg, Portland, OR (US)

( * ) Notice: Subject to any disclaimer, the term of this patent is extended or adjusted under 35 U.S.C. 154(b) by 0 days.

(21) Appl. No.: 16/390,867

(22) Filed: Apr. 22, 2019

(65) Prior Publication Data

US 2020/0330821 A1 Oct. 22, 2020

(51) Int. Cl.
*A63B 23/035* (2006.01)
*A63B 21/005* (2006.01)
(Continued)

(52) U.S. Cl.
CPC .... *A63B 23/03558* (2013.01); *A63B 21/0056* (2013.01); *A63B 21/00072* (2013.01);
(Continued)

(58) Field of Classification Search
CPC ..... A63B 21/00058; A63B 21/00069; A63B 21/00072; A63B 21/00076; A63B 21/00192; A63B 21/005; A63B 21/0051; A63B 21/0052; A63B 21/0056; A63B 21/0057; A63B 21/15; A63B 21/159; A63B 21/4027; A63B 21/4029; A63B 21/4031; A63B 21/4033; A63B 21/4034; A63B 21/4035; A63B 21/4045; A63B 21/4047; A63B 21/4049; A63B 23/035; A63B 23/03516; A63B 23/03533; A63B 23/03541; A63B 23/0355;
(Continued)

(56) References Cited

U.S. PATENT DOCUMENTS 5,070,816 A * 12/1991 Wehrell ..... A63B 21/00069 119/702
5,176,601 A * 1/1993 Reynolds ..... A63B 23/03525 482/121
(Continued)

FOREIGN PATENT DOCUMENTS

CN 108499032 A * 9/2018

*Primary Examiner* — Gary D Urbiel Goldner
(74) *Attorney, Agent, or Firm* — Kevin P. Crosby, Esq.

(57) ABSTRACT

An exercise apparatus having a frame with attachments to multiple independent bidirectional resistance devices used by arms and/or legs of a user to provide resistance against movement of the user's appendages in two substantially opposed directions. The resistance devices may have a mechanism to control bi-directional resistance. The movement of the user's appendages in bi-directional resistance offers near full body exercise of agonist/antagonist muscles using flexion and extension action of larger muscle groups in a gait pattern, simultaneously. Hand engaging members attach to arm resistance devices and foot engaging members attach to leg resistance devices. The exercise apparatus may include an attached inclined backboard, mat, bench, or cushion to fully or partially support the user. The exercise apparatus may have separate height and/or length adjustment mechanisms for adjusting a range of motion of the user's appendages.

9 Claims, 47 Drawing Sheets

(51) Int. Cl.
*A63B 21/00* (2006.01)
*A63B 21/008* (2006.01)

(52) U.S. Cl.
CPC ..... *A63B 21/0083* (2013.01); *A63B 21/159* (2013.01); *A63B 21/4029* (2015.10); *A63B 21/4034* (2015.10); *A63B 21/4035* (2015.10); *A63B 23/03541* (2013.01)

(58) Field of Classification Search
CPC ..... A63B 23/03558; A63B 23/03575; A63B 69/10; A63B 71/0054; A63B 2071/0063; A63B 2071/0072; A63B 2208/0252; A63B 2209/00; A63B 2209/08; A63B 2225/09; A63B 2225/093; A63B 2225/10; A63B 2225/105; A63B 2225/107; A63B 2244/20
See application file for complete search history.

(56) References Cited

U.S. PATENT DOCUMENTS

2015/0126337 A1* 5/2015 Popov ..... A63B 21/00192 482/71
2018/0056122 A1* 3/2018 Lind ..... A63B 21/0087

* cited by examiner

MULTI-DEGREE OF FREEDOM RESISTANCE EXERCISE DEVICE

CROSS-REFERENCE TO RELATED APPLICATIONS

This application claims priority to and the benefit of U.S. Provisional Application No. 62/336,861, filed on May 16, 2016, and is a continuation-in-part of and claims priority to and the benefit of non-provisional patent application Ser. No. 15/597,027 filed on May 16, 2017. The disclosure of the foregoing applications are expressly incorporated herein by reference as though fully set forth herein.

BACKGROUND OF THE INVENTION

Field of the Invention

This invention relates to exercise devices, and, more particularly, relates to devices having multiple resistance elements permitting the user to exercise his or her arms and/or legs synchronously in full or nearly full range of motion without the influence of gravity.

Description of the Prior Art

There are two major reasons people don't exercise. The most common objection is the time it takes for a workout, typically at least 45-60 minutes, performed three or more times per week. The second most common objection to exercise is the lack of results from engaging in an exercise program.

Safety concerns about exercise in general also limit or altogether preclude many from exercise, including those who: have heart conditions; have balance problems; have dizziness and occasionally lose consciousness; have bone or joint pain made worse by weight-bearing activity; or have neuropathy made worse by weight-bearing activity.

However, the importance of exercise is universally recognized. Moreover, the wider/fuller the range of motion through which a user's limbs are put during exercise, the more benefit is realized. Some of the benefits of full range of motion during exercise include muscles becoming far stronger, not just in the bottom of the range of motion but throughout the entire range of motion, muscle size increases throughout the entire muscle, fat stores decrease, joints are strengthened throughout the entire range of motion, not in just one particular range of motion, less work (weight and intensity) is needed to strengthen a muscle during a full range of motion, and greater efficient load can be imposed on the muscle(s) (using less weight or resistance) during full range of motion.

The best exercise for the body is it to engage the most muscle groups in the highest active intensity for the shortest time, until complete fatigue. The more muscles that are engaged, the more the heart pumps blood, the more the lungs exchange oxygen and carbon dioxide, the greater the volume of oxygen ($VO_2$). The more muscles that are engaged, the less time it takes to reach maximum anaerobic threshold (the point of anaerobic metabolism) and the sooner the striated muscles and cardio-respiratory system reaches fatigue. The most successful cardio-respiratory exercise is one that activates the most muscle groups to reach maximum fatigue as rapidly as possible.

To improve muscle function, tone, strength, and endurance the muscles must be overloaded to the point of fatigue. An overloaded muscle requires more mitochondrial activity, more oxygen consumption, and increased efficient metabolism through anaerobic metabolism. The longer time spent in muscle overload (past the level of maximum anaerobic threshold), the more oxygen/carbon dioxide is exchanged and the more glucose is used. Therefore, the goal of effective exercise is to bring total cardio-respiratory overload as fast as possible. This can best be done by engaging large muscle mass with bi-directional resistance, through near-complete ranges of motion, while involving both sides of the body synchronously.

In some approaches, such as disclosed in U.S. Pat. Nos. 4,750,735, 6,500,099, and 4,949,954, the user is limited in the range of motion provided by the exercise machine. In particular, the exercise machines described in the prior art generally limit the user to extension of one set of limbs during exercise. Other approaches, such as those disclosed in U.S. Pat. Nos. 5,104,363 and 4,684,126, require the user to remain in a seated position and still limits the range of motion provided during exercise. There is an unmet need in the art for an exercise machine that allows a user to have a full range of motion in both the arms and the legs at the same time so as to allow for high intensity interval training or equivalent exercise, for which the current art does not provide.

Maximum aerobic capacity is the maximum rate of oxygen consumed and is measured as $VO_2$ Max. $VO_2$ Max reflects the aerobic physical condition of the individual.

$VO_2$ Max is affected by: the ability of the lungs to transfer maximum oxygen through inspiration and maximum carbon dioxide through expiration, the efficiency of oxygen and carbon dioxide exchange in peripheral tissues, the ability of the heart to pump maximum blood volume through the lungs and peripherally through the body, the condition of the circulatory system, the condition of the muscles and peripheral tissues, and the autonomic nervous system control.

Maximum anaerobic capacity is the maximal amount of energy released by anaerobic metabolism. Enhanced anaerobic metabolism causes: improved efficiency of the lactic acid cycle, mobilization and burning of fats, increased metabolic efficiency such that both metabolic rate and caloric burning is more efficient 24 hours per day (not merely while exercising—this is the "after-burn" affect), more efficient use of sugar and glycogen (stored sugar) for energy, maximization of muscular development, maximization of cardiovascular-pulmonary stamina, enhanced regeneration of adenosine triphosphate (ATP) and creatine phosphokinase (CPK) in muscle tissue, and mitochondrial growth throughout muscle cells.

The more muscles that are activated into fatigue the more calories are burned. The more the muscles that are activated the more oxygen is required by them. The more the muscles that are activated the more sugar the body burns as fuel. The more the muscles that are activated the more likely the body moves into anaerobic metabolism, increasing the efficiency of mitochondrial function at the cellular level.

The greater the muscle mass that is activated, the greater will be the caloric burn quantity and rate. The highest muscle activation comes from muscle contraction under resistance. The further the muscle moves through its range of motion, the greater the muscle is activated. The greater the resistance and stretch on the muscle, the greater the muscle strength gained (both in the striated and cardiac muscles) during the anabolic repair phase. The prior art previously only allowed for range of motion in one set of limbs, thereby only allowing for muscle activation in fewer than desired muscle groups.

Exercise is a physical/mechanical stress that causes a catabolic phase (tissue breakdown), followed by a longer anabolic phase (tissue repair), lasting hours or days. Efficient exercise tears down striated muscle and cardiac muscle, forcing the body to rebuild and repair. When exercise is efficient, the body rebuilds tissue such that the functional capacity of the muscle is more efficient than it was before the exercise was performed and the oxygen delivery system is improved ($VO_2$ max).

With proper exercise, body strength is increased and physical stamina improves until a physiological limit is reached at about 32 years of age. After the physiological limit has been reached, no greater gains can be made in physiology. However, with a proper exercise routine, strength and stamina can be maintained for decades as body metabolism and other factors of health are maintained. The greater the catabolic breakdown of the muscle through proper exercise and the greater the opportunity to complete the anabolic repair cycle, the more efficient the muscles become. Exercising multiple muscle groups at the same time allows for greater catabolic breakdown of the muscles thereby allowed for a greater opportunity to complete the anabolic repair cycle, leading for more efficient muscles.

The complete cycle of exercise begins with a strenuous exercise. Ideally, the catabolic phase begins during the exercise activity and then continues, and then the anabolic phase begins and continues until full recovery and rebuilding from the workout is completed, up to 48 hours later. In an efficient exercise routine, the anabolic phase is not interrupted by an early catabolic phase, but it often is when a person exercises too frequently—a condition known as overtraining. In a high intensity, short duration catabolic exercise phase, the anabolic recovery phase may take up to 48 hours for completion.

High intensity interval training (HIIT) sessions are highly intense, short duration workouts in which a person quickly reaches maximum aerobic capacity ($VO_2$ max) and then approaches their anaerobic threshold, to the point of muscle fatigue and in attempt to satisfy the growing oxygen debt.

HIIT is a short duration exercise (sprint-like bursts of activity). HIIT is the most effective way to condition the physical body, while low intensity, long duration exercise (jogging, treadmill, elliptical, cycling) usually makes a person weak, tired, hungry, irritable and older faster. Consider the health and physique of a sprinter versus that of a long-distance runner.

The most effective high intensity interval training will cause the body to reach its anaerobic threshold quickly. The exercise goal of HIIT is to continue in anaerobic metabolism as long as possible, until complete fatigue. In summary, high intensity interval training (engaging in short bursts of rapid activity (20-30 second bursts)), using the most muscle mass, to the point of complete fatigue, is the most effective form of exercise. The prior art fails to disclose exercise machines that allow for the most effective high intensive interval training because they generally only use a smaller number of muscle groups at a time or exercises in less ranges of motion.

HIIT produces the greatest hormonal and other metabolic effects that can be derived from any exercise, burns body fat, burns sugar, builds lean body mass, and continues metabolic processes up to 24-48 hours later.

HIIT has at least two novel features: Firstly, unlike walking or moderate intensity aerobic training, efficient HIIT involves the activation of large muscle mass. Secondly, this large muscle mass activation is associated with a very high glycogen breakdown-turnover which means improved muscle glucose uptake.

The principal benefits of HIIT are that: the cardio-respiratory system will be strengthened; the risk of heart attacks and strokes will reduce; circulation will improve; functional muscular strength will improve; weight loss will occur more readily; food cravings will be reduced; hormonal balance will improve; muscles will be toned; fat reserves will be metabolized; energy will improve; aerobic and anaerobic fitness will improve; fasting insulin levels will decrease; insulin sensitivity will increase; abdominal and subcutaneous fat will reduce; and total exercise time will decrease.

As little as six sessions of HIIT over two weeks, or a total of only approximately 15 minutes of very intense exercise (a cumulative energy expenditure of roughly 600 kJ or 143 kcal), has been shown to increase oxidative capacity in skeletal and cardiac muscle and significantly improve performance in activities that rely on aerobic energy metabolism.

Most people who exercise over-train. Because of their exercise routine, people are either in an ongoing catabolic phase or an incomplete anabolic phase. That is, they are stuck in a catabolic phase and cannot begin the anabolic phase needed to recover and repair, or they are stuck in an anabolic phase in which their body is working desperately in an attempt to complete recovery from the previous catabolic workouts. But they do not complete the anabolic recovery phase before their next workout. In either case, most people over-train and continue exercising while they are not fully recovered.

Overtraining and excessive exercise are metabolic stressors that advance the catabolic damages of aging. More than just a few minutes in a catabolic phase without a complete anabolic repair phase is over-training. A person cannot over-exercise themselves into better health. It takes very little exercise volume to maximize cardio-respiratory fitness, fat loss, strength gain, and metabolic efficiency.

The "plateau" is the phase of exercise when the body approaches the zone of causing greater catabolic stress than anabolic repair. When a person reaches a plateau, exercise should not continue until the anabolic cycle is completed. Objective measurements must be used to determine when the plateau has been reached (heart rate recovery). Continuing to exercise beyond the plateau will only make a person tired, hungry, and irritable, have more pain, waste more time, expose them to injury, and age faster.

In an effective exercise program, a person will just reach plateau but never overdo the exercise routine.

Therefore, the most effective exercise routine is to engage as many muscles, safely, through their complete range of motion, in a synchronized pattern, with adequate resistance, as vigorous as possible, to complete fatigue.

However, there has heretofore not been proposed an exercise machine that can provide such an effective workout. Therefore, it is a principle object of this invention to provide an exercise device adapted to simultaneously, or synchronously, exercise the arms and legs in near complete range of motion with resistance in the flexion/extension planes.

The main objective is to exercise the arms and legs in near complete range of motion with resistance in the flexion/extension planes. A second objective is to activate the muscles so that muscular fatigue can be reached quickly. A third objective is to allow for a non-weight bearing way to exercise large groups of muscles. A fourth objective is to provide a synchronized movement of the arms and legs in a gait-like pattern. A fifth objective is to rehabilitate the arms and leg muscles and joints through near complete range of motion with adjustable resistance. A sixth objective is to offer one of the safest ways to exercise, almost eliminating any risk of injury.

It is also an object of this invention to activate the muscles so that muscular fatigue can be reached quickly.

Another object of this invention is to allow for a way to exercise large groups of muscles without the user bearing any weight.

A further object of this is to provide a synchronized movement of the arms and legs in a gait-like pattern, synchronizing the nervous system.

A still further object of this invention is to rehabilitate the arms and leg muscles and joints through near complete range of motion with adjustable resistance.

It is yet a further object of this invention to provide an exercise device which allows for a free, not rigid, range of motion of the limbs.

It is yet a further object of this invention to provide an exercise device which allows for a full body, non-weight bearing exercise.

It is an even further object of this invention to provide an exercise device which offers purely operator-induced exercise because the exerciser is supine and using only muscular action, not gravity, to facilitate exercise.

It is an even further object of this invention to provide an exercise device which offers the greatest effect to the cardio-respiratory systems by utilizing the largest muscle groups in all four limbs in near-complete range of motion through resistance.

It is an even further object of this invention to provide an exercise device which provides high intensity interval training exercise.

It is an even further object of this invention to provide an exercise device through which a user reaches cardio-respiratory fatigue quickly.

It is an even further object of this invention to provide an exercise device which activates more than one muscle group at one time.

It is an even further object of this invention to provide an exercise device which increases cardio-respiratory output.

It is an even further object of this invention to provide an exercise device which increases aerobic metabolism.

It is an even further object of this invention to provide an exercise device which increases anaerobic metabolism.

It is an even further object of this invention to provide an exercise device which offers the shortest time to achieve a full body exercise.

A further object of this invention is to provide an exercise device having one or more resistance elements selected from the group of magnetic, also known as "eddy current," resistance elements, which cause resistance or braking without contact between relative moving/braking members, such that braking parts are not worn out due to friction. In addition, when using magnetic resistance elements, magnetic resistance increases as the speed of the user increases. In other words, two people can have different experiences at the same magnetic setting solely based on how hard, i.e., how fast, they try to operate their limbs against the machine.

SUMMARY OF THE INVENTION

The foregoing objectives, among others, are achieved through an exercise apparatus which allows for near-complete joint range of motion of the elbows, shoulders, knees and hips in active and resistant movements.

An embodiment of the present invention is directed to an exercise machine comprising a base, a first pair of bi-directional resistance elements, each comprising a first end and a second end, the first end of each resistance element of the first pair of resistance elements pivotally attached to a support in such a manner as to imbue each element with a substantially free range of motion, the second end of each resistance element of the first pair of resistance elements comprising a foot-engagement member, and a second pair of bi-directional resistance elements, each comprising a first end and a second end, the first end of each resistance element of the second pair of resistance elements pivotally attached to the support in such a manner as to imbue each such element with a substantially free range of motion, each resistance element of the second pair of resistance elements comprising a hand-engagement member.

In another embodiment, an exercise machine is provided which comprises a base, a first pair of bidirectional resistance apparatus adapted for engagement by a user's legs or feet, and a second pair of bidirectional resistance apparatus adapted for engagement by a user's hands or arms. In this embodiment, the first pair of by directional resistance apparatus, and/or the second pair of bidirectional resistance apparatus, employ eddy current braking elements to provide resistance to the movements imparted on the respective apparatus by the user.

Eddy current braking, also known as induction braking, electromagnetic braking and electric retarder braking, is a frictionless braking technology that is used to slow a moving object by dissipating its kinetic energy as heat. Eddy current braking has both economic and risk management advantages. This braking system takes the simple function of magnetic and non-magnetic forces and uses them as a braking mechanism through the purposeful generation of eddy currents in order to slow a movement. Eddy currents are formed when a conductor moves through a magnetic field, which induces an electromagnetic force.

A magnet moving past a conductor will induce circular electric currents called eddy currents in the conductor by the magnetic field, as described by Faraday's law of induction. By Lenz's law, the circulating currents will create their own magnetic field which opposes the field of the magnet. Thus, the conductor will experience a drag force from the moving magnet that opposes the motion of the magnet, proportional to its velocity. The kinetic energy of the moving magnet is dissipated as heat generated by the current flowing through the electrical resistance of the conductor.

In an eddy current brake, the magnetic field may be created by a permanent magnet (where braking force can be varied or turned off by adjusting the position of the magnet relative to a conductive member), or by an electromagnet (where the braking force can be turned on and off or varied by varying the electric current in the electromagnet's windings). Since the brake does not work by friction, there are no brake shoe surfaces to wear out, necessitating replacement, as with friction brakes.

Eddy current brakes are an ideal form of braking because of their absence of physical contact between internal components, which allows eddy current brakes to be very low maintenance.

Example embodiments will become more fully understood from the detailed description given herein below and the accompanying drawings, wherein like elements are represented by like reference characters, which are given by way of illustration only and thus are not to be taken as limiting of the scope of the invention.

DETAILED DESCRIPTION OF EXEMPLARY EMBODIMENT(S)

Figure 1:
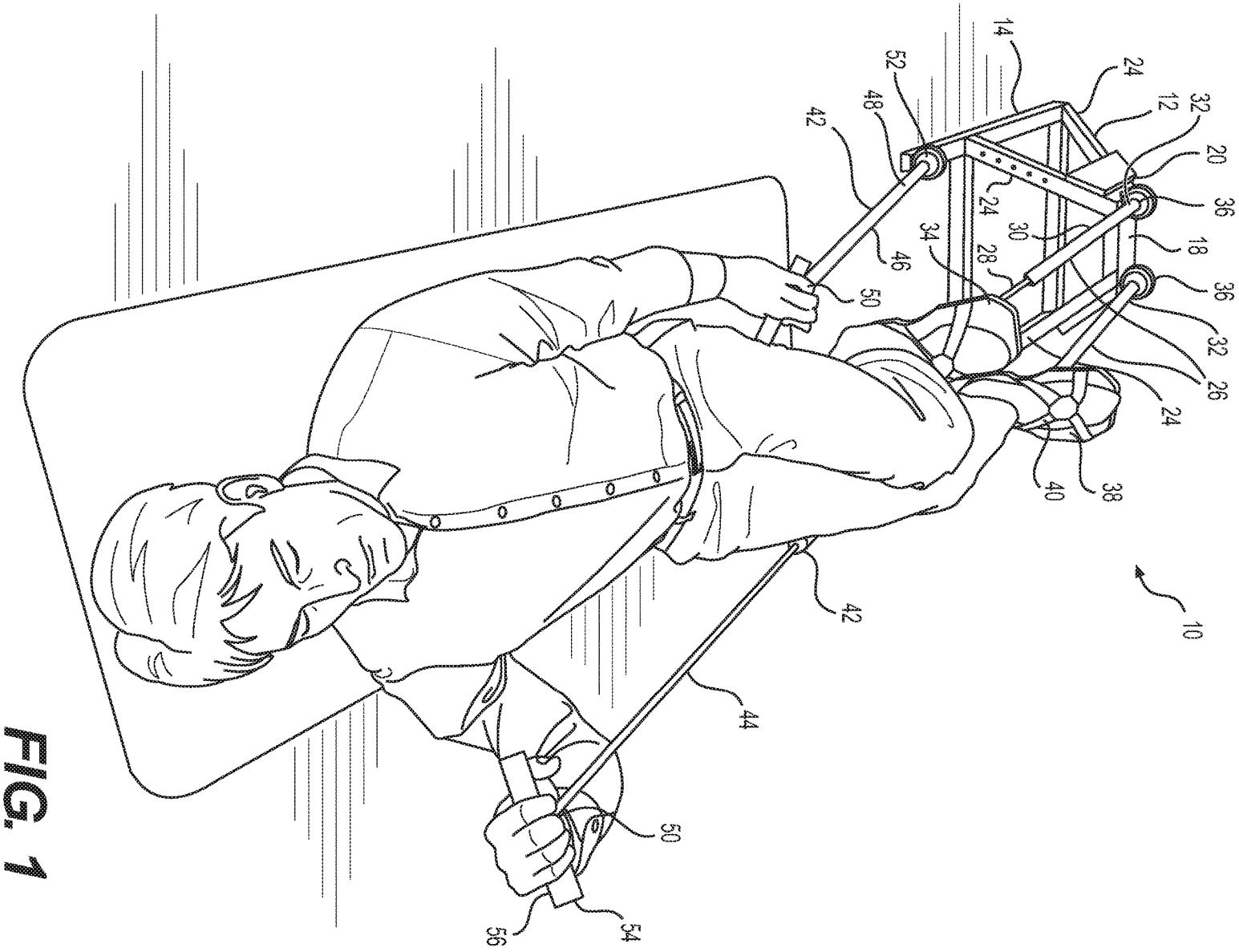
FIG. 1 is a left rear perspective view of a first embodiment of the invention showing a user in a first position of use employing the invention.

The following description is of a preferred and other embodiments presently contemplated for carrying out the invention. This description is not to be taken in a limiting sense, but is made merely for the purpose of describing one or more embodiments of the invention. The scope of the invention should be determined with reference to the claims.

By "substantially free range of motion" is meant freedom to rotatingly move about a connection in any direction of movement brought about by the appendage with which the resistance element is associated while the exercise device is in use.

An embodiment of the present invention is illustrated in FIGS. 1-7 shown from various perspectives. In this embodiment, the exercise apparatus 10 is comprised of a frame/base 12 having a first base side 14 and second base side 16, and an upper platform 18 having a first platform side 20 and second platform side 22. The frame/base 12 has one or more supports 24 connecting the lower sides 14, 16 to the platform 18.

Hingedly attached to frame/base 12 are a first pair of resistance elements 26, which may be any type of apparatus that presents resistance to the user in both flexion and extension, such as hydraulic or pneumatic rams, spring-like members, frictional resistance mechanisms, pulleys, cams, and/or the like. In the case of a hydraulic or pneumatic ram, the resistance elements may be comprised of an inner rod 28 and outer cylinder 30.

The first pair of resistance elements (each denoted by the reference numeral "26") each have a first end 32 and second end 34. The first ends 32 of the first pair of resistance elements 26 are attached to the upper platform level side 20 and second platform side 22 through the use of pivot joints 36 such as ball and socket joints or other structure permitting substantially free range of motion. Joints 36 should be constructed and arranged in such a manner as to imbue each such element with a substantially free range of motion in any direction of movement brought about by the user's appendage with which the resistance element is associated while the exercise device is in use. Joints 36 may, in one or more embodiments, be adjustably connected to upper section 16 so as to permit adjustment of the position of resistance element 26 relative to the user, to accommodate different sized users and/or different exercise modalities. By providing such an adjustment of the connection position of joints 36 to base 12 relative to the user, the distance of the connection points of joints 36 from the user can be adjusted. Additional mounting points may be provided on the frame/base 12. A user may also adjust the resistance provided by the first pair resistance elements 26 through the use of a valve or methods currently known or to be discovered.

Second ends 34 of the first pair of resistance elements 26 have associated therewith foot engaging members 38 adapted to engage the user's feet during use of the device. Structure for removably securing the user's feet to the foot engaging members 38, such as straps 40, may be provided as well.

Hingedly attached to frame/base 12 are a second pair of resistance elements 42, which may be any type of apparatus that presents resistance to the user in both flexion and extension, such as hydraulic or pneumatic rams, spring-like members, frictional resistance mechanisms, pulleys, cams, and/or the like. In the case of a hydraulic or pneumatic ram, the resistance elements may be comprised of an inner rod 44 and outer cylinder 46, or vice versa.

The second pair of resistance elements (each denoted by the reference numeral "42") each have a first end 48 and second end 50. The first ends 48 of the second pair of resistance elements 42 are attached to the lower section 14 through the use of a pivot joints 52 such as ball and socket members or other structure permitting substantially free range of motion. Joints 52 should be constructed and arranged in such a manner as to imbue each such element with a substantially free range of motion in any direction of movement brought about by the user's appendage with which the resistance element is associated while the exercise device is in use. Joints 52 may, in one or more embodiments, be adjustably connected to lower section 14 so as to permit adjustment of the position of resistance element 42 relative to the user, to accommodate different sized users and/or different exercise modalities.

Figure 2:
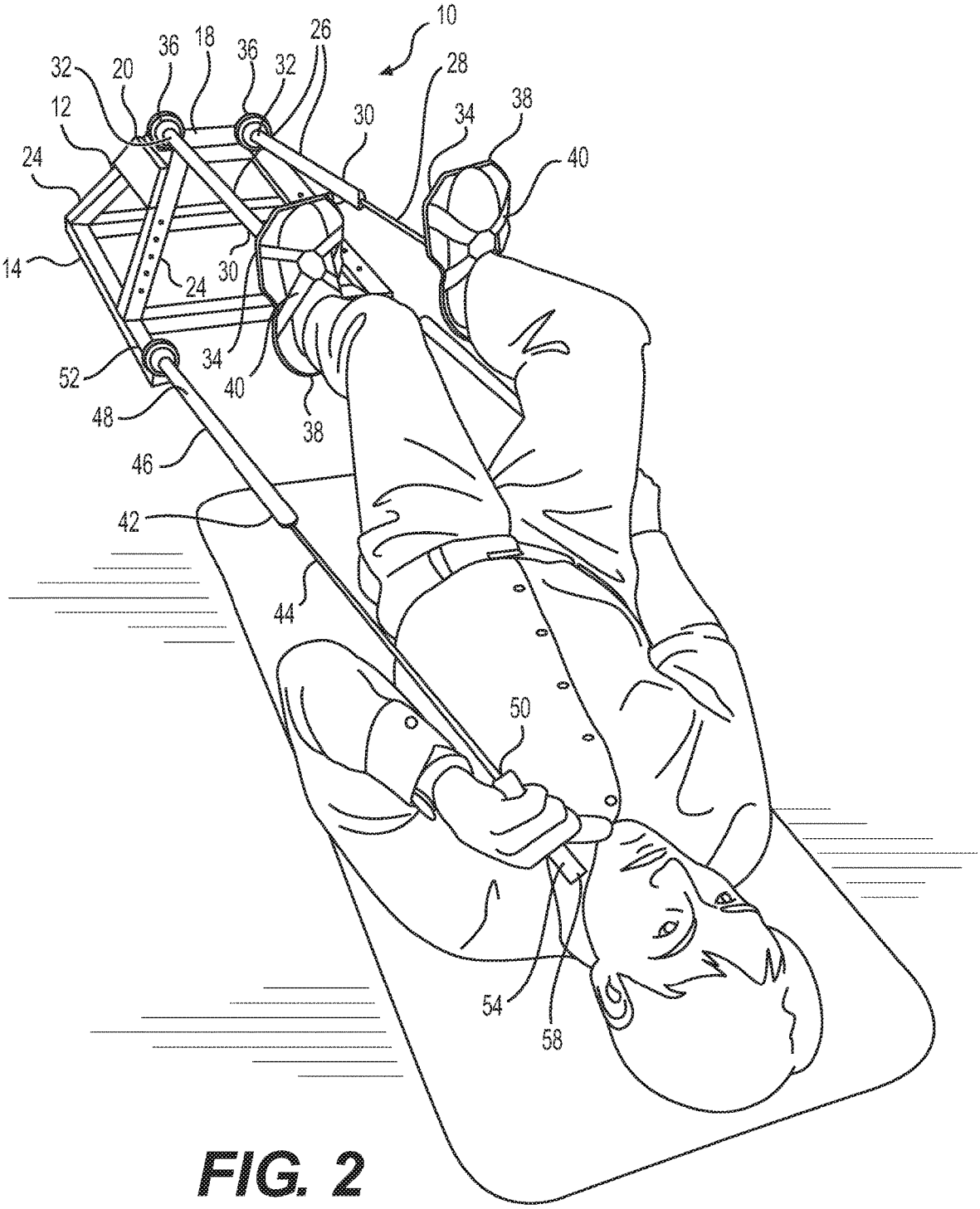
FIG. 2 is a left rear perspective view of the first embodiment of the invention showing a user in a second position of use employing the invention.
Figure 3:
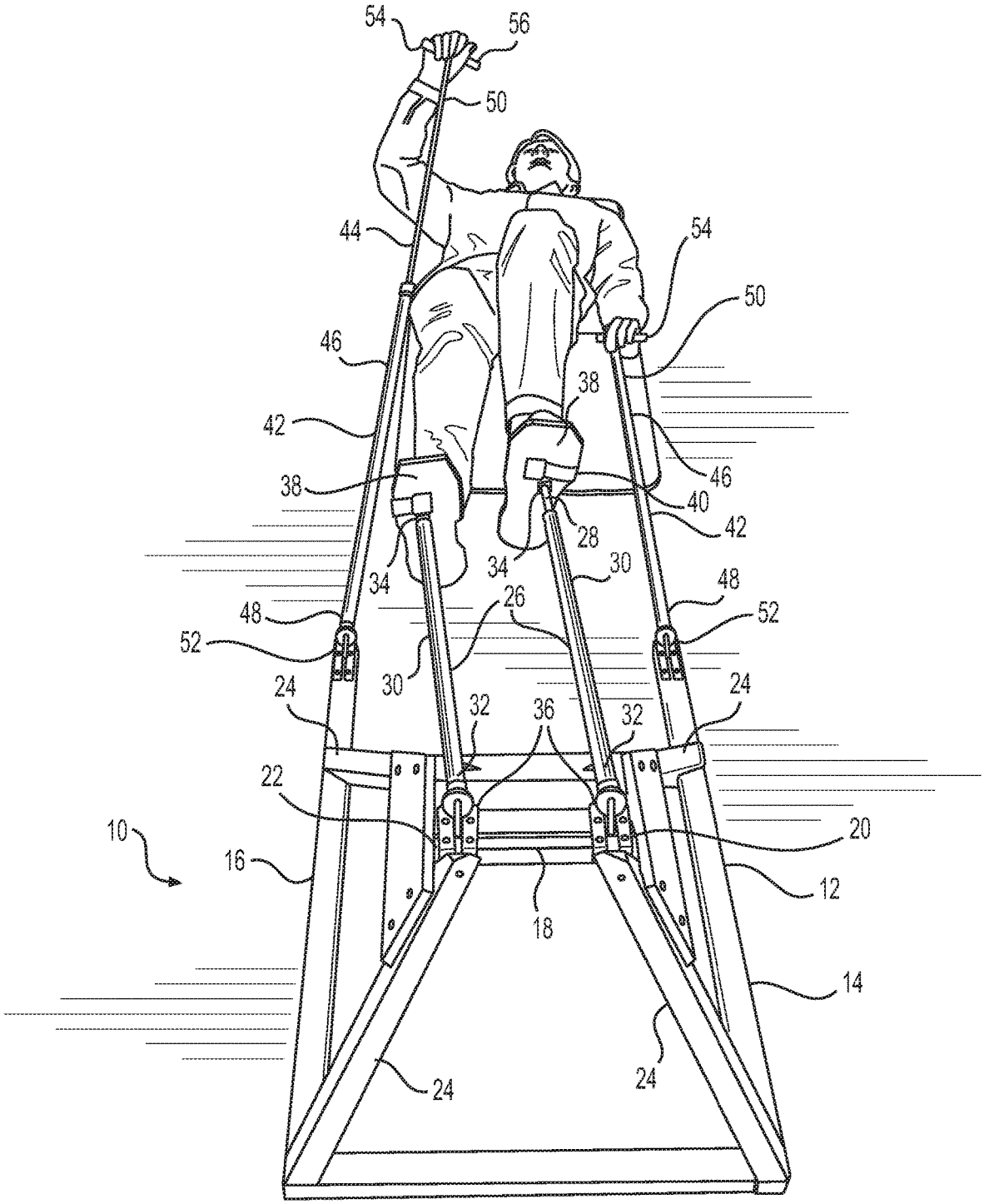
FIG. 3 is a front perspective view of the embodiment of FIGS. 1 and 2.
Figure 4:
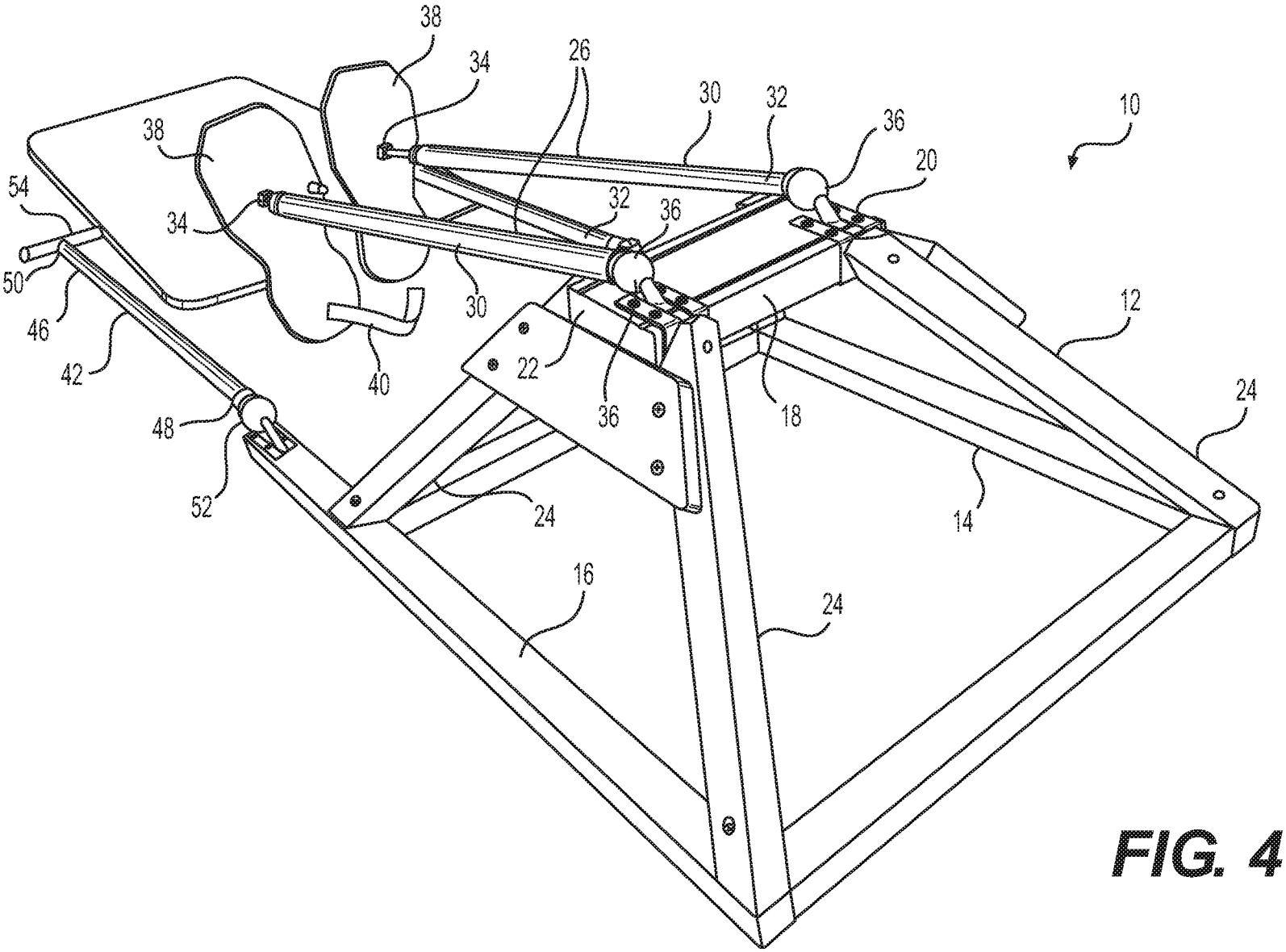
FIG. 4 is a right front perspective view thereof.
Figure 5:
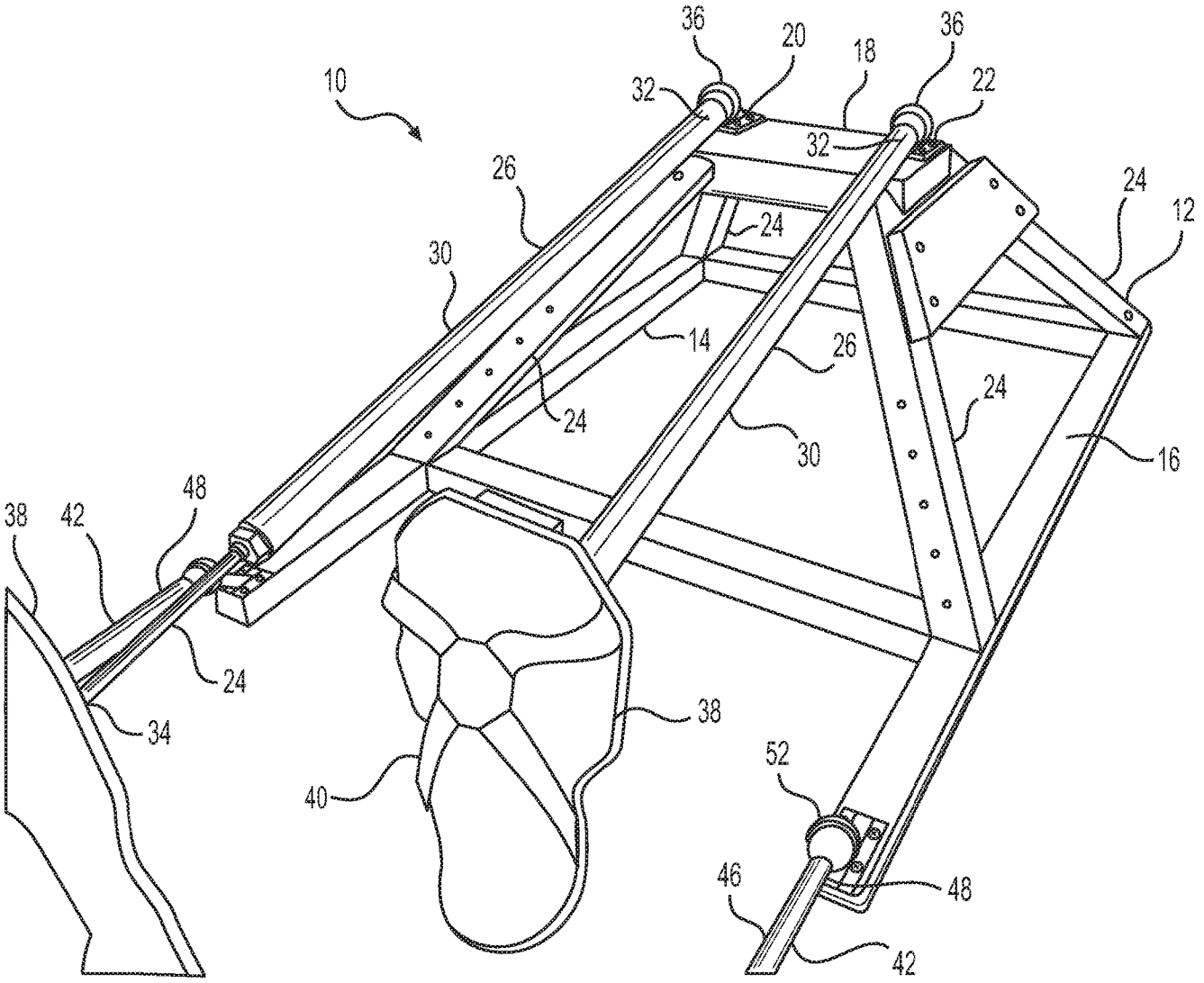
FIG. 5 is a right rear perspective view thereof.
Figure 6:
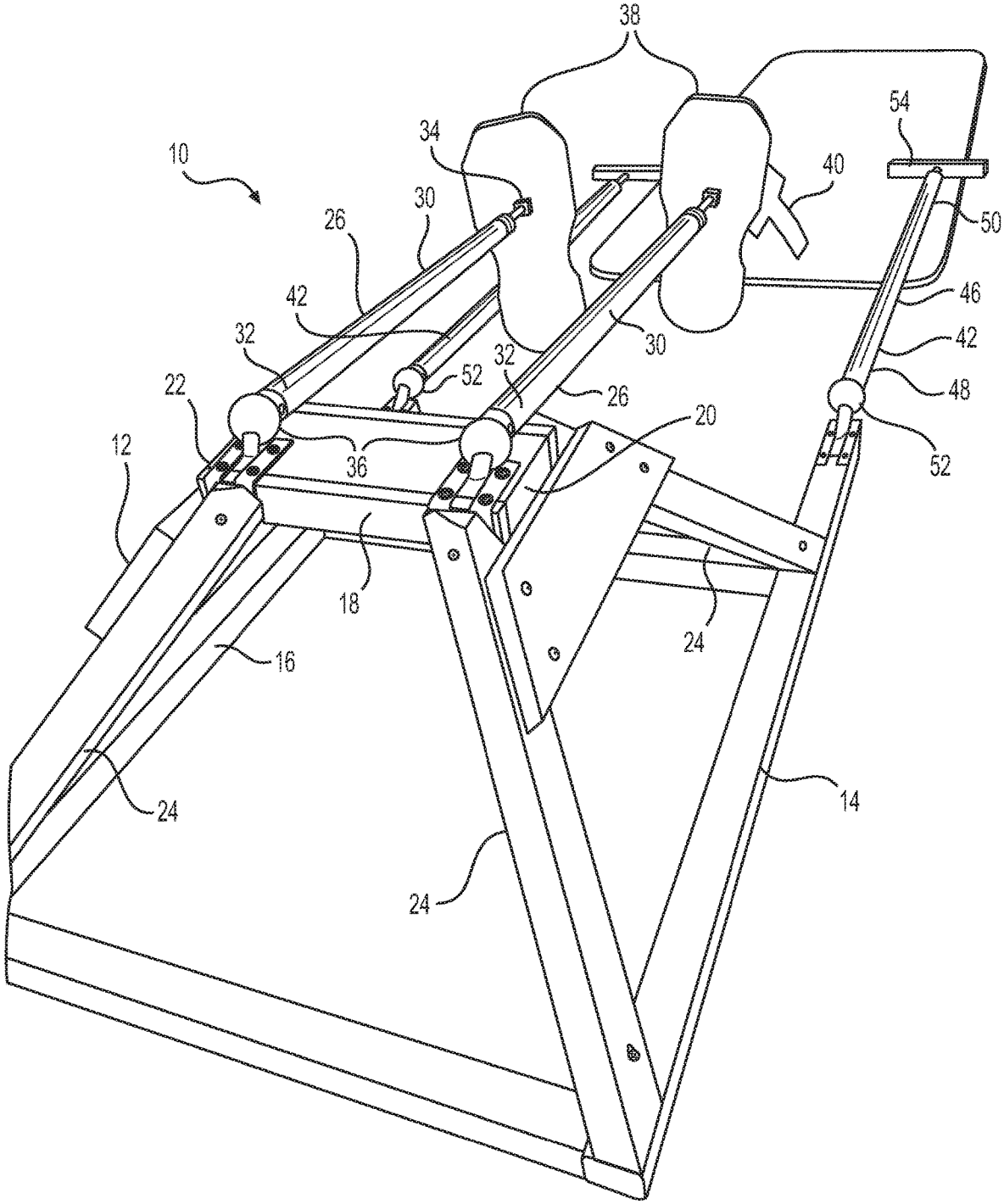
FIG. 6 is a left front perspective view thereof.
Figure 7:
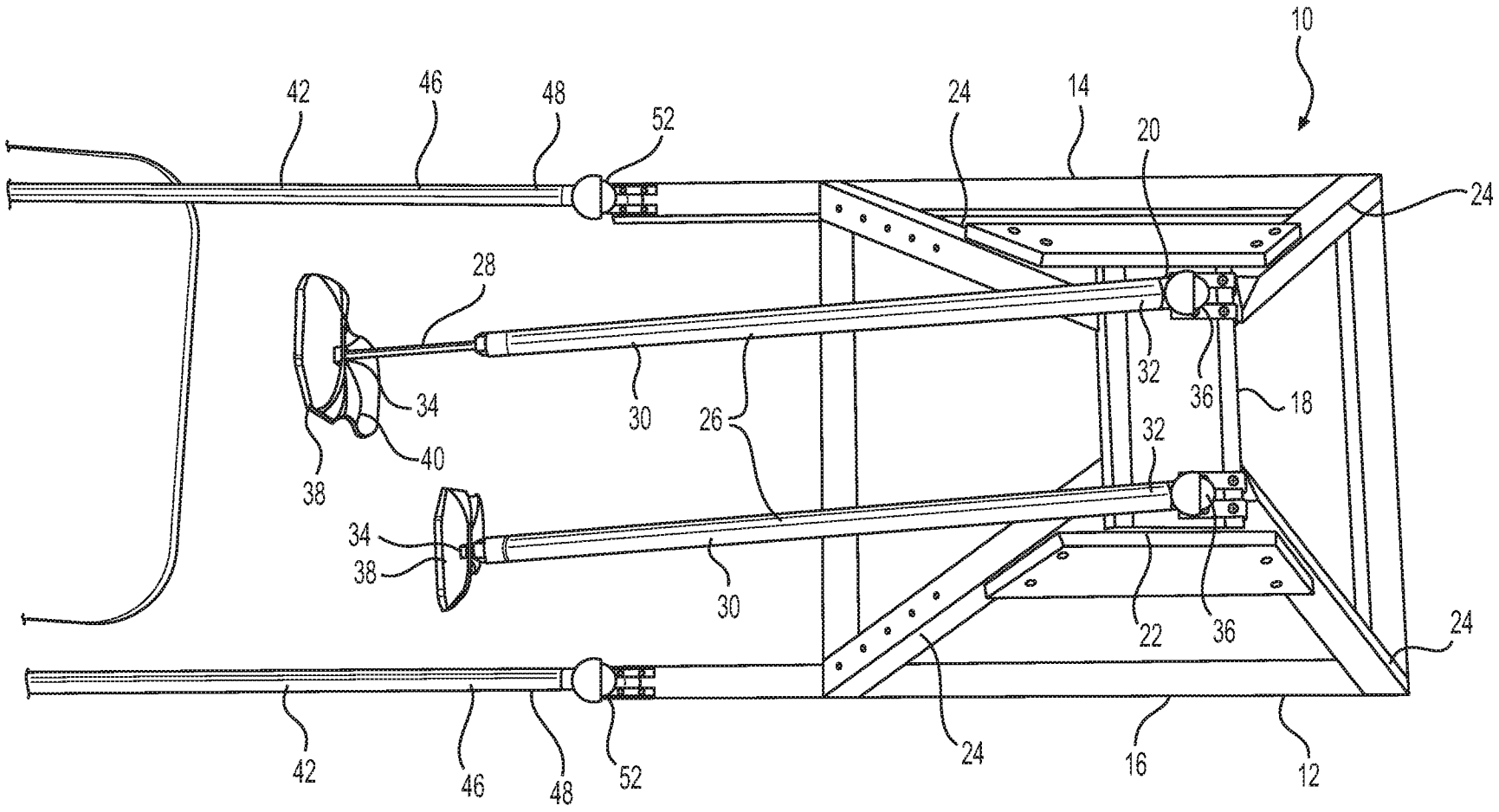
FIG. 7 is a top plan view thereof.

Second ends of the second pair of resistance elements 42 have associated therewith hand engaging members 54 adapted to be engaged by a user's hands during use of the device. Structure for removably securing the user's hands to the hand engaging members (not shown), such as straps, may be provided as well. As shown in FIGS. 1 and 2, the hand engaging member 54 can be a handle 56 or a grip 58, or any other known or unknown hand engaging configuration or structure.

In the preferred embodiment, each resistance element 26, 42 is independent and bidirectional and can provide resistance in a number of ways, including, but not limited to, pneumatics, hydraulics, springs, and any other apparatus, now known or currently unknown, that resists the pushing or pulling forces exerted by the user. The action of the arms and legs in bi-directional resistance offers near full body exercise of the agonist/antagonist muscles using flexion and extension action of the larger muscle groups in a gait pattern, simultaneously.

The unit may include an attached inclined or horizontal support, mat, cushion or the like for the exerciser to lay on. The unit may have an adjustment mechanism for height of the leg settings and for the length of the arm settings in accord to reach maximal limb range of motion. The unit may include one or more devices to monitor heart rate, blood pressure, oxygen flow ($VO_2$ max), body temperature and the like.

For one version of a rehabilitation use of the invention, a person lays on their back, straps their feet in foot engaging members 38 using the straps 40, holds onto the hand engaging members 54, and moves their arms and legs against resistance in near-complete range of motion. In one version of an exercise use of the invention, a person lays on their back, straps their feet in foot engaging members 38 using the straps 40, holds onto the hand engaging members 54, and pumps their arms and legs against bi-directional resistance in near-complete range of motion until cardio-respiratory fatigue is reached.

The unit allows for near-complete joint range of motion in active and resistant movements. That is, for example, the following magnitude of movements can be achieved in the following joints: elbow flexion: 0-150 degree movement, shoulder flexion: 0-180 degree movement, knee flexion: 0-100 degree movement, hip flexion: 0-120 degree movement. These ranges represent what is essentially free range of movement for all four limbs, thereby providing a full body workout engaging multiple muscle groups.

Figure 8:
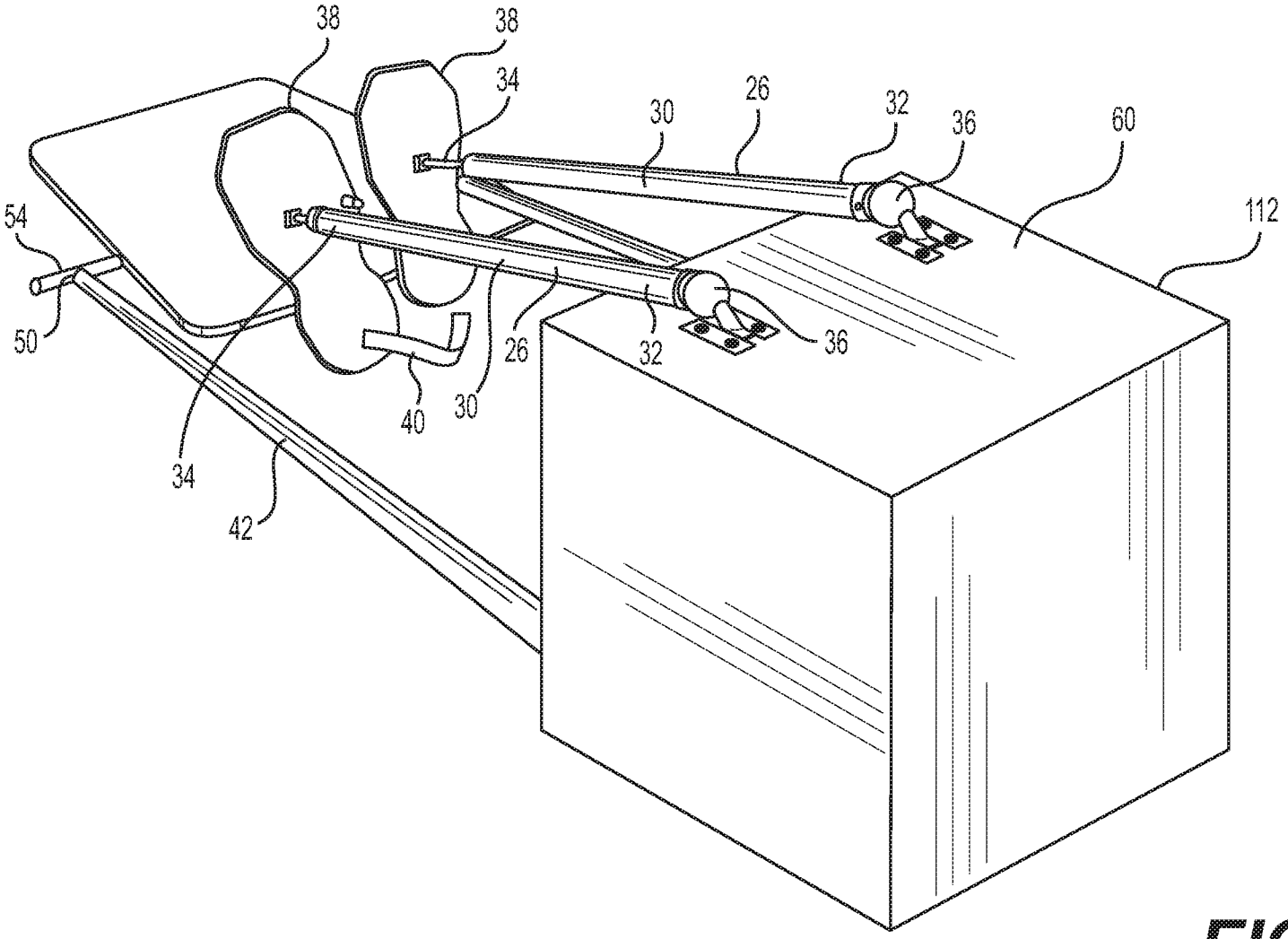
FIG. 8 is a right front perspective view of a second embodiment of the invention.
Figure 9:
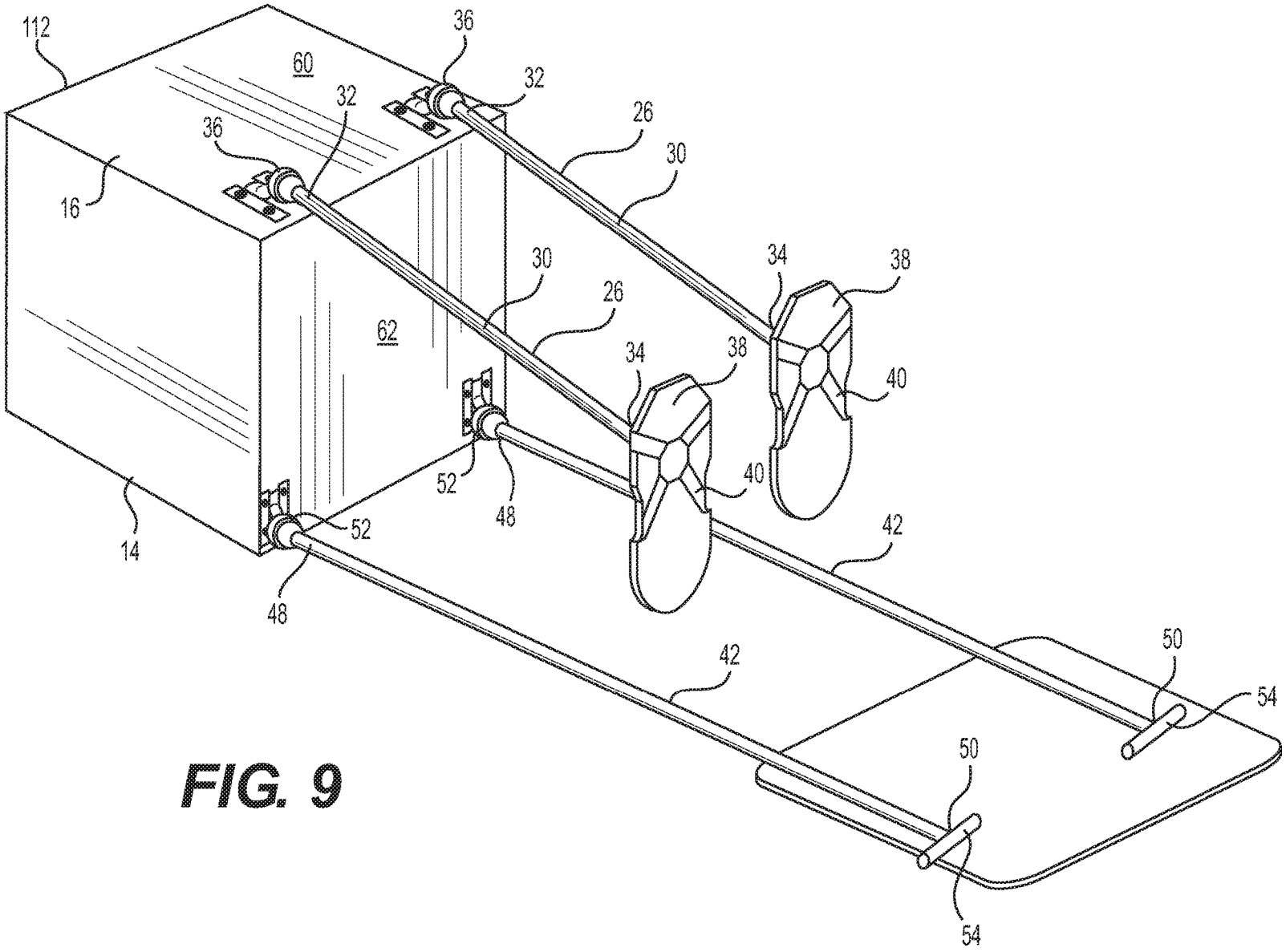
FIG. 9 is a left rear perspective view of the second embodiment of the invention.

An alternative embodiment is shown in FIGS. 8 and 9, in which a base of any configuration/shape is contemplated. By way of example but not by way of limitation, a rectangular-shaped base 112 is shown. Base 112 may be water-Tillable or otherwise constructed and arranged to be heavy enough to remain in place while being used by someone exercising, and/or to accommodate some form of removable weight (not shown) such as sand or discrete, removable weight elements. Base 112 provides support for the pair of resistance elements 26 and a solid structure for the exercise apparatus as a whole. The frame/base 112 still has a first, lower, section 14 and second, upper, section 16. The frame/base 112 also has a top face 60 where the first pair of resistance elements 26 are attached using pivot joint 36. The second pair of resistance elements 42 are also attached to a lower portion of front face 62 of the frame/base 112 using pivot joints 52.

The unit may include one or more devices to monitor such things as heart rate, oxygen flow (VO2 max), blood pressure, and temperature or any newly developed health monitoring devices.

Figure 10:
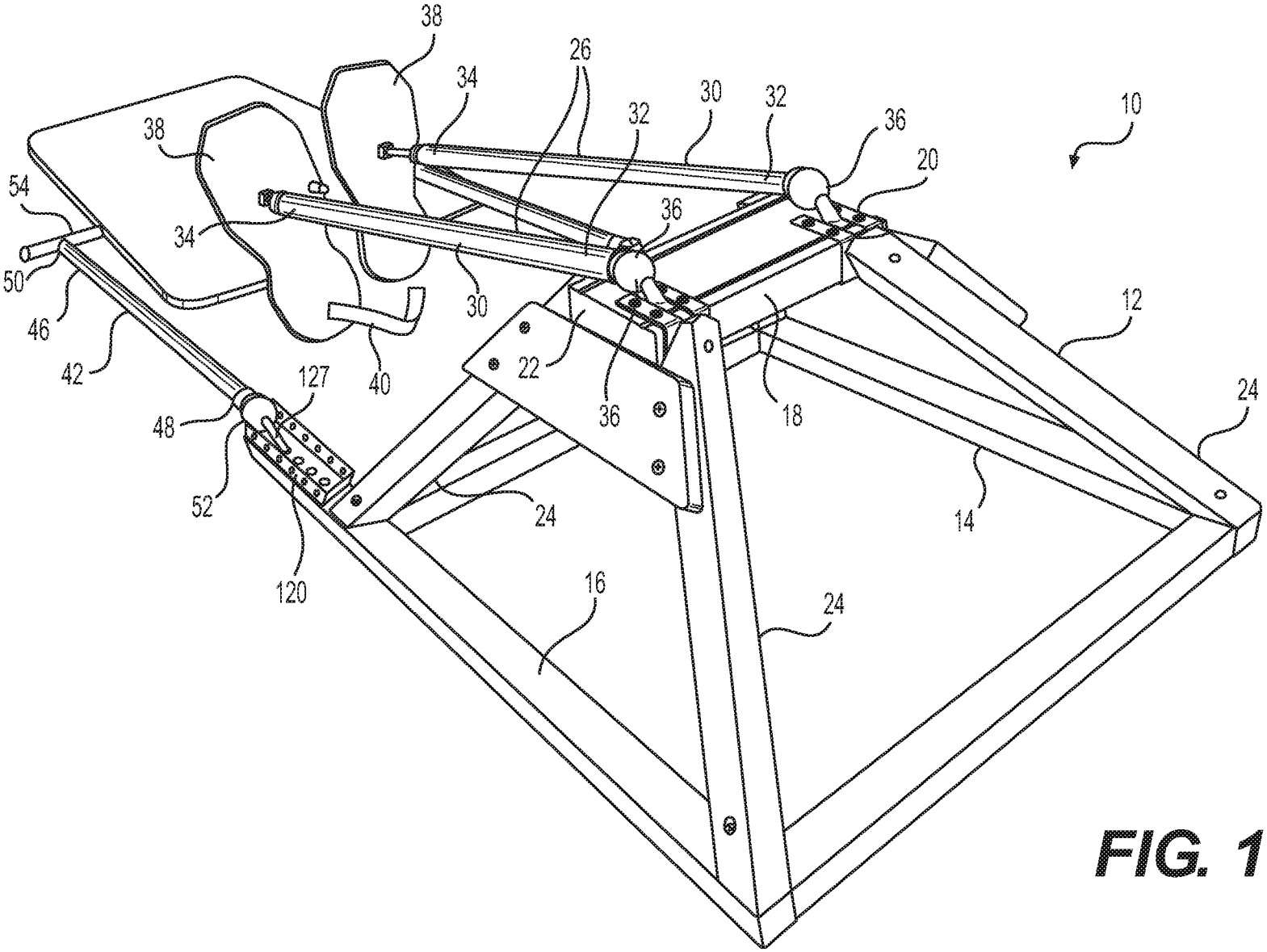
FIG. 10 is a right front perspective view of a third embodiment of the invention.
Figure 11:
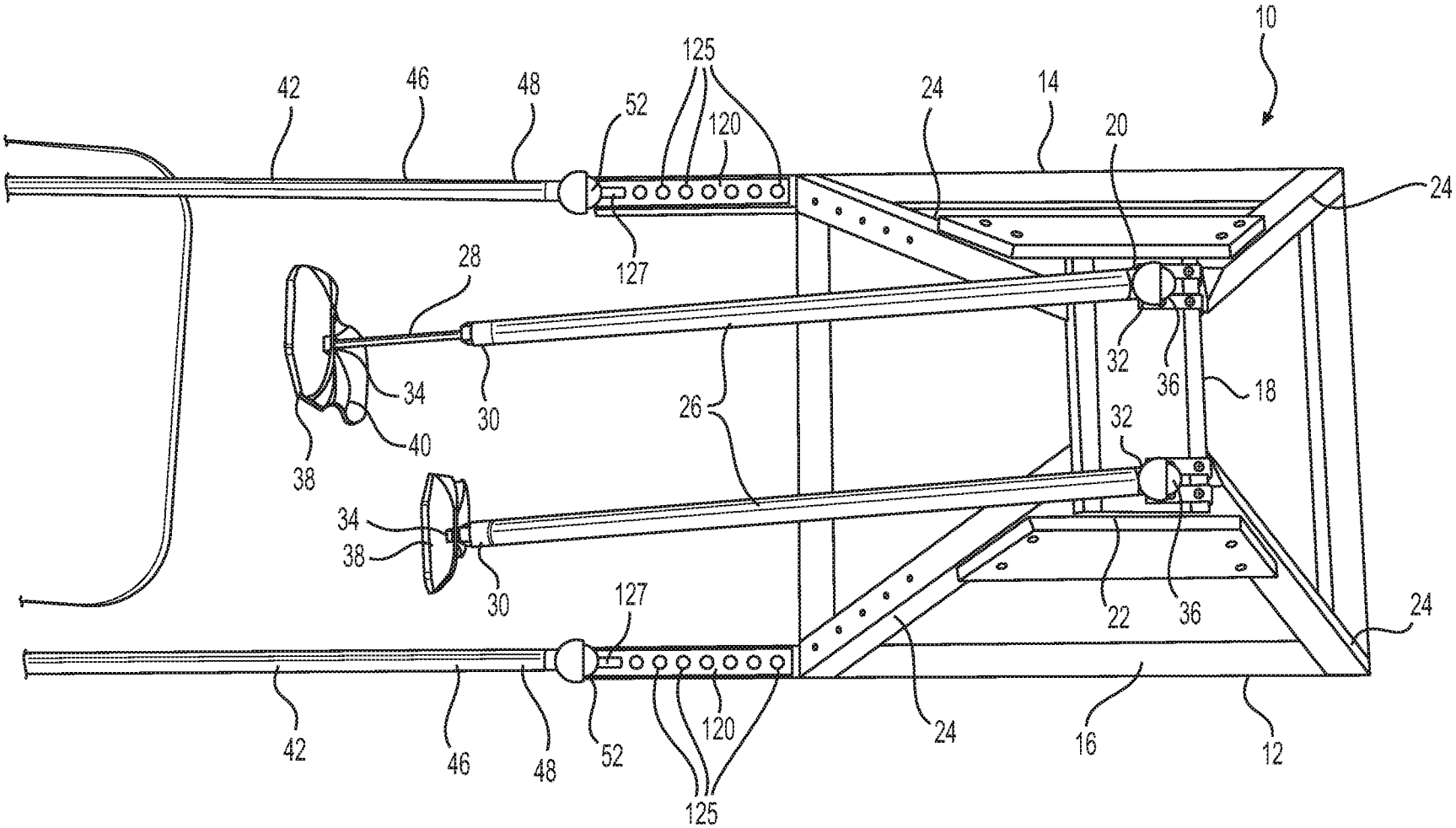
FIG. 11 is a top plan view of the third embodiment of the invention.

In another embodiment, such as shown in FIGS. 10-11, base 12 or 112, or a base comprised simply of a flat plate or the like (not shown) (e.g., steel), which is heavy enough to remain in place while the device is in use, to which is connected resistance elements 26, 42, may be constructed and arranged to be placed on or mounted to a surface such as a wall or floor.

In embodiments, a back support structure may be employed to support the user either on the ground/floor or above the ground/floor. Such a support may be connected to bases 12/112 or be independent thereof.

In another embodiment, the arm or leg resistance elements, or all of them, may be movably connected to the base to permit extended appendage movement by larger (i.e., taller) users. In one embodiment shown in FIGS. 10-11, arm resistance elements 42, through joints 52, are slideably connected to base 12/112 via tracks 120. Joints 52 are slideably disposed in tracks 120 such that joint 52 will slide back and forth in response to user adjustment, allowing for different sized individuals to use the device. Joints 52 may be releasably locked into place relative to tracks 120 via a suitable locking structure. Any structure for allowing releasable locking of joints 52 may be used, such as aligned holes 125 through which may be passed a removable locking pin 127.

Figure 12:
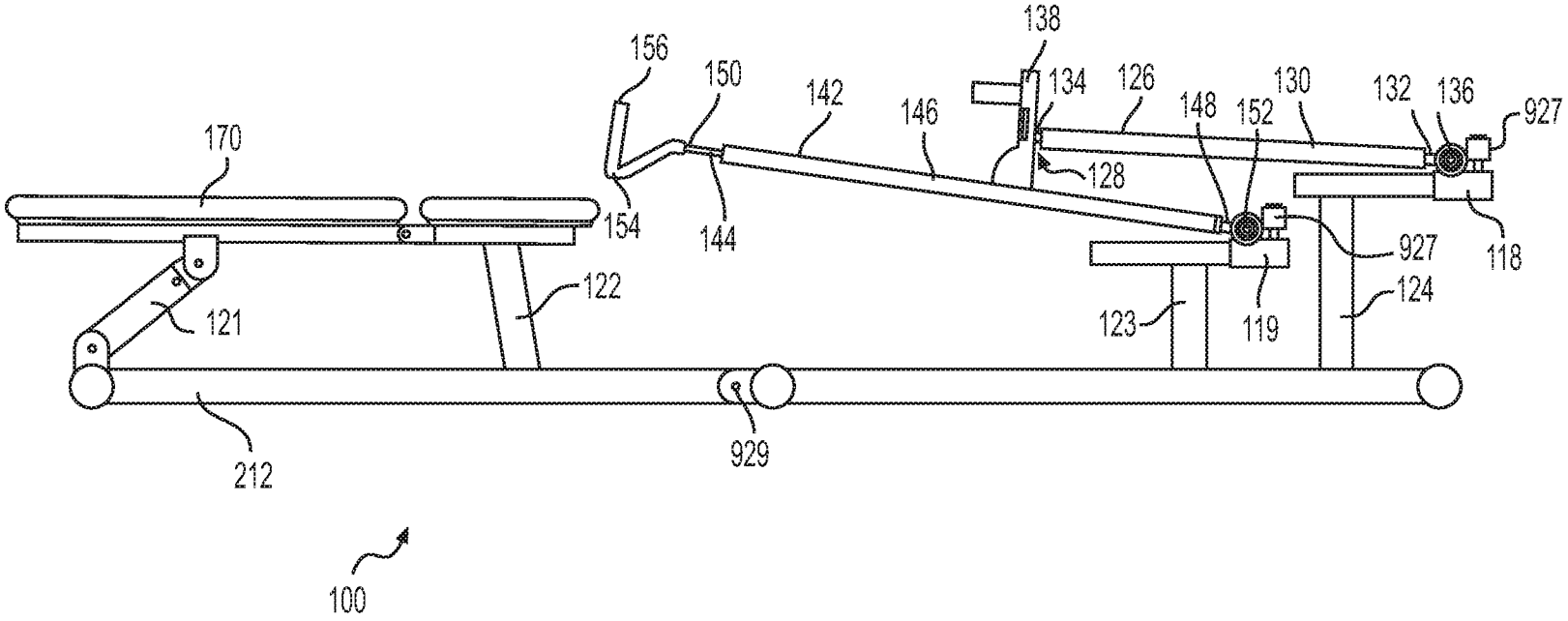
FIG. 12 is a right elevational view of a fourth embodiment of the invention in an extended position.
Figure 13:
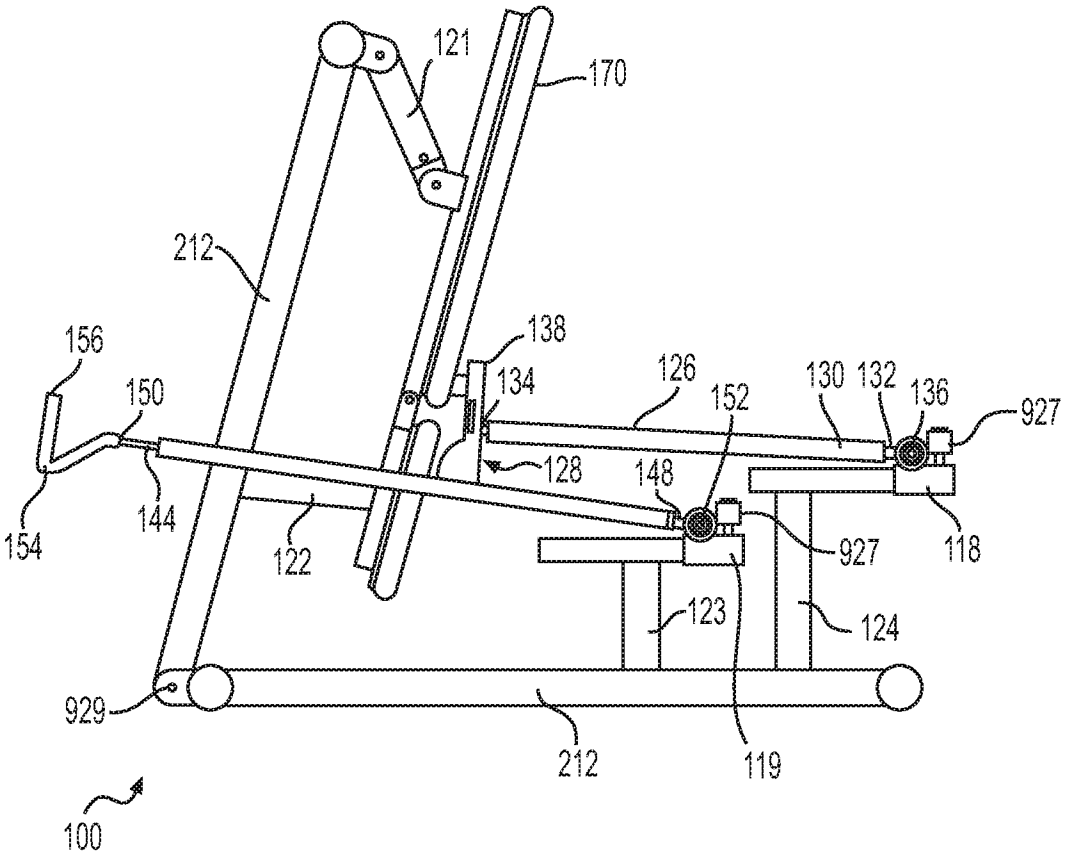
FIG. 13 is a right elevational view of the fourth embodiment of the invention in a folded position.
Figure 14:
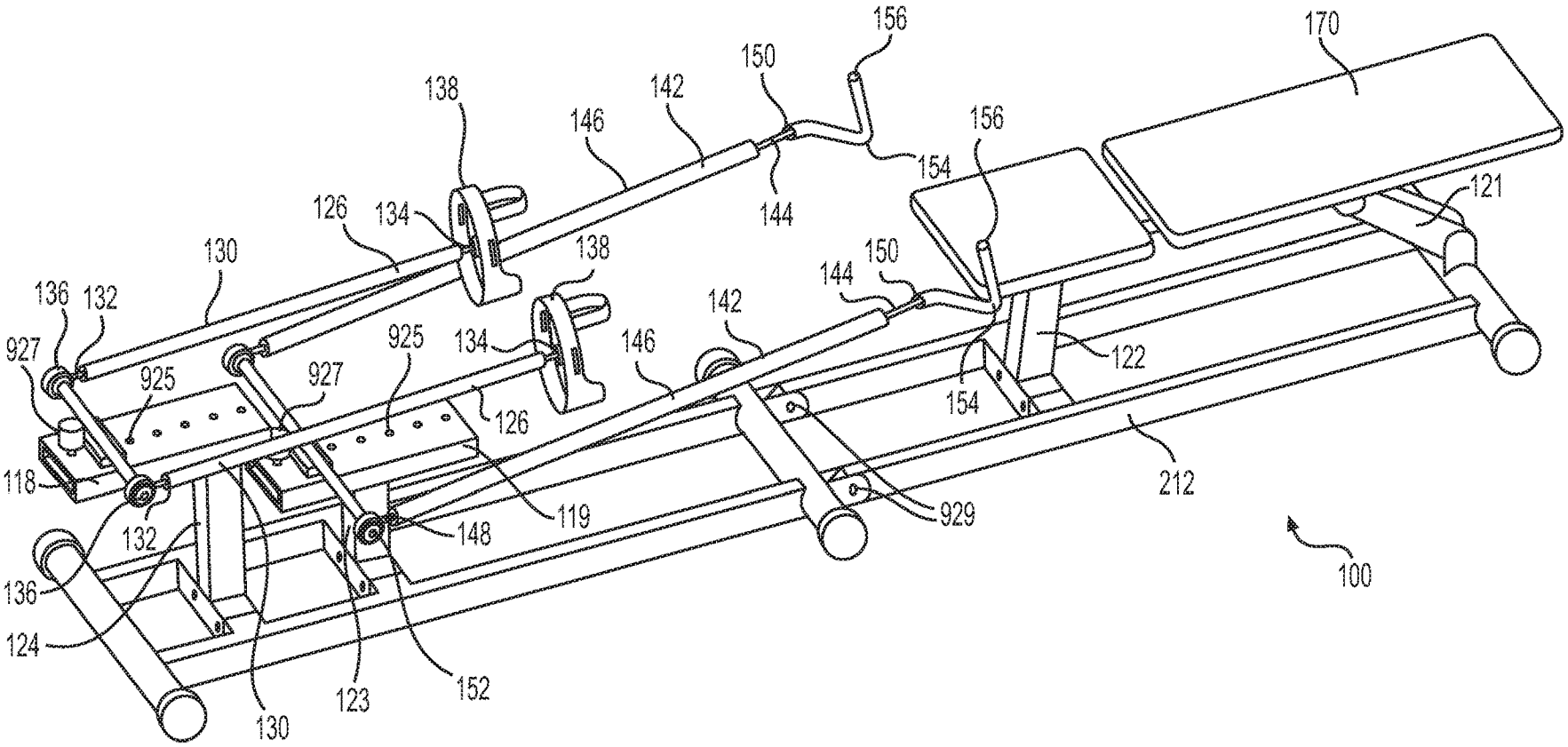
FIG. 14 is a left front perspective view of a fifth embodiment of the invention in an extended position.

In another embodiment, as illustrated in FIGS. 12-14, the exercise apparatus 100 is comprised of a frame/base 212, a first pair of resistance elements 126, a second pair of resistance elements 142, and a bench 170. By way of example but not by way of limitation the frame/base 212 is comprised of multiple elongated members. In various other embodiments, the frame/base 212 is comprised of one or more members arranged in a variety of shapes/configurations. In the current embodiment, the frame/base 212 has one or more supports 123, 124 hingedly connecting the first pair of resistance elements 142, and the second pair of resistance elements 126, respectively, to the frame/base 212.

In various embodiments the support 124 extends higher than the support 123, relative to the frame/base 212, such that when the first pair of resistance elements 126 is hingedly connected to the support 124, and the second pair of resistance elements 142 is hingedly connected to the support 123, the resistance elements 126, 142 do not come in contact with one another during use. In the alternative, the resistance elements 126, 142 may be capable of being switched, in which the first pair of resistance elements 126 are hingedly connected to the support 123, and the second pair of resistance elements 142 are hingedly connected to the support 124. In either configuration the difference in height between the support 124 and the support 123 is such that the resistance elements 126, 142 do not come in contact with one another during use.

The first pair of resistance elements 126 may be any type of apparatus that presents resistance to the user in both flexion and extension, such as hydraulic or pneumatic rams, spring-like members, frictional resistance mechanisms, pulleys, cams, and/or the like. In the case of a hydraulic or pneumatic ram, the resistance elements may be comprised of an inner rod 128 and outer cylinder 130.

The first pair of resistance elements (each denoted by the reference numeral "126") each has a first end 132 and a second end 134. When attached to the support 124, the first ends 132 of the first pair of resistance elements 126 are attached to the first upper platform 118 through the use of pivot joints 136 such as ball and socket joints or other structure permitting substantially free range of motion. Joints 136 may, in one or more embodiments, be adjustably connected so as to permit adjustment of the position of resistance element 126 relative to the user, to accommodate different sized users and/or different exercise modalities. The adjustability of the connection position allows for the distance from the connection points of the joints 136 relative to the user to be altered to the preference of the user. The user may also be able to adjust the resistance provided by the first pair of resistance elements 126.

The adjustability of the distance of the connection points of the joints 136 relative to the user may be achieved through any suitable locking structure, such as aligned holes 925 through which may be passed a removable locking pin 927. As seen in FIGS. 12-14, the removable locking pin 927 may comprise a spring loaded knob and pin combination, whereas once pulled up, the joints 136 slidingly engage with the aligned holes 925 in the first upper platform 118.

The second ends 134 of the first pair of resistance elements 126 have associated therewith foot engaging members 138 adapted to engage the user's feet during use of the device. The foot engaging members 138 are capable of removably securing the user's feet to the foot engaging members 138. The ability of removably securing the user's feet may be achieve through any suitable securing structure, currently known or unknown, such that when the exercise apparatus 100 is in use the user's feet remain fixed to the foot engaging members 138. In various embodiments, the securing ability may be provided by at least a portion of the foot engaging member 138 enveloping the user's foot. The foot engaging member 138 may comprise multiple components, of a variety of differing materials, configured in a variety of manners. In one or more embodiments, the foot engaging member 138 may include a base portion, a webbing or strap portion, and a heel portion. In other embodiments, not shown, the foot engaging member 138 may include various other components such as to allow the foot engaging member 138 to removably secure the user's foot. In one or more embodiments, the foot engaging members 138 may be removable and replaceable with a differently configured foot engaging member 138.

Hingedly attached to the frame/base 212 are a second pair of resistance elements 142, which may be any type of apparatus that presents resistance to the user in both flexion and extension, such as hydraulic or pneumatic rams, spring-like members, frictional resistance mechanisms, pulleys, cams, and/or the like. In the case of hydraulic or pneumatic ram, the resistance elements may be comprised of an inner rod 144 and an outer cylinder 146, or vice versa.

The second pair of resistance elements (each denoted by the reference numeral "142") each has a first end 148 and a second end 150. When attached to the support 123, the first ends 148 of the second pair of resistance elements 142 are attached to the second upper platform 119 through the use of pivot joints 152 such as ball and socket members or other structure permitting substantially free range of motion. Joints 152 may, in one or more embodiments, be adjustably connected so as to permit adjustment of the position of resistance element 142 relative to the user, to accommodate different sized users and/or different exercise modalities. The adjustability of the connection position allows for the distance from the connection points of the joints 142 relative to the user to be altered to the preference of the user. The user may also be able to adjust the resistance provided by the second pair of resistance elements 142.

The adjustability of the distance of the connection points of the joints 152 relative to the user may be achieved through any suitable locking structure, such as aligned holes 925 through which may be passed a removable locking pin 927. As seen in FIGS. 12-14, the removable locking pin 927 may comprise a spring loaded knob and pin combination, whereas once pulled up, the joints 152 slidingly engage with the aligned holes 925 in the second upper platform 119.

Second ends of the second pair of resistance elements 142 have associated therewith hand engaging members 154 adapted to be engaged by the user's hands during use of the device. The hand engaging members 154 can be a handle 156 or a grip, or any other known or unknown hand engaging configuration or structure. The hand engaging members 154 may comprise multiple components, of a variety of differing materials, configured in a variety of manners. In one or more embodiments, the hand engaging members 154 may be removable and replaceable with a differently configured hand engaging member 154. One or more hand engaging members 154 may be of a fixed structure, and one or more hand engaging members 154 may have at least of a portion that is flexible, the flexible structure may include but is not limited to fabric.

In an embodiment, each resistance element 126, 142, is independent and bidirectional and can provide resistance in a number of ways, including, but not limited to, pneumatics, hydraulics, springs, pulleys, cams, and any other apparatus, now known or currently unknown, that resists the pushing or pulling forces exerted by the user. The action of the arms and legs in bi-directional movement while being resisted by the resistance elements in both directions offers near full body exercise of the agonist/antagonist muscles using flexion and extension action of the larger muscle groups in a gait pattern, simultaneously.

In the current embodiment, the bench 170 is elevated from the frame/base 212 by one or more supports 121, 122. In various other embodiments, the bench 170 may rest on the frame/base 212. In the current embodiment, one way to use the exercise apparatus 100 allows the person lay their back on the bench 170, place their feet in the foot engaging members 138, hold onto the hand engaging members 154, and move their arms and legs against resistance in near-complete range of motion.

The unit allows for near-complete joint range of motion in active and resistant movements. That is, for example, the following magnitude of movements can be achieved in the following joints: elbow flexion: 0-150 degree movement, shoulder flexion: 0-180 degree movement, knee flexion: 0-100 degree movement, hip flexion: 0-120 degree movement. These ranges represent what is essentially free range of movement for all four limbs, thereby providing a full body workout engaging multiple muscle groups.

In various embodiments, the frame/base 212 may include one or more removable locking pins 929. When utilized, the removable locking pins 929 may allow for the frame/base 212 to pivotally fold from an extended position, as shown in FIG. 12, to a folded position, as shown in FIG. 13. The removable locking pin 929 may comprise a spring loaded knob and pin combination, whereas once pulled up, the frame/base 212 is no longer locked in a uniform section, but instead is able to fold upon itself. In other embodiments, the removable locking pin 929 may be of the fixed pin and hole variety. By allowing for frame/base 212 to fold up, the exercise apparatus 100 is able to be stored in a more space-efficient manner.

In various embodiments, the supports 121, 122 may allow for various portions of the bench 170 to be elevated in various degrees. In the preferred embodiment, the range of degree variation can allow for the bench 170 to form any angle between 90 to 180 degrees. In various other embodiments, the bench 170 may form an angle greater than 180 degrees. By providing for variation in the angle of the bench 170, the position of the resistance elements 126, 142 relative to the user are able to be altered, thus allowing the user to focus on differing muscle groups.

Figure 15:
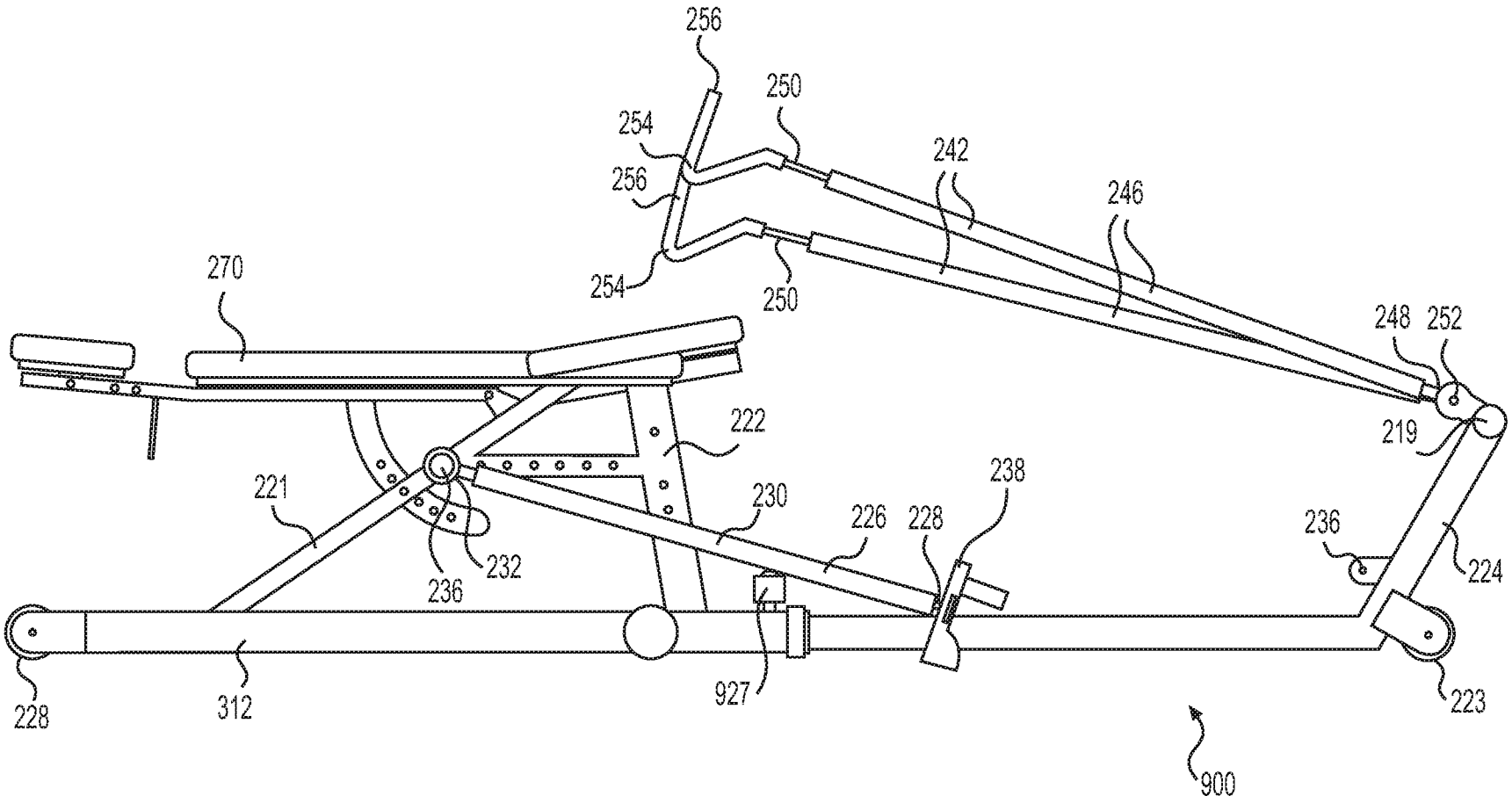
FIG. 15 is a right elevational view of the fifth embodiment of the invention.
Figure 16:
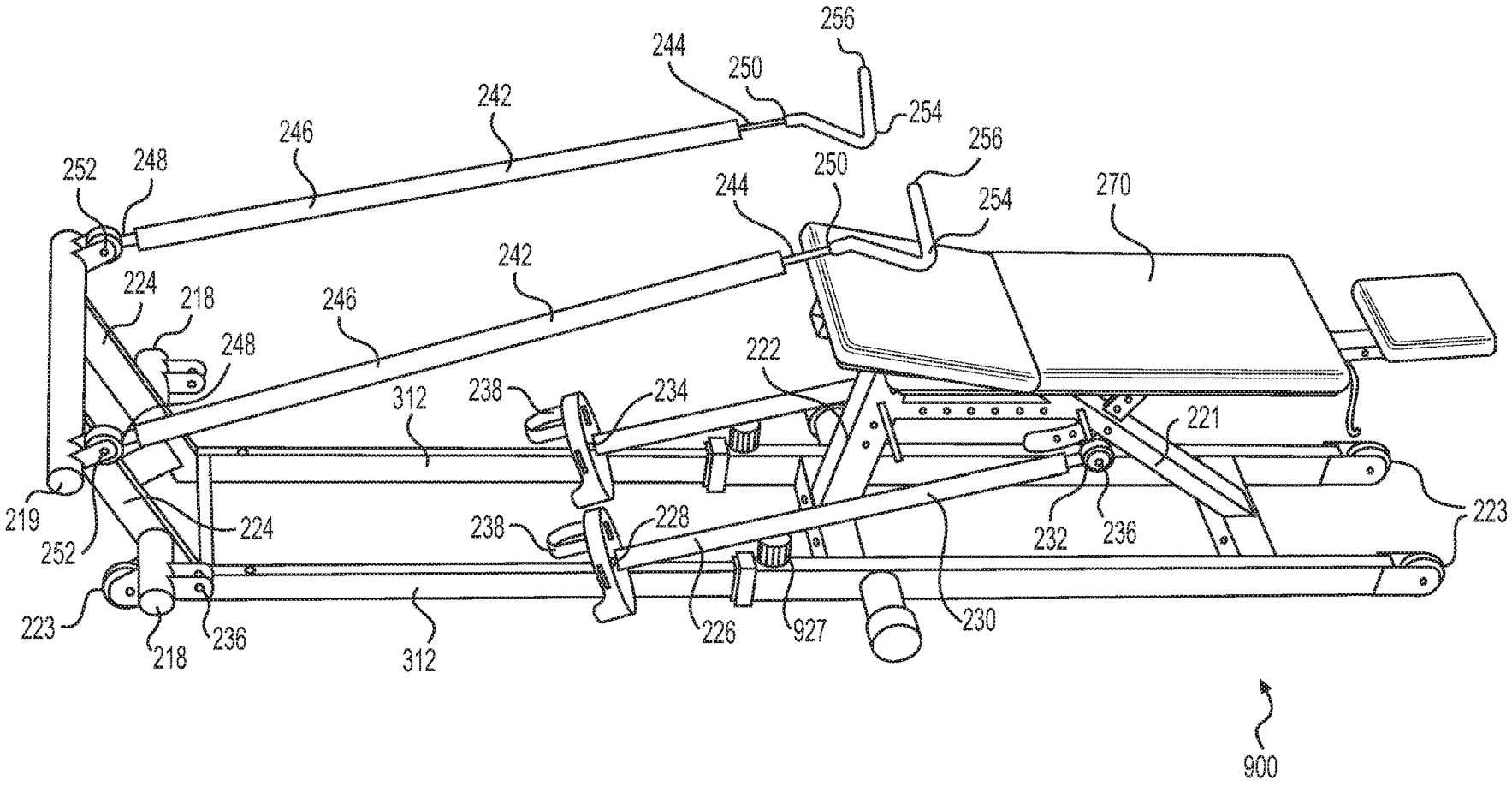
FIG. 16 is a left front perspective view of the fifth embodiment of the invention.

In another embodiment, as illustrated in FIGS. 15-16, the exercise apparatus 900 is comprised of a frame/base 312, at least one pair of resistance elements 242, and a bench 270. By way of example but not by limitation, the frame/base 312 is comprised of multiple elongated members. In various embodiments, such as the embodiment depicted in FIG. 17, the frame/base 312 may include one or more locking pins 927 to allow for the various members to slidingly-engage with one another so as to allow the frame/base 312 to be capable of lengthening or shortening. As seen in FIGS. 15 and 16, the removable locking pin 927 may comprise a spring loaded knob and pin combination, whereas once pulled up, the frame/base 312 is able to telescopically elongate. In various other embodiments, the frame/base 312 may be comprised of one or more members comprised in a variety of shapes/configurations. The frame/base 312 has one or more supports 221, 222, 224. Resistance elements 242 are hingedly connected to the frame/base 312 via support 224.

The resistance elements 226, 242 may be any type of apparatus that presents resistance to the user in both flexion and extension, such as hydraulic or pneumatic rams, spring-like members, frictional resistance mechanisms, pulleys, cams, and/or the like. In the case of a hydraulic or pneumatic ram, the resistance elements 226, 242 may be comprised of inner rods 228, 244, and outer cylinders 230, 246, respectively.

The resistance elements 242 each have a first end 248 and a second end 250. The first ends 248 of the pair of resistance elements 242 are attached to the upper platform 219 through the use of pivot joints 252 such as ball and socket joints or other structure permitting substantially free range of motion. The user may be able to adjust the resistance provided by the pair of resistance elements 242. In the alternative, the resistance elements 242 are capable of attaching to the lower platform 218, wherein the connection may be made through the use of pivot joints 236 such as ball and socket or other structure permitting substantially free range of motion.

In this embodiment, as shown in FIG. 16, both the upper platform 219 and the lower platform 218 are located on the same support structure 224. In various embodiments the support structure 224 may be angled relative to the frame/base 312, or in the alternative, may be perpendicular to the frame/base 312. Both the upper platform 219 and the lower platform 218 are capable of having resistance elements 226, 242 attached thereto. In various versions of use the upper platform 219 hingedly attaches the first resistance element 226, where the lower platform 218 hingedly attaches the second resistance element 242. Whereas, when the upper platform 219 is hingedly attached to the second resistance element 226, the lower platform 218 may hingedly attach the first resistance element 226.

In this embodiment, the upper platform 219 and the lower platform 218 are configured in a cross-brace fashion with hinges at either end to attach the resistance elements 226, 224. In various embodiments, either one or both of the upper platform 219 and the lower platform 218 may span the entire width of the support structure 224. For instance, in the embodiment shown in FIG. 16 the upper platform 219 spans across the width of the support structure 224, where the lower platform 218 is comprised of two independent sections that do not span the width of the support structure 224.

Second ends 250 of the pair of resistance elements 242 have associated therewith hand engaging members 254 adapted to be engaged by the user's hands during use of the device. The hand engaging members 254 can be a handle 256 or a grip, or any other known or unknown hand engaging configuration or structure. The hand engaging members 254 may comprise multiple components, of a variety of differing materials, configured in a variety of manners. In one or more embodiments, the hand engaging members 254 may be removable and replaceable with a differently configured hand engaging member 254. One or more hand engaging members 254 may be of a fixed structure, and one or more hand engaging members 254 may have at least a portion that is flexible, the flexible structure may include but is not limited to fabric.

Figure 17:
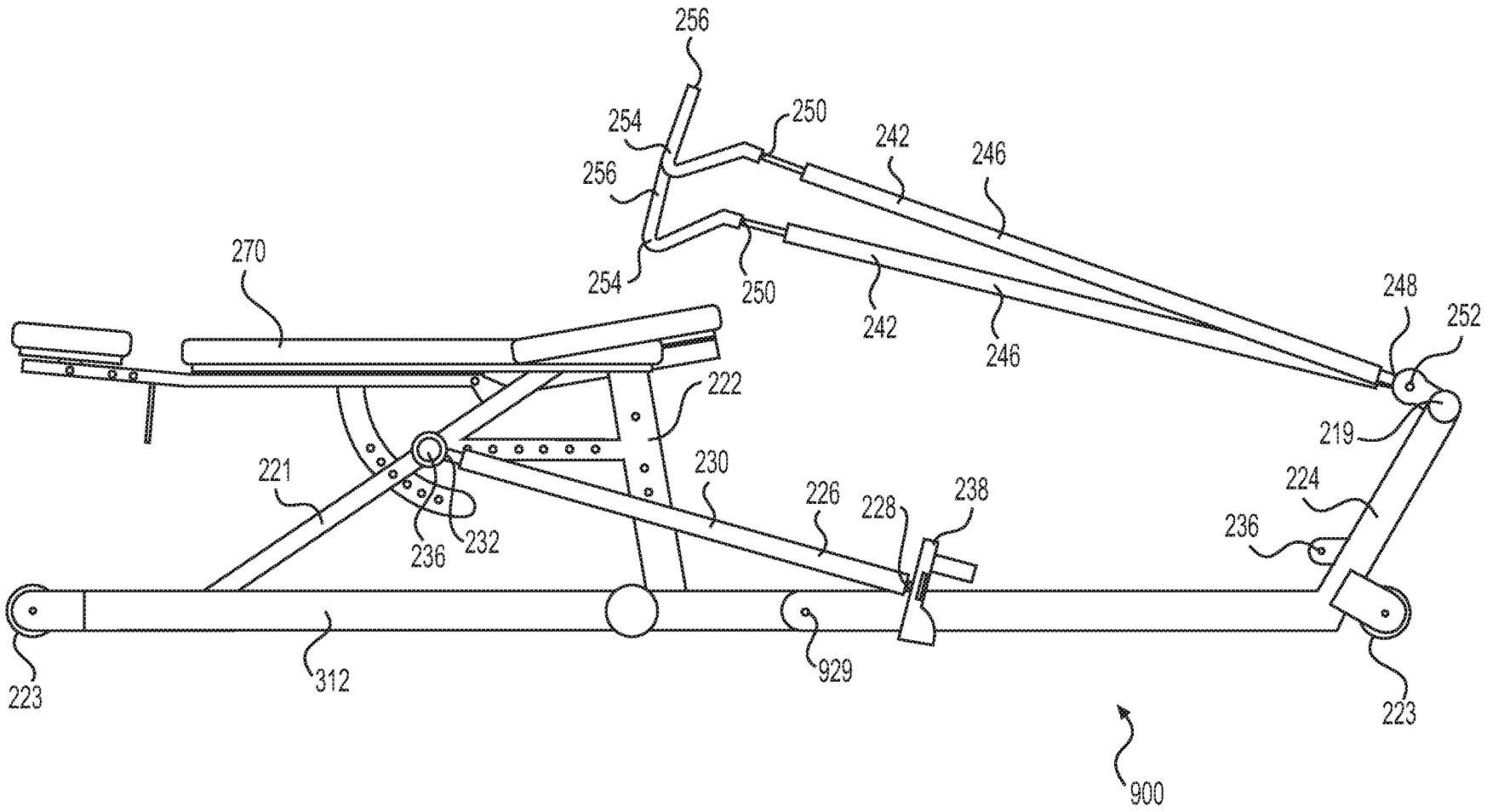
FIG. 17 is a right side elevational view of a sixth embodiment of the invention in an extended position.
Figure 18:
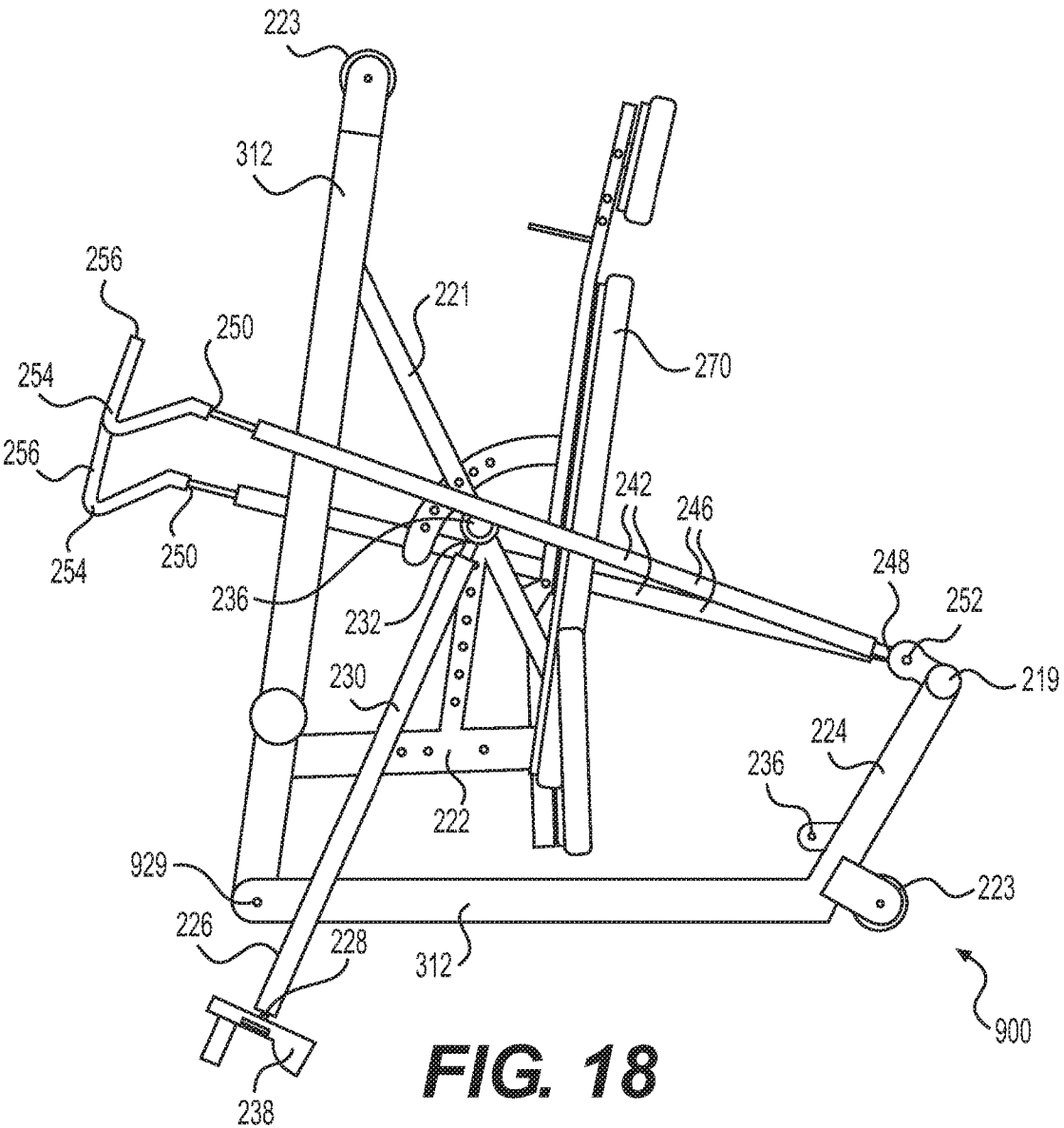
FIG. 18 is a right side elevational view of the sixth embodiment of the invention in a folded position.
Figure 19:
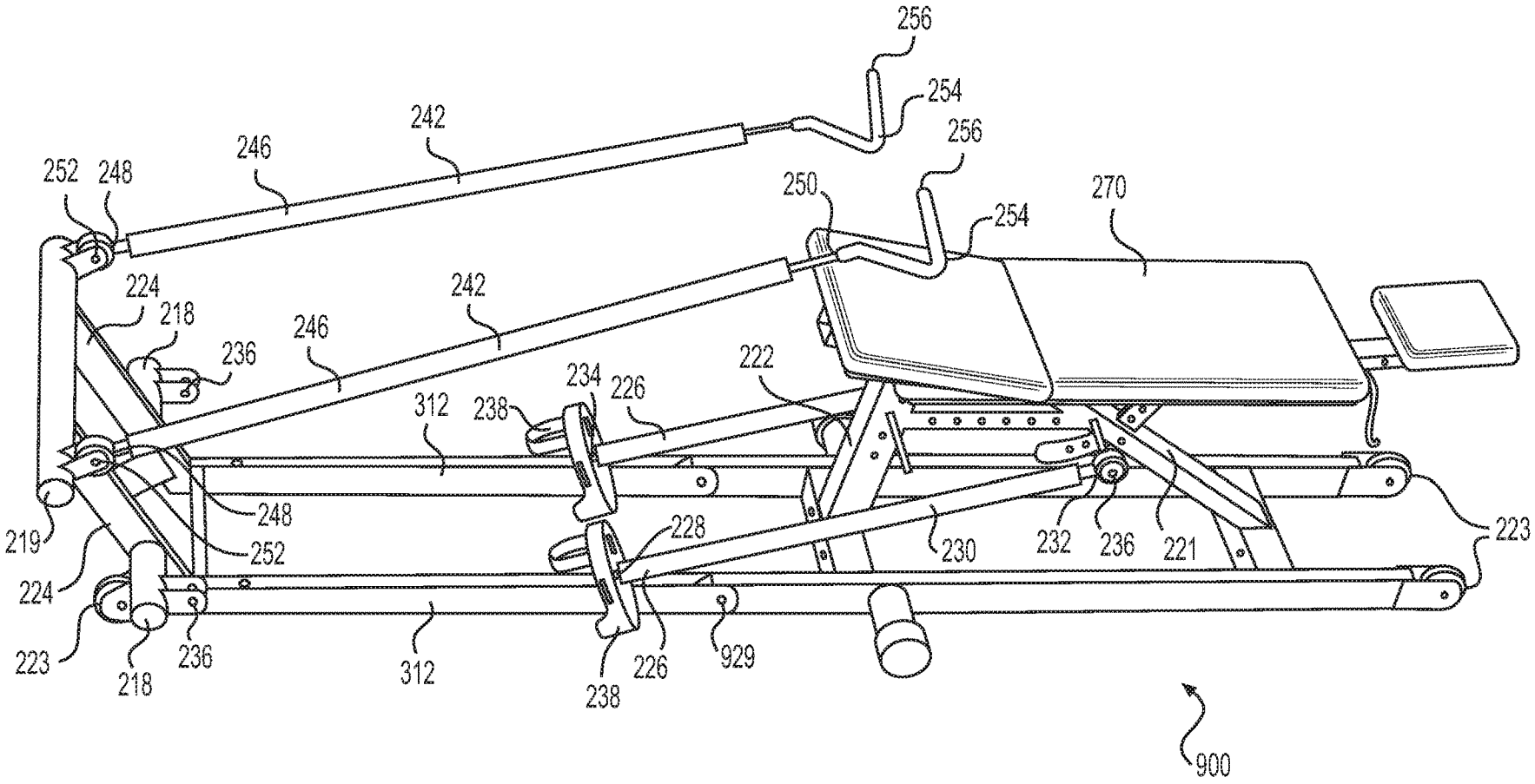
FIG. 19 is a left front perspective view of the sixth embodiment of the invention in an extended position.

In another embodiment, as shown in FIG. 17-19, the first end 232 of the resistance elements 226 may be attached under the bench 270, or, in the alternative, may be attached to the upper platform 218, in either attachment the connection may be made through the use of pivot joints 236 such as ball and socket or other structure permitting substantially free range of motion. The user may be able to adjust the resistance provided by the pair of resistance elements 226.

In the preferred embodiment, the resistance elements 226, 242, are independent and bidirectional and can provide resistance in a number of ways, including, but not limited to, pneumatics, hydraulics, springs, pulleys, cams, and any other apparatus, now known or currently unknown, that resists the pushing or pulling forces exerted by the user.

In the current embodiment, the bench 270 is elevated from the frame/base 312 by one or more supports 221, 222. In various other embodiments, the bench 270 may rest on the frame/base 312.

One method of using the exercise apparatus 900 allows for the person to lay on their back on the bench 270, place their feet in either a foot engaging member 238, as shown in FIGS. 12-14, on the floor, on the frame/base 312, on the lower platform 218, or the upper platform 219, hold onto the hand engaging members 254, and move their arms and/or legs against resistance in near-complete range of motion.

The unit allows for near-complete joint range of motion in active and resistant movements. That is, for example, the following magnitude of movements can be achieved in the following joints: elbow flexion: 0-150 degree movement, and shoulder flexion: 0-180 degree movement. These ranges represent what is essentially free range of movement, thereby providing a workout engaging multiple muscle groups.

In differing embodiments, as shown in FIGS. 17-19, the frame/base 312 may include one or more removable locking pins 929 that allow for the frame/base 312 to pivotally fold from an extended position, as shown in FIG. 17, to a folded position, as shown in FIG. 18. The removable locking pin 929 may comprise a spring loaded knob and pin combination, where once pulled up, the frame/base 312 is no longer locked in a uniform section, but instead is able to fold upon itself. In other embodiments, the removable locking pin 929 may be of the fixed pin and hole variety. By allowing for the frame/base 312 to fold up, the exercise apparatus 900 is able to be stored in a more space-efficient manner.

In various embodiments, the frame/base 312 may include wheels 223 either fixed, or removably attached. The wheels 223 allow for the exercise apparatus 900 to be pivotally-lifted and moved without having to fully lift the exercise apparatus 900. Thereby allowing the user to move and position the exercise apparatus 900 on any suitable floor space.

In various embodiments, the supports 221, 222 may allow for various portions of the bench 270 to be elevated to various fixed positions, such as can be seen in FIG. 17. The adjustability of the various portions of the bench 270 may be achieved through any suitable locking structure, such as aligned holes through which may be passed a removable locking pin.

The adjustability of the various portions of the bench 270 may help provide comfort for the user by allowing the user to engage the exercise apparatus 900 in various positions. By enabling the user to engage the exercise apparatus 900 in various positions, the user is able to position themselves in a suitable position to better focus on differing muscle groups. For instance, if the user wishes to focus on their shoulders, the bench 270 will optimally be flat in a 180 degree position. If the user wishes to focus on their biceps and/or triceps, the bench 270 will optimally be positioned between 90 to 120 degrees. However, the optimal position for various users may vary based upon the individual preference of the user.

Figure 20:
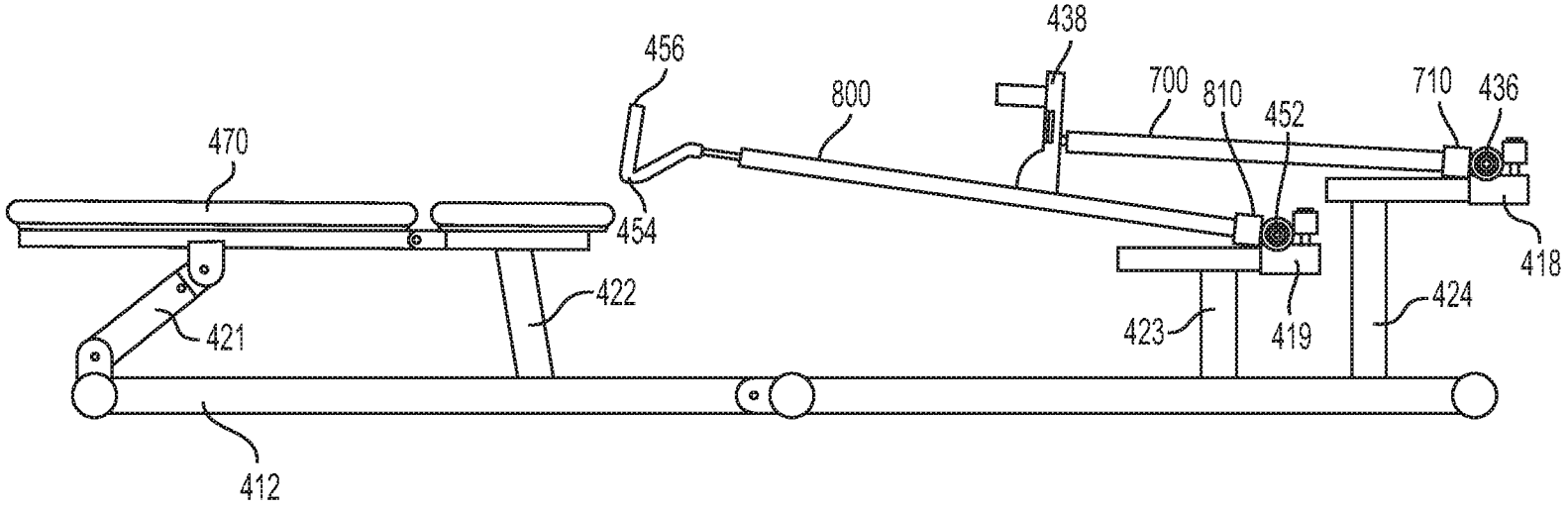
FIG. 20 is a right side elevational view of a seventh embodiment of the invention in an extended position.
Figure 21:
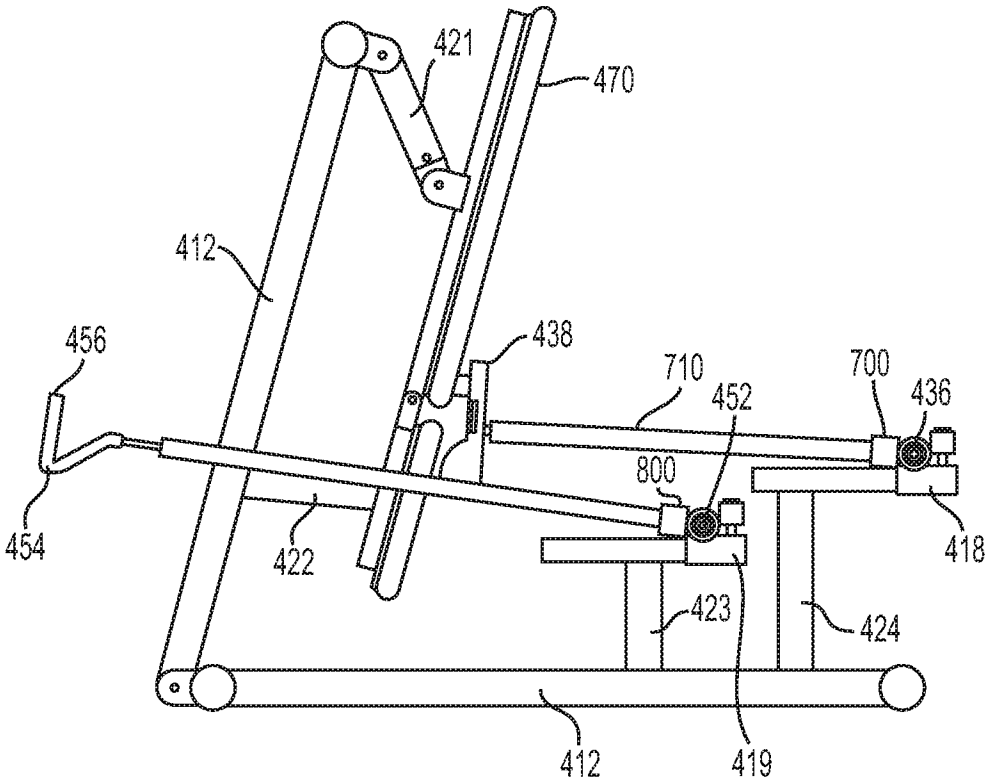
FIG. 21 is a right side elevational view of the seventh embodiment of the invention in a folded position.
Figure 22:
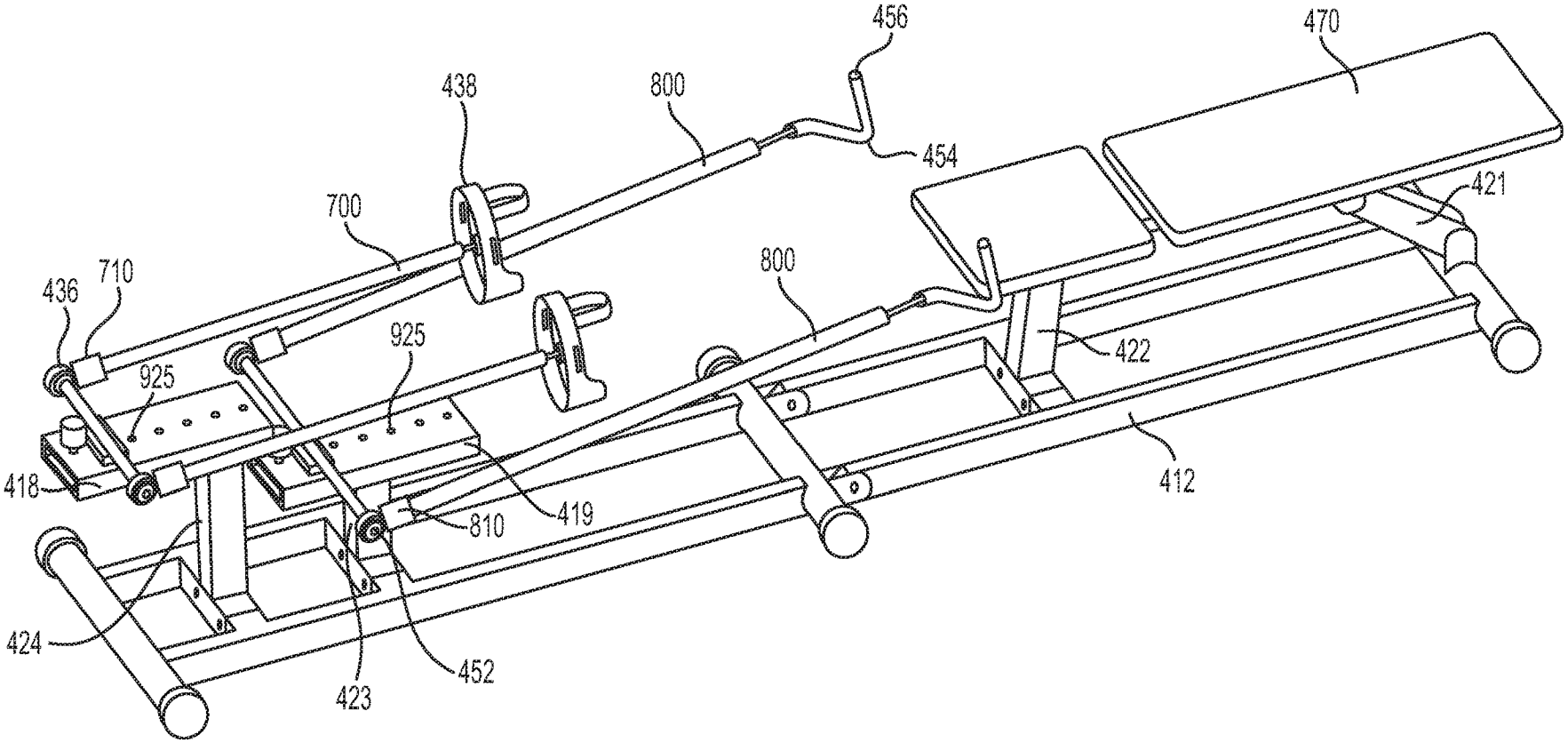
FIG. 22 is a left front perspective view of the seventh embodiment of the invention in an extended position.

In various embodiments, as seen in FIGS. 20-22, either foot-engaging members such as 438 and hand-engaging members such as 454 may be deleted, along with the corresponding resistance elements 700 or 800 to create a less expensive or otherwise preferred exercise device. For example, by deleting the foot-engaging members 438, a true rowing machine results. By deleting the hand engaging member, a leg-only exercise machine is created.

In either event, throughout the foregoing disclosure, whether both foot and leg exercise assemblies are employed, or just one of the foot or leg exercise assemblies are employed, the associated resistance elements may be any unidirectional or bidirectional resistance apparatus, including, by way of example but not by way of limitation, fluid cylinders, electromechanical devices, pulleys, cam devices, leaf spring, coil spring, brakes, or combination thereof. The cam devices may include but are not limited to spring loaded cams. The resistance elements 700, 800, may interchangeably attach to the different support structures 423, 424, which hingedly connect the resistance elements 700, 800 to the frame/base 412 at the location of the joint 436, 452. The joint 436 connects to the support structure 424 on the first upper platform 418, and the joint 452 connects to the support structure 423 on the second upper platform 419. In the various embodiments, the resistance elements 700, 800, may be interchangeable, in which a resistance element 700, 800 of one variety (i.e. fluid cylinders, electromechanical devices, pulleys, cam devices, leaf spring, coil spring, brakes, or combination thereof) may be exchanged for a resistance elements 700, 800, of a different variety (i.e. fluid cylinders, electromechanical devices, pulleys, cam devices, leaf spring, coil spring, brakes, or combination thereof).

The resistance element 700 is connected to a connecting apparatus 710, which is itself connected to first upper platform 418. The resistance element 800 is connected to a connecting apparatus 810, which is itself connected second upper platform 419. The connecting apparatus 710, 810 may be of any suitable structure to connect the resistance elements 700, 800 first and second upper platforms 418, 419, respectively. In various embodiments the connecting apparatus 710, 810 may be either a rigid material, like a metal, plastic, or other suitable bar composition, or may be flexible, like a wire, nylon, or other suitable cable-like structure. Different choice of connection apparatus 710, 810, may be suitable dependent on, among other things, the choice of the resistance element 700, 800. For example, when employing pulleys the connection apparatus 710, 810, best suited will likely be a flexible structure, such as but not limited to a cable.

The resistance elements 700, 800 may be formed through a combination of multiple different varieties of resistance elements. For example, if a pulley is selected the user may also choose to attach a cam device to provide increased resistance for the pulley. The combination of a pulley and cam device may form one unitary resistance element 700, 800. By allowing for a variety of resistance mechanisms to be combined to form one unitary resistance element 700, 800, the user will be further enabled to vary the level of resistance created.

In another form of the invention shown in FIGS. 23A-36C, an exercise device 1000 is disclosed, comprised of a bench support beam 1002, front and rear legs 1006, 1004, respectively, and front and rear ground-engaging members 1010 and 1008, respectively. However, any structure for supporting a user and for situating the device 1000 on the ground is contemplated. In the embodiment shown, bench 1012 is supported by bench support beam 1002. Bench 1012 may be adjustable and may be comprised of more than one section, such as first and second sections 1012A and 1012B, respectively. Bench 1012 may be adjustable or fixed as will be appreciated by those skilled in the art. FIGS. 26A-26D show that the bench 1012 may be situated and/or positioned in any of a number of adjustment positions. Any suitable structure for supporting the bench in one or more adjustment positions is contemplated, such as bench adjustment support struts 1013A and 1013B, which are hingedly connected to bench sections 1012A and 1012B and supported by strut stops 1015A and 1015B, respectively.

In embodiments, right and left leg exercise assemblies 1020R and 1020L, respectively, are employed, which may include right and left bidirectionally movable leg exercise pylons 1026R and 1026L, respectively, which support respective foot engaging members 1027R, 1027L for reciprocal movement by a user in a novel manner employing novel structure that will be explained in more detail below.

Likewise, in embodiments, right and left arm exercise assemblies 1070R and 1070L, respectively, are employed, which may include a pair of left and right bidirectionally movable arm exercise pylons 1066R and 1066L, respectively, and respective hand engaging members 1071R, 1071L, for reciprocal movement by a user in a novel manner and employing novel structure that will be explained in more detail below.

In embodiments, hand engaging members 1071R, 1071L may be connected to arm exercise pylons 1066R and 1066L using arm exercise struts 1062R, 1062L to provide for adequate ergonomic convenience, comfort and efficiency.

In embodiments, arm exercise struts 1062R and 1062L may be connected to arm exercise pylons 1066R and 1066L using any suitable structure. In one embodiment (shown, for example, in FIGS. 23-26D), a compound joint may be employed, providing multiple degrees of freedom to create a comfortable and efficient experience for the user. An exemplary construction of such a joint, by way of example but not limitation, may comprise connecting the distal end 1063R of arm exercise strut 1062R to a clevis joint 1064R as shown and, in turn, connecting clevis joint 1064R to a hinged support plate 1067R which is hingedly connected to arm exercise pylon 1066R via hinge pin 1069R. Clevis joint 1064 R creates a pivot orthogonal to that created by pin 1069 which allows the strut to move left and right. The effect is like a universal joint where the user's hand is not restrained in any axis. This allows the equivalent motion to a ball and socket joint. Similar configurations may be employed for left side arm exercising member 1060L.

Support plate 1067R may be biased away from pylon 1066R so as to assist a user in lifting hand engaging member 1061R, and to likewise dampen the downward movement of hand engaging member 1061R and downward movement of strut 1062R in the event that the user drops the hand engaging member from an elevated position, limiting damage and undue wear to the apparatus.

Figure 23A:
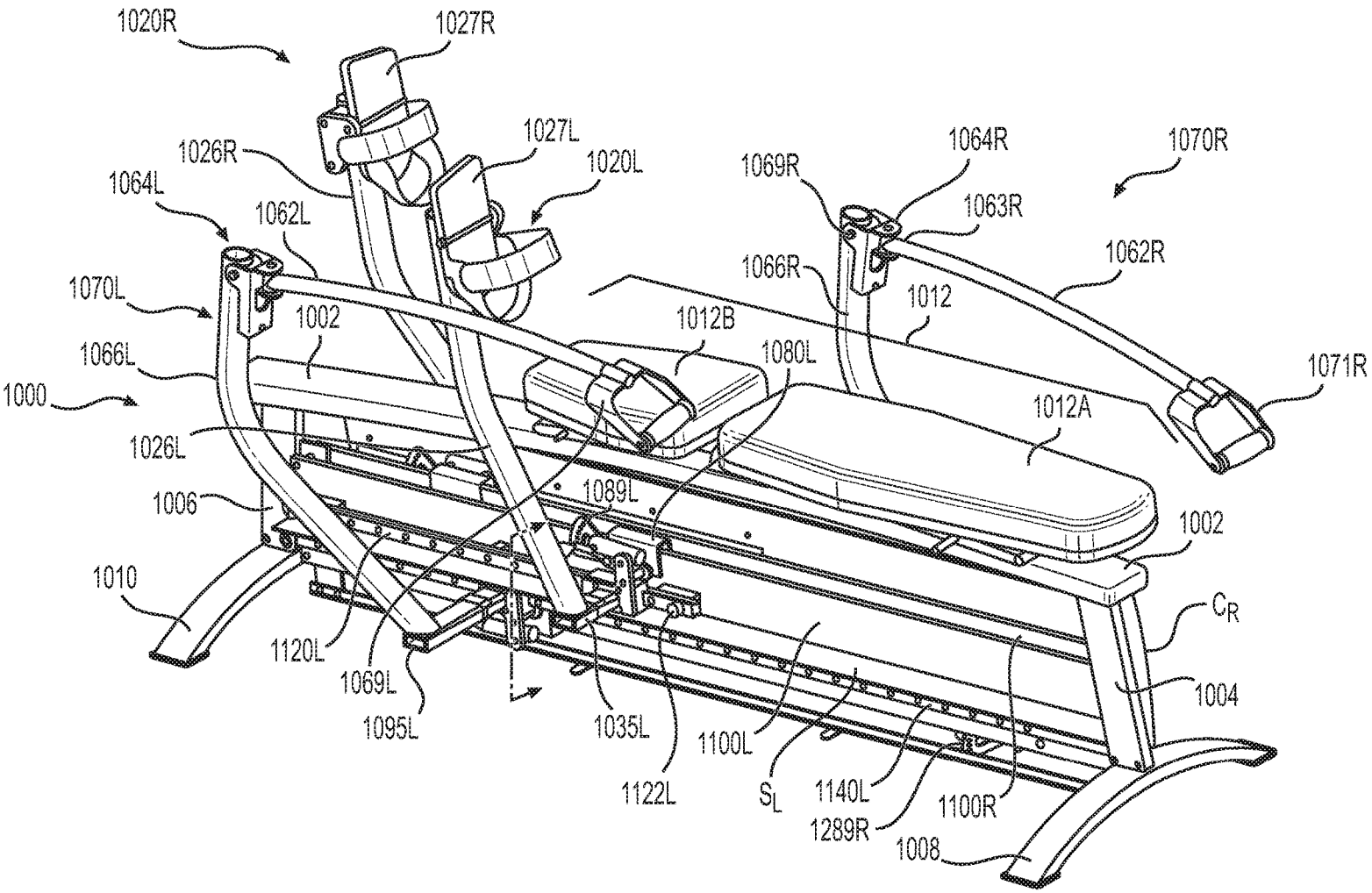
FIG. 23A is a left, rear perspective view of an eighth embodiment of the invention.
Figure 23B:
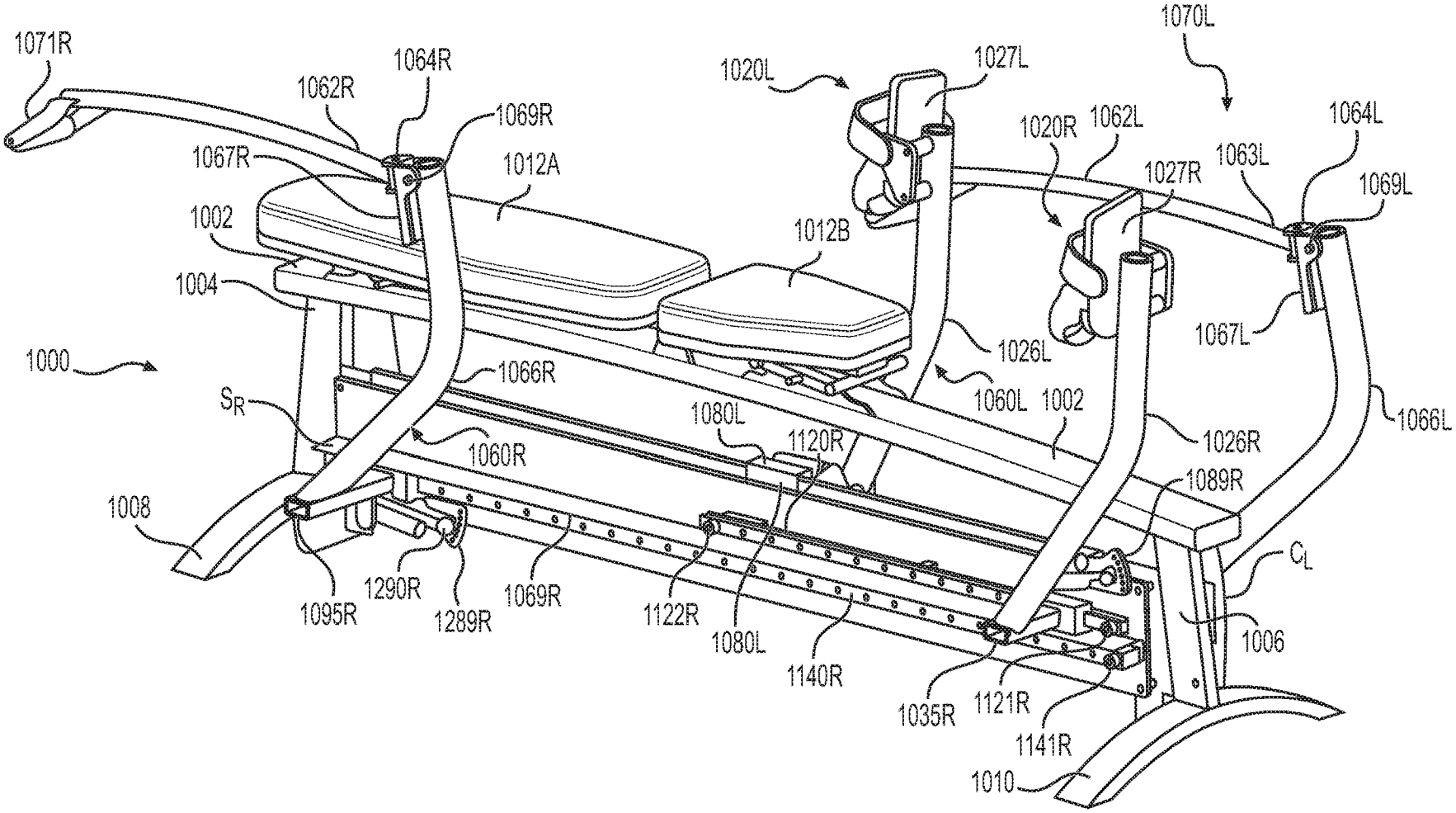
FIG. 23B is a right, front perspective view thereof.
Figure 24:
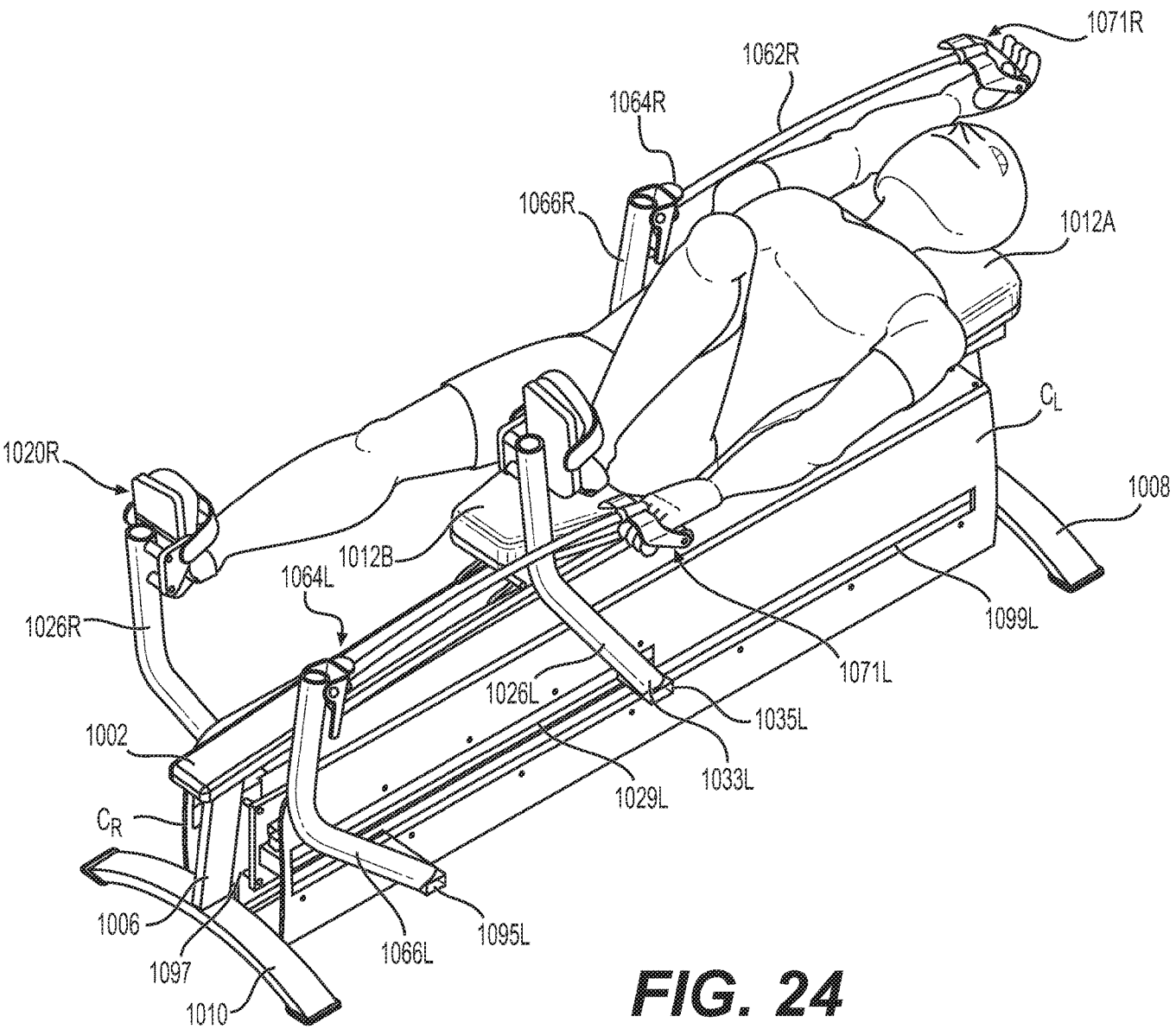
FIG. 24 is a left, front perspective view thereof showing a schematic user in place on the device.
Figure 25:
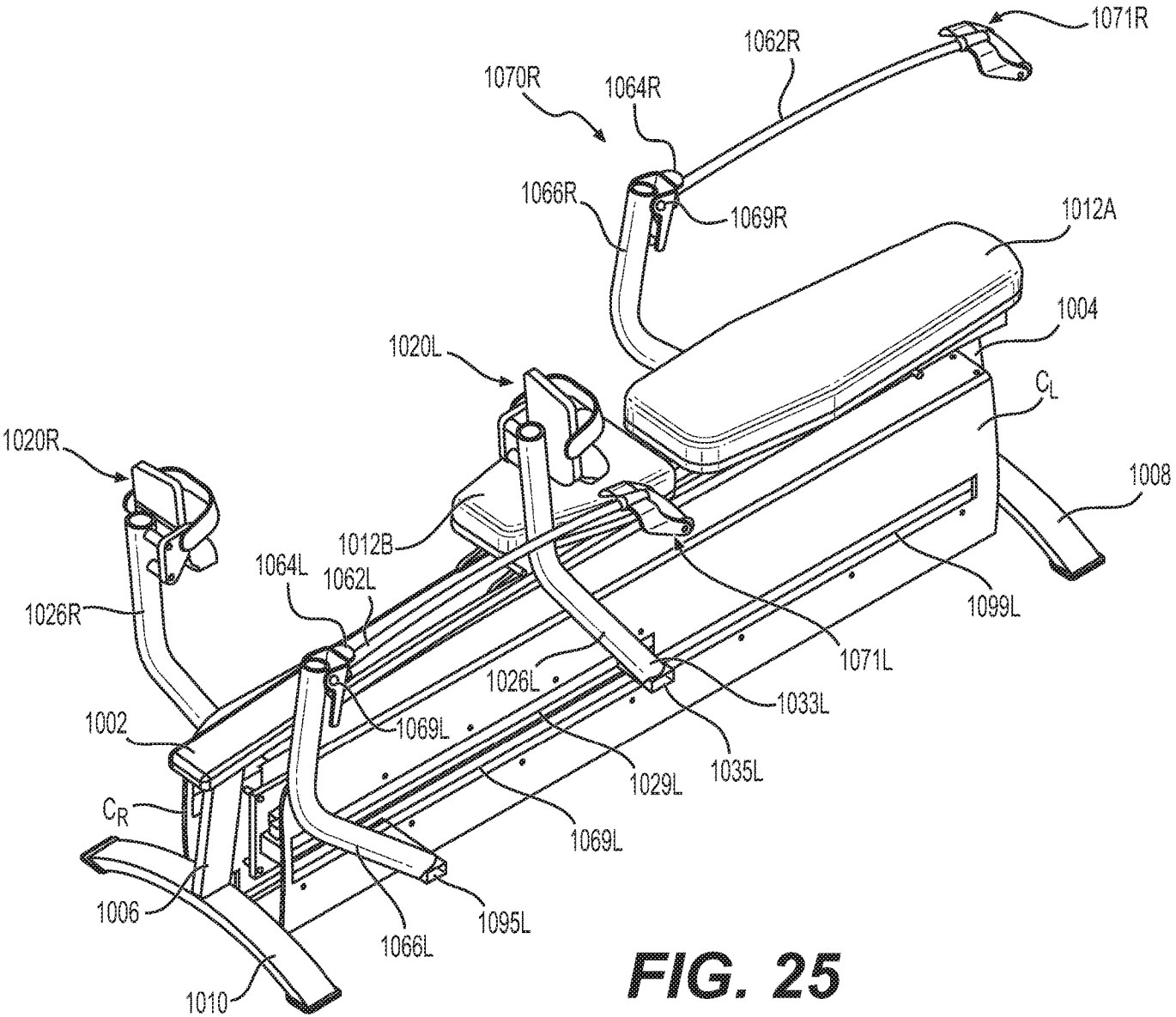
FIG. 25 is a left, front perspective view thereof without the schematic user in place on the device.
Figure 26A:
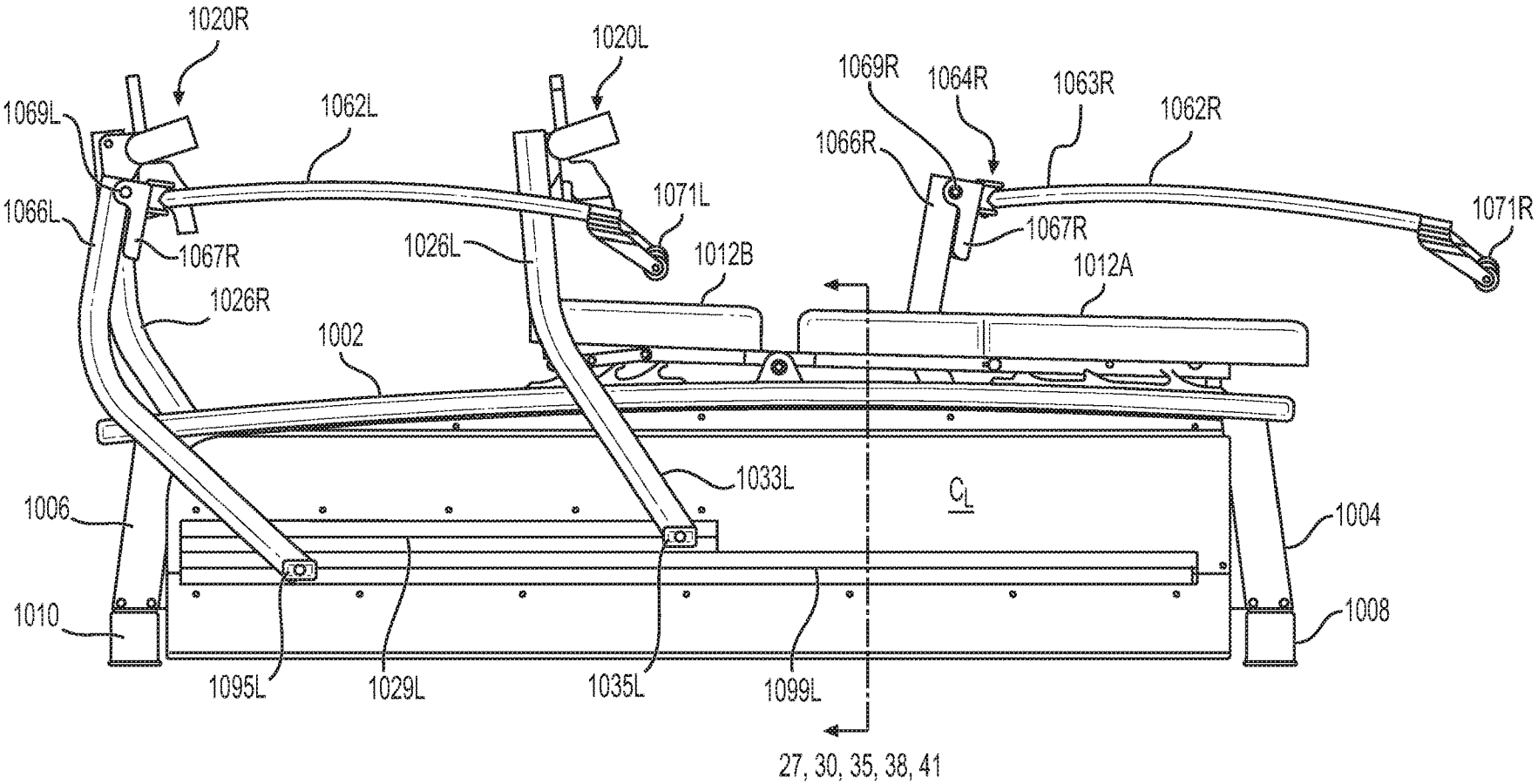
FIG. 26A is a left side elevational view thereof with a protective cover $C_L$ in place.
Figure 26B:
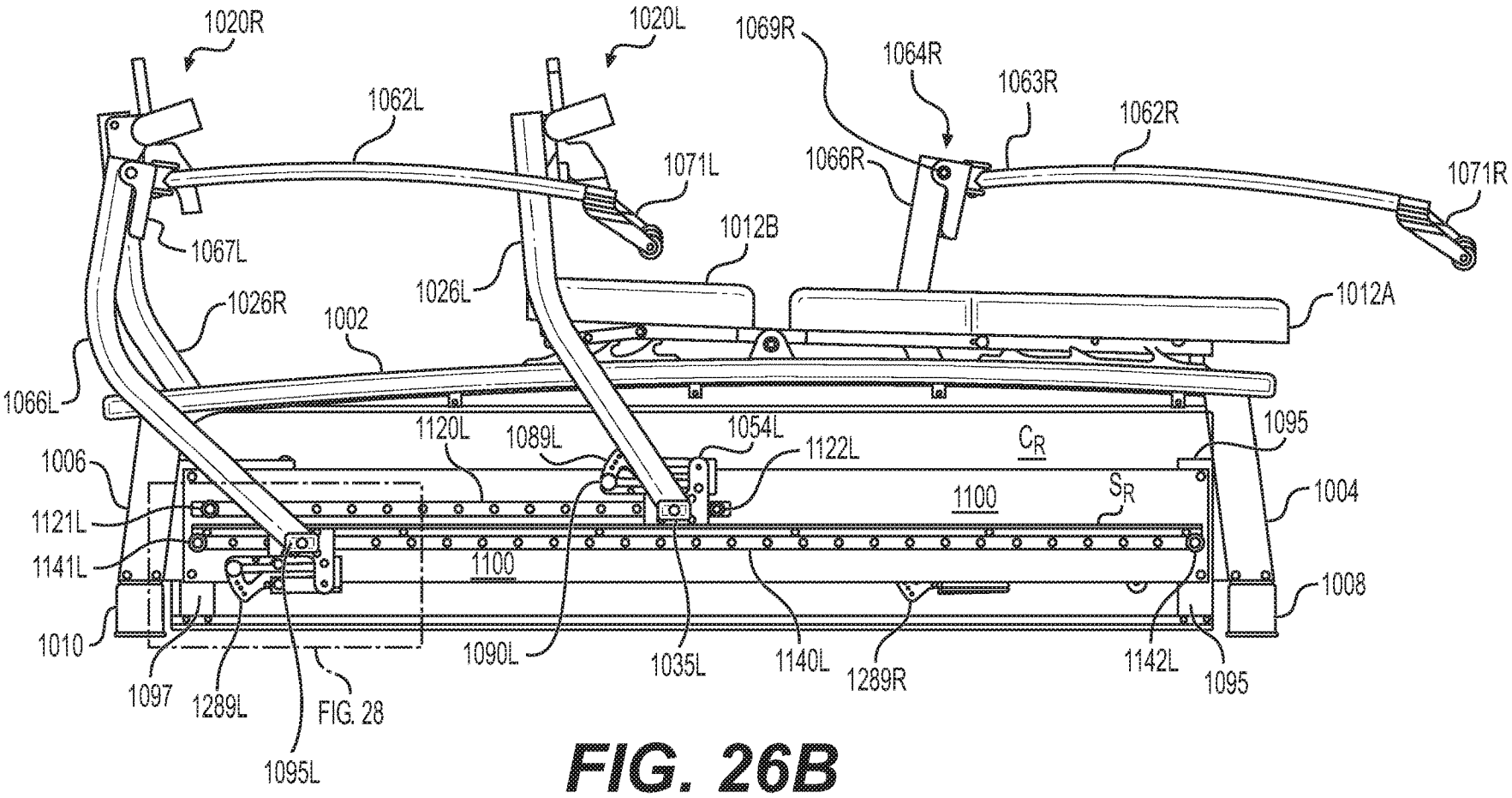
FIG. 26B is a left side elevational view thereof without the protective cover $C_L$.
Figure 26C:
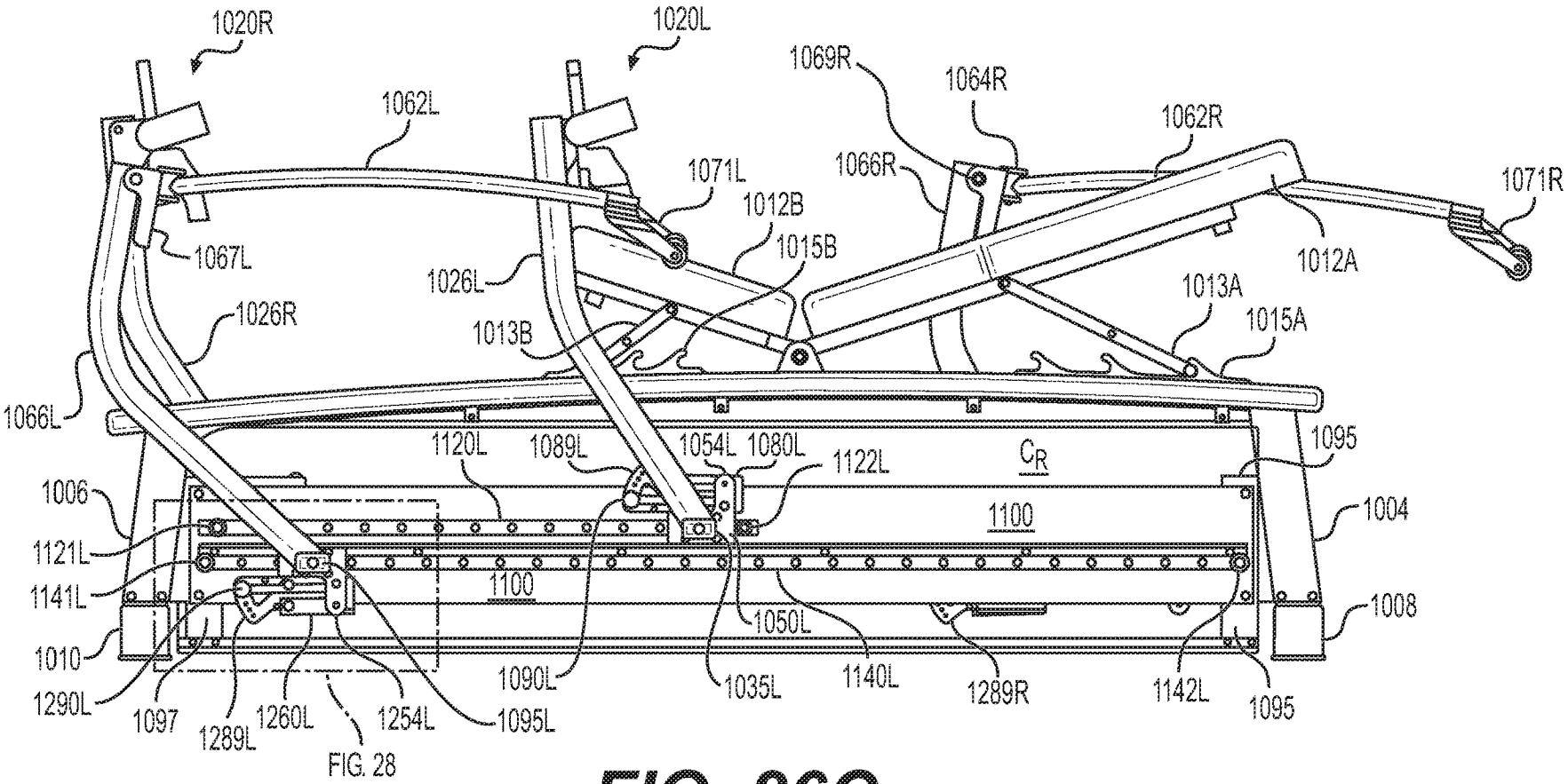
FIG. 26C is a left side elevational view thereof without the protective cover $C_L$ showing the support bench in one of many possible alternate positions.
Figure 26D:
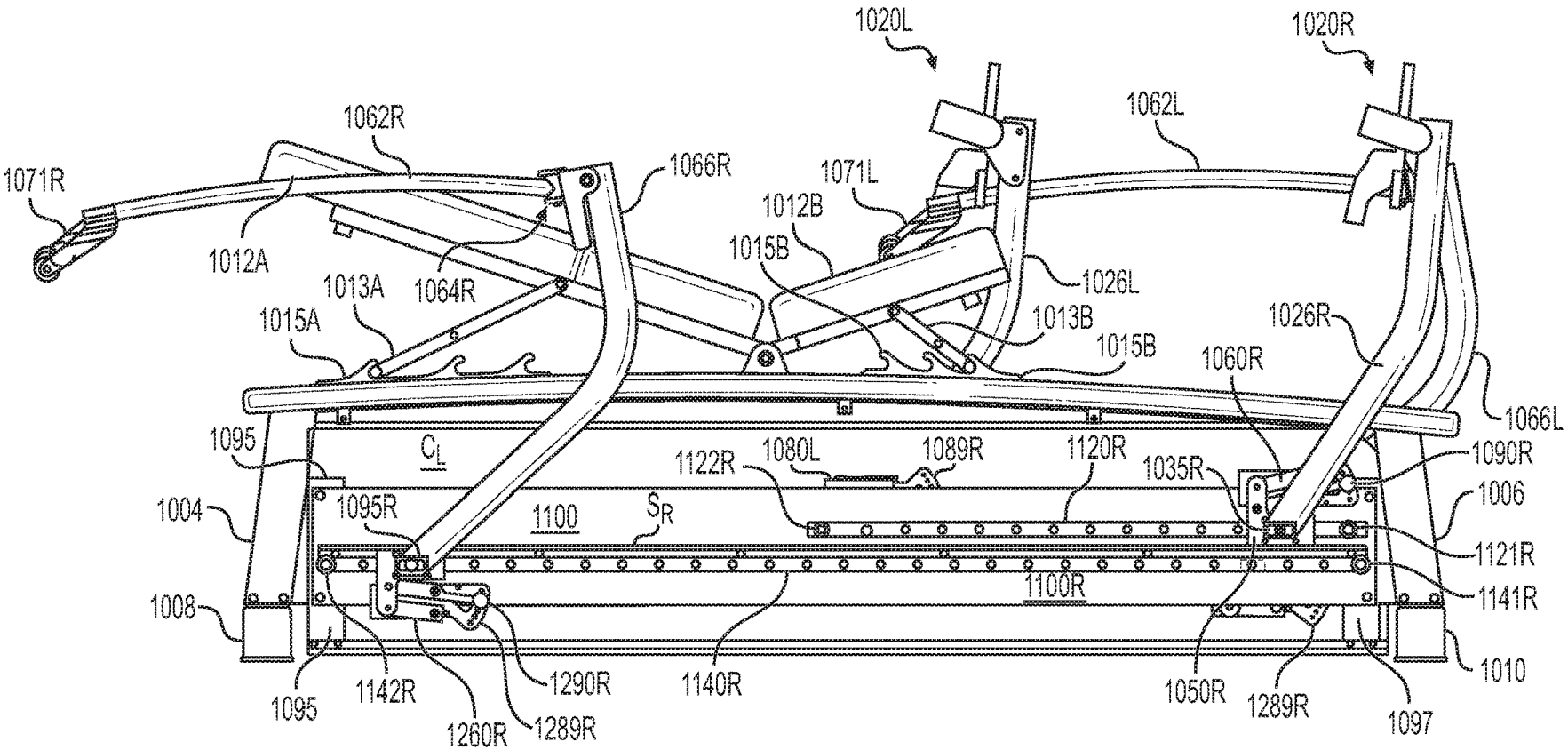
FIG. 26D is a right side elevational view thereof without the protective cover $C_R$.

It should be noted that any embodiment of the exercise device disclosed herein may or may not employ some sort of ornamental cover, such as cover C. An example of such a cover is shown in FIGS. 24-26D. By viewing FIGS. 24 and 25, it can be seen that cover C may comprise left and right cover sections $C_R$ and $C_L$, respectively, which are shown in place covering both the right and left sides of the device 1000. In FIGS. 23A and 26B-C, a left side $C_L$ of cover C is removed for purposes of exposing the novel resistance assemblies associated with the left side of the device, which are a mirror image of the resistance assemblies on the right side of the device. Cover section $C_R$ is removed in the view shown in FIG. 26D for purposes of exposing the novel resistance assemblies associated with the right side of the device.

In embodiments, magnetic resistance braking elements or mechanisms may be employed in association with each leg and arm exercise assembly 1020R, 1020L, 1070R and 1070L. In that manner, true simultaneous adjustable independent movement and exercise resistance can be provided to each appendage of a user.

In embodiments, any one or more of such resistance mechanisms may be adjusted and/or adjustable in resistance force to accommodate differences in strength among users and among the different appendages of any given user. For example, a handicapped or injured person may have diminished strength in one or more appendage, but not in the other appendages. Accommodation of specific needs of the individual is contemplated to be within the scope of this invention. Conversely, the resistance applied to a user's arm appendages may be set to the same level for both arms, and the resistance applied to a user's leg appendages may be set to the same level for both legs.

Adjustment of the resistance against movement of any one or more of leg and arm exercise assemblies 1020R, 1020L, 1070R and 1070L, respectively, may also be desired to vary the level of exertion required by the user, and thereby adjust the exercise experience and results.

In embodiments, magnetic resistance, or Eddy current, braking mechanisms are contemplated for each individual appendage of the user. An exemplary embodiment thereof is shown in detail in FIGS. 30A-33. Such magnetic resistance braking mechanisms may be of the fixed magnet or electromagnet type. Utilization of fixed magnets is preferred in that no independent power source is required to be supplied thereto. However, variable electromagnetic braking mechanisms are envisioned as being within the scope of the invention as well. It is to be understood that the structure and function of the mechanism shown in FIGS. 30A-33, which services the left leg of a user, is contemplated to be identical to the mechanisms which service the right leg and each of the right and left arms of a user, although the braking mechanisms which serve the arms are inverted in embodiments relative to the braking mechanisms which serve the legs so as to have the left leg and left arm braking mechanisms share the left conductive beam 1100L, and have the right leg and right arm braking mechanisms share the right conductive beam 1100R.

As stated, the arm braking mechanisms in the embodiment shown are positioned below the leg braking mechanisms and inverted (i.e., rotated 180°) relative to the orientation of the leg braking mechanisms elements. In embodiments, as seen, for example, in FIGS. 27 and 29, the arm braking mechanism on the right shares the same conductive beam or member 1100R as the leg braking mechanism on the right. Likewise, the arm braking mechanism on the left shares the same conductive beam or member 1100L as the leg braking mechanism on the left, as will be explained in greater detail below. Such an arrangement allows for a substantially compact, efficient construction which uses a relatively small number of parts and minimal amount of materials.

In embodiments, the magnet carriers 1080 and 1280 are positioned in registry with, and essentially straddle, adjacent portions of beams 1100L and 1100R, as can readily be seen in FIGS. 29 and 34C, 35C and 36C. The magnet carriers are movable between a fully raised (in the case of leg magnet carriers 1080L and 1080R) or a fully lowered (in the case of arm magnet carriers 1280L and 1280R) position (the left leg magnet carrier 1080L being shown in FIGS. 34C, 35C and 36C) so as to adjust the amount of overlap, and, hence, Lenz force interaction, between the leg and arm magnet elements 1082 and 1282, respectively, as the user's movements cause the linear bearing and magnetic braking assemblies to be translated parallel to the conductive beams.

In one embodiment, right and left conductive beams 1100R and 1100L are connected to the device 1000, such as by connection to support legs 1004 and 1006 via brackets 1095 and 1097. In the embodiment shown, beams 1100R and 1100L are mounted in a vertical, parallel fashion. However, such conductive beams may be oriented in any desired configuration. In embodiments, they may be oriented horizontally in parallel, or in any other orientation, whether in parallel with each other or not. Moreover, separate conductive beams may be used for each of the four leg and foot linear bearing and braking mechanisms in lieu of having the left leg and arm braking mechanisms share a left conductive beam and the right leg and arm braking mechanisms share a right conductive beam.

Aspects of embodiments of linear bearing and braking mechanisms on the left and right sides of the device will be described in detail, it being understood that the linear bearing and braking mechanisms on one side of the device are, preferably but not by way of limitation, mirror images of the linear bearing and braking mechanisms on the other side of the device. In embodiments, such as shown in the drawings, the leg exercise braking mechanisms are oriented in one position (i.e., right-side-up) while the arm exercise braking mechanisms are oriented up-side-down (i.e., inverted) relative thereto.

In embodiments, and referring now to the left side of the device as seen in FIGS. 23A, 24, 25 and 26B-C, the two (one for the left leg and left foot, the other for the left arm and left hand) resistance mechanisms on the left side of the device are comprised of a novel combined linear bearing and magnetic resistance braking structure. As to the left leg exercise assembly 1020L, distal or lower end 1033L of left leg exercise pylon 1026L is connected to a support brace 1035L, which in turn is rigidly fastened to a linear bearing bracket 1050L.

A linear bearing slider carriage or member 1052L is connected to the linear bearing bracket 1050L. A distal end of raised flange 1054L associated with linear bearing bracket 1050L supports a first pivotable link 1060L at a first, proximal, end of said pivotable link 1060L using hinge member or pin 1062L. A second, distal, end of said pivotable link 1060L is pivotably connected to magnet carrier 1080L using hinge member 1061L. A raised adjustment arm or flange 1089L provides an extended surface area on magnet carrier 1080L to locate a plurality of adjustment apertures 1083L therein.

A proximal end of the second pivotable link 1055L is pivotably connected to a proximal end of raised flange 1054L via hinge pin 1056L, while an intermediate section of second pivotable link 1055L is pivotable connected to magnet carrier 1080L via hinge pin 1059L. A distal end of second pivotable link 1055L is adapted for adjustable and removable connection to the raised flange 1089L of magnet carrier 1080L. Pivotable links 1055L and 1060L pivotably connect magnet carrier 1080L to linear bearing bracket 1050L, while simultaneously causing magnet carrier 1080L to translate parallel to linear bearing track 1120L when linear bearing slider carriage 1052L is translated along linear bearing track 1120L by movement of the user, but said links can be locked in any one of a plurality of adjustment positions, and consequently lock the magnet carrier in position relative to conductive beam 1100L, as will be described in more detail below Virtually any type of bearing may be employed in the novel electromagnetic resistance exercise devices contemplated by the current invention. In the preferred form of the invention, but not by way of limitation, linear bearings are used in connection with the magnetic resistance, i.e. braking, arrangements. Virtually any type of linear bearing may be employed in the novel linear bearing/magnetic braking arrangements used in embodiments of the invention, such as self-lubricating materials, roller bearings, and the like, as will occur to those of skill in the art.

Linear bearings such as those manufactured by Satoshi Linear Industry Co., Ltd of Japan, and Pacific Bearing Company of Rockford, Ill., are examples of suitable bearings for use with the instant invention. The representation of linear bearing blocks 1052R, 1052L, 1252R and 1252L, along with representative bearing slide tracks 1120R, 1120L, 1140R and 1140L, shown in the drawings are a generic rendering of linear bearings, it being understood that a person of skill in the relevant art will be familiar with and capable of constructing an exercise device using suitable linear bearings in accordance with the teachings of the invention.

Figure 30A:
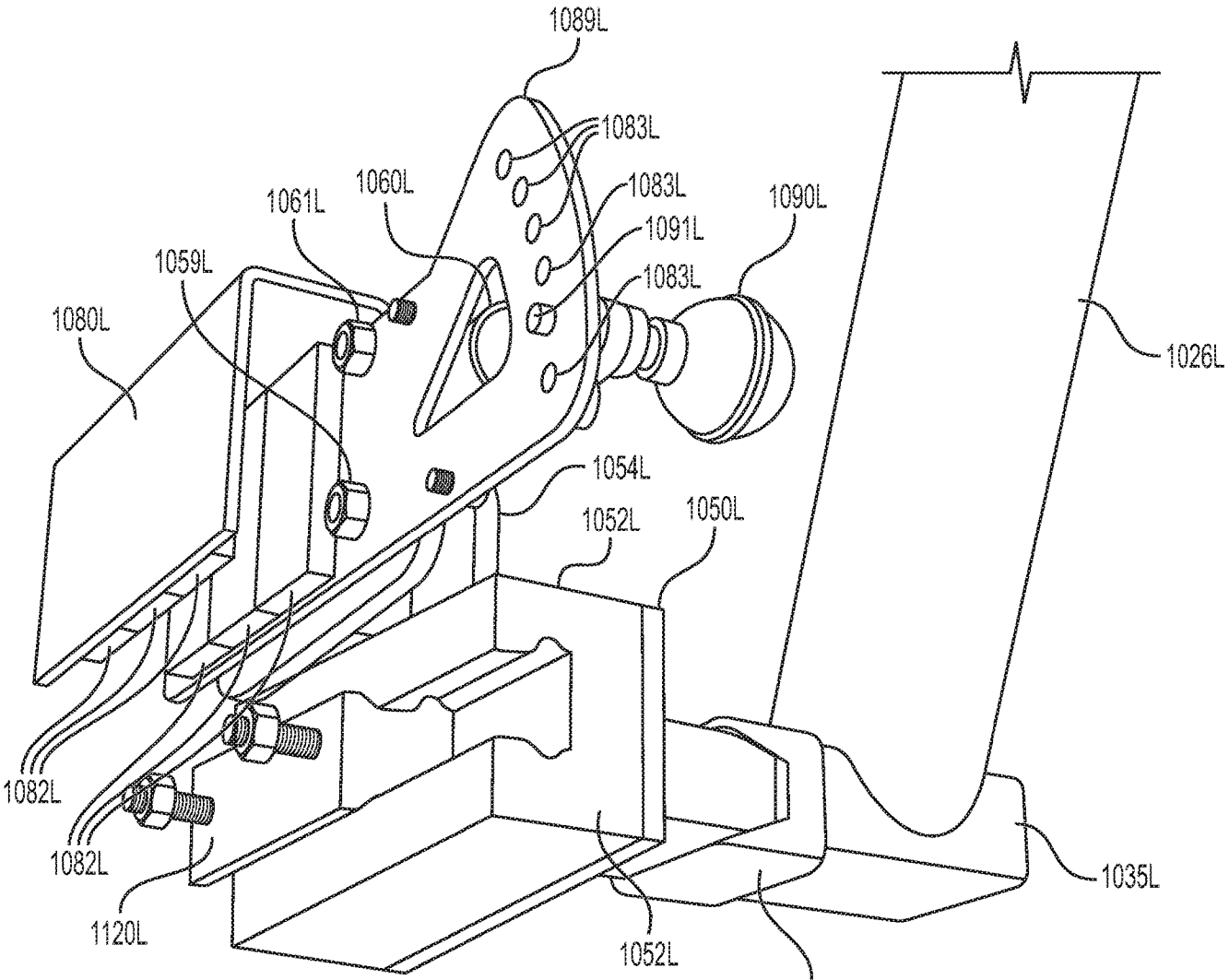
FIG. 30A is a bottom front perspective view of one of the braking and linear bearing assemblies used in embodiments of the invention locked in one of multiple adjustment positions.
Figure 30B:
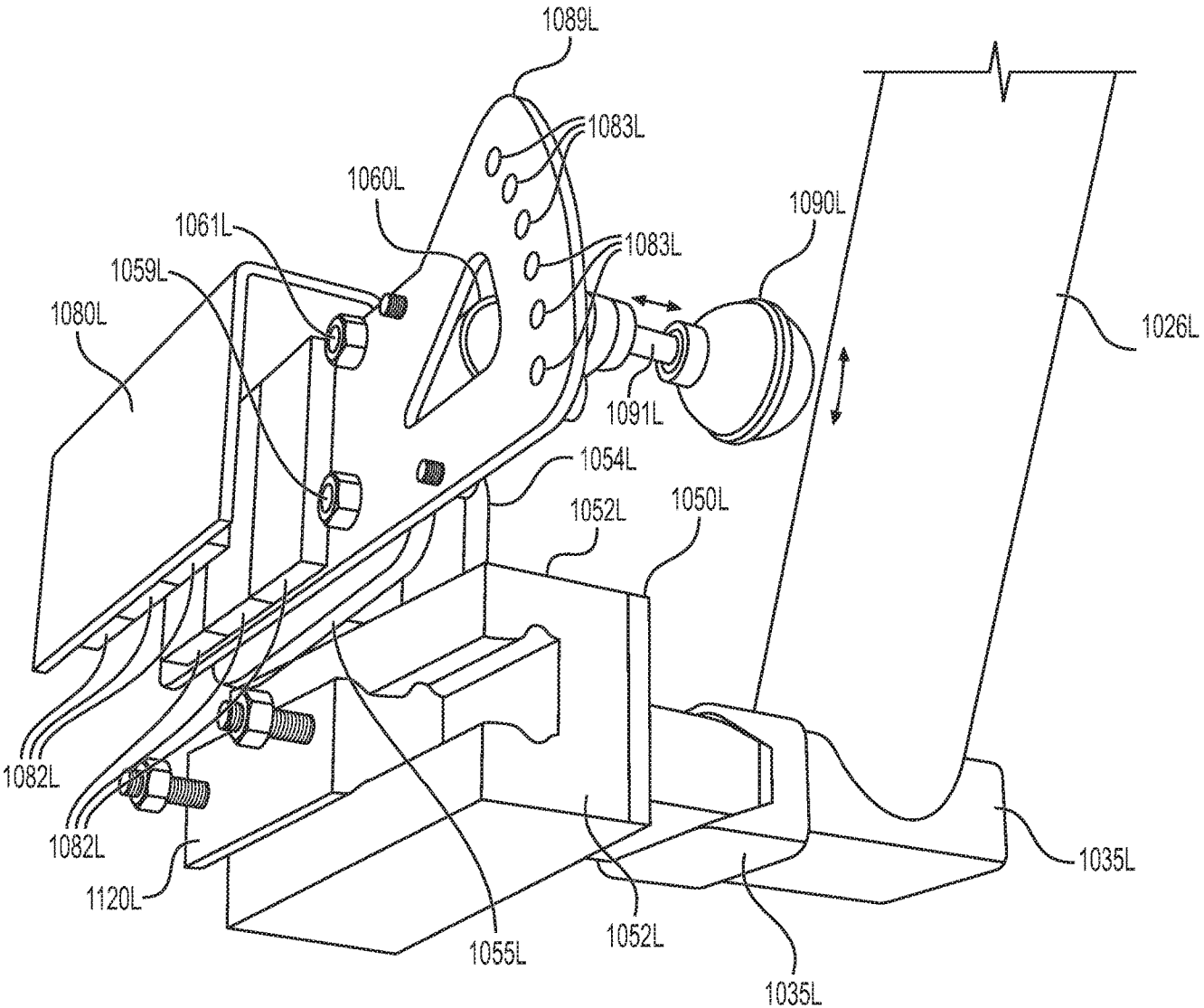
FIG. 30B is a bottom perspective view of the braking and linear bearing assembly shown in FIG. 30A but with an adjustment pin disengaged such that it is not locked in position.
Figure 31:
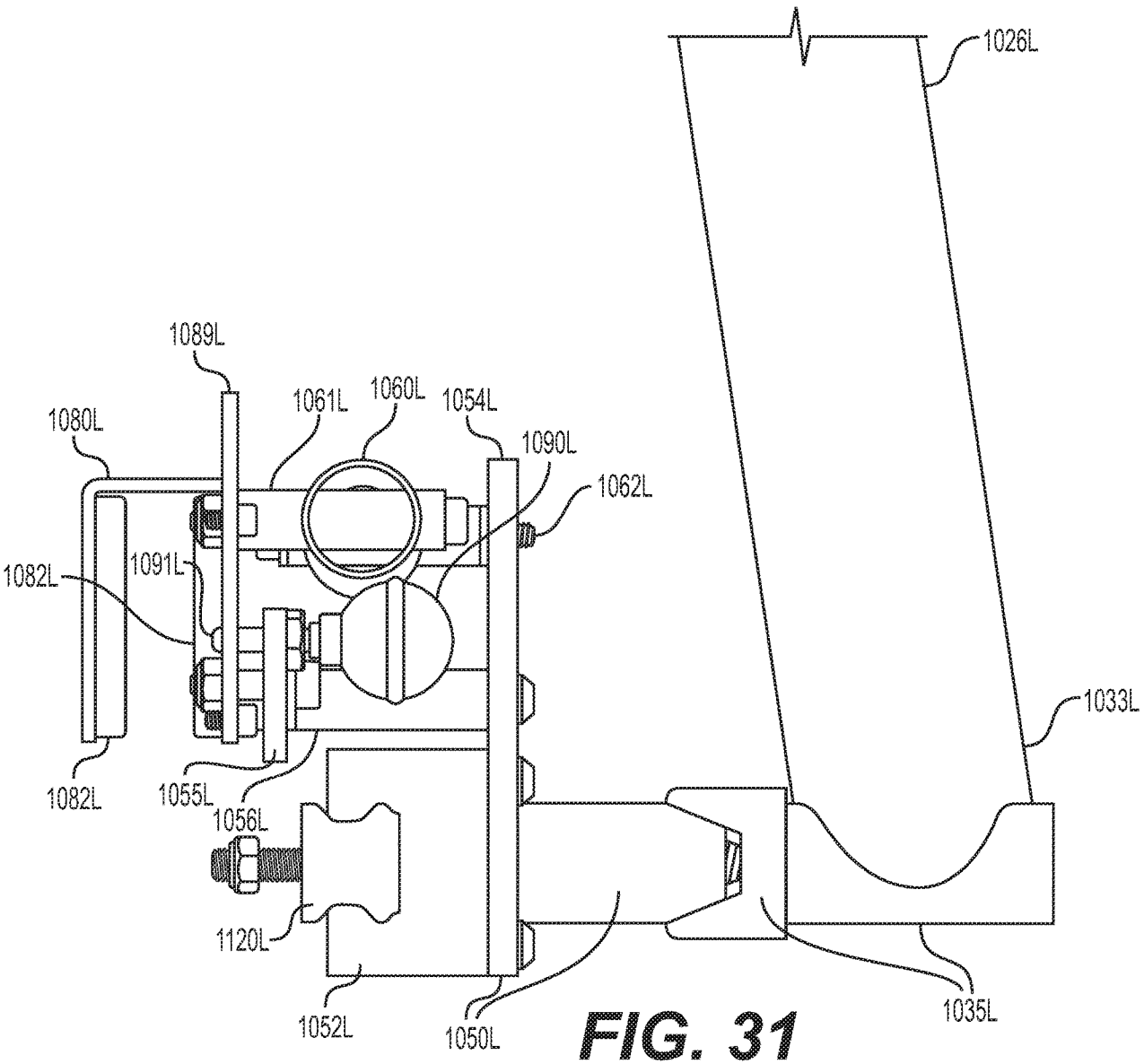
FIG. 31 is a front elevational view thereof.
Figure 32:
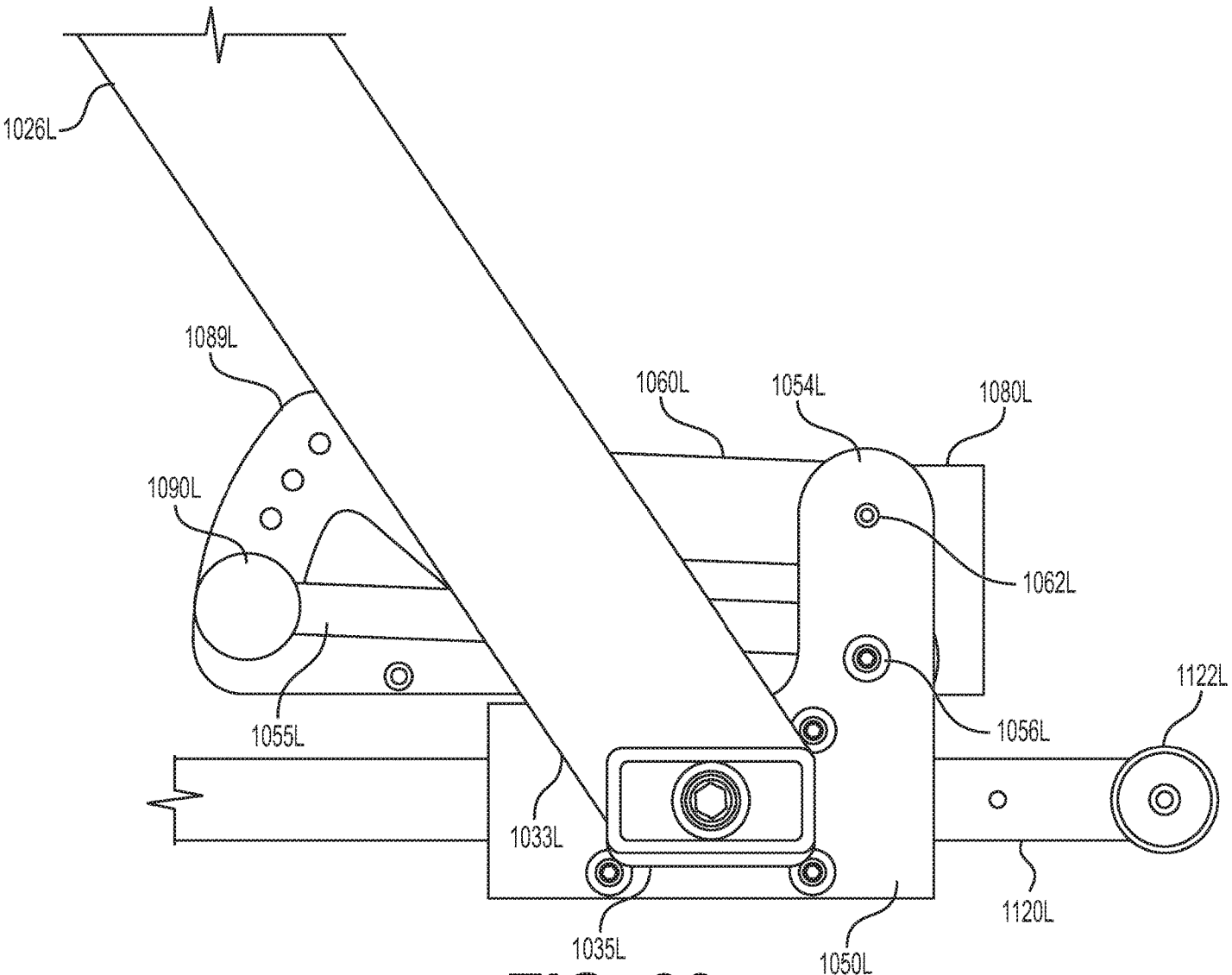
FIG. 32 is a left side elevational view thereof.
Figure 33:
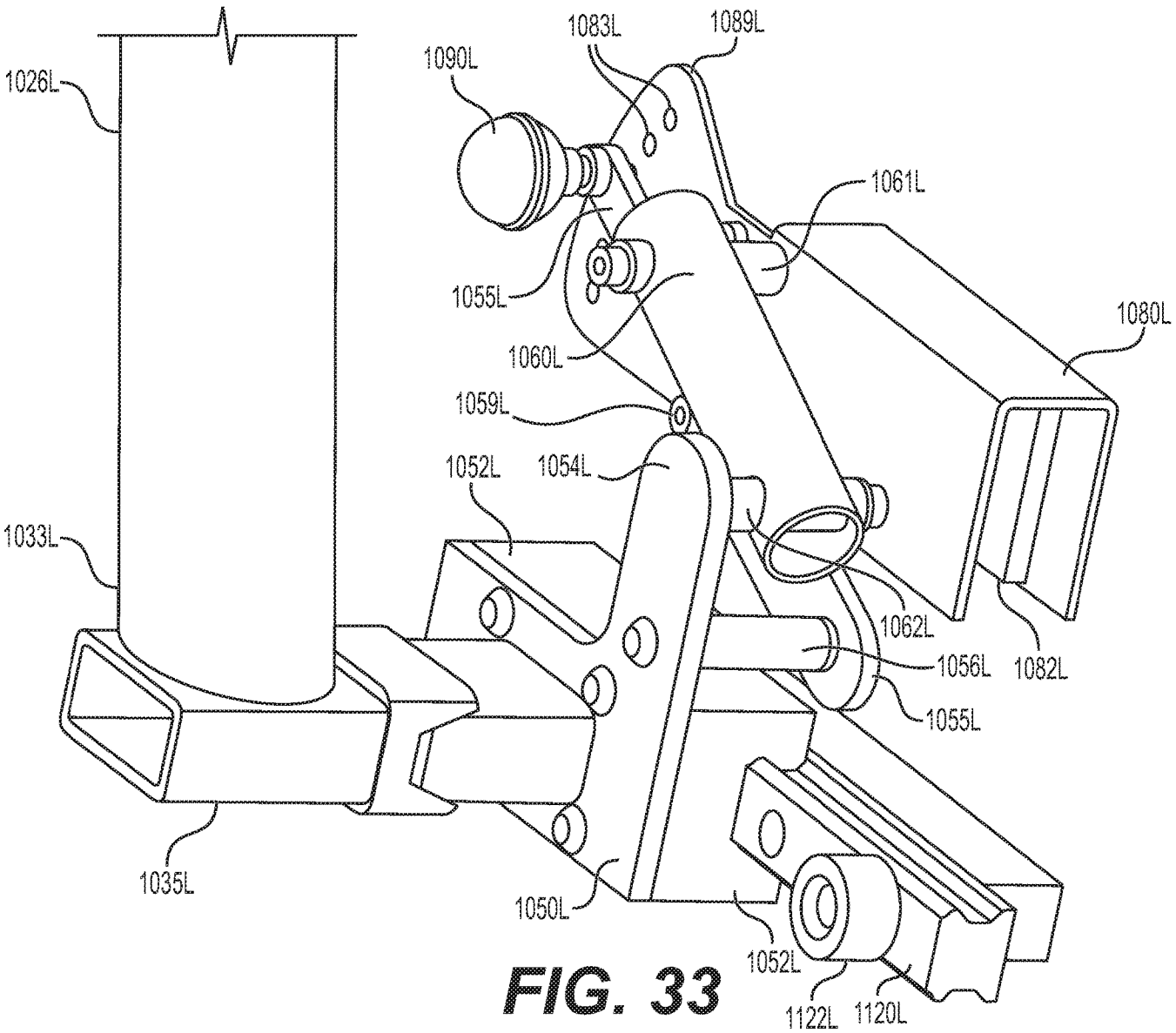
FIG. 33 is a rear left side perspective view thereof.

In accordance with the above-referenced examples of linear bearings, in embodiments, such as that shown in FIGS. 30A, 30B and 33, left leg exercise assembly 1020L employs a linear bearing slide member 1052L which slidably receives linear bearing track 1120L in nested relationship, such that slide member 1052L can translate in sliding engagement on bearing guide 1120L to permit a user to move the left leg exercise assembly 1020L back and forth.

Movement limits or stops 1121L and 1122L may be used to prevent the leg braking mechanism from sliding too far while still allowing for full range of motion of the leg of the user.

Figure 27:
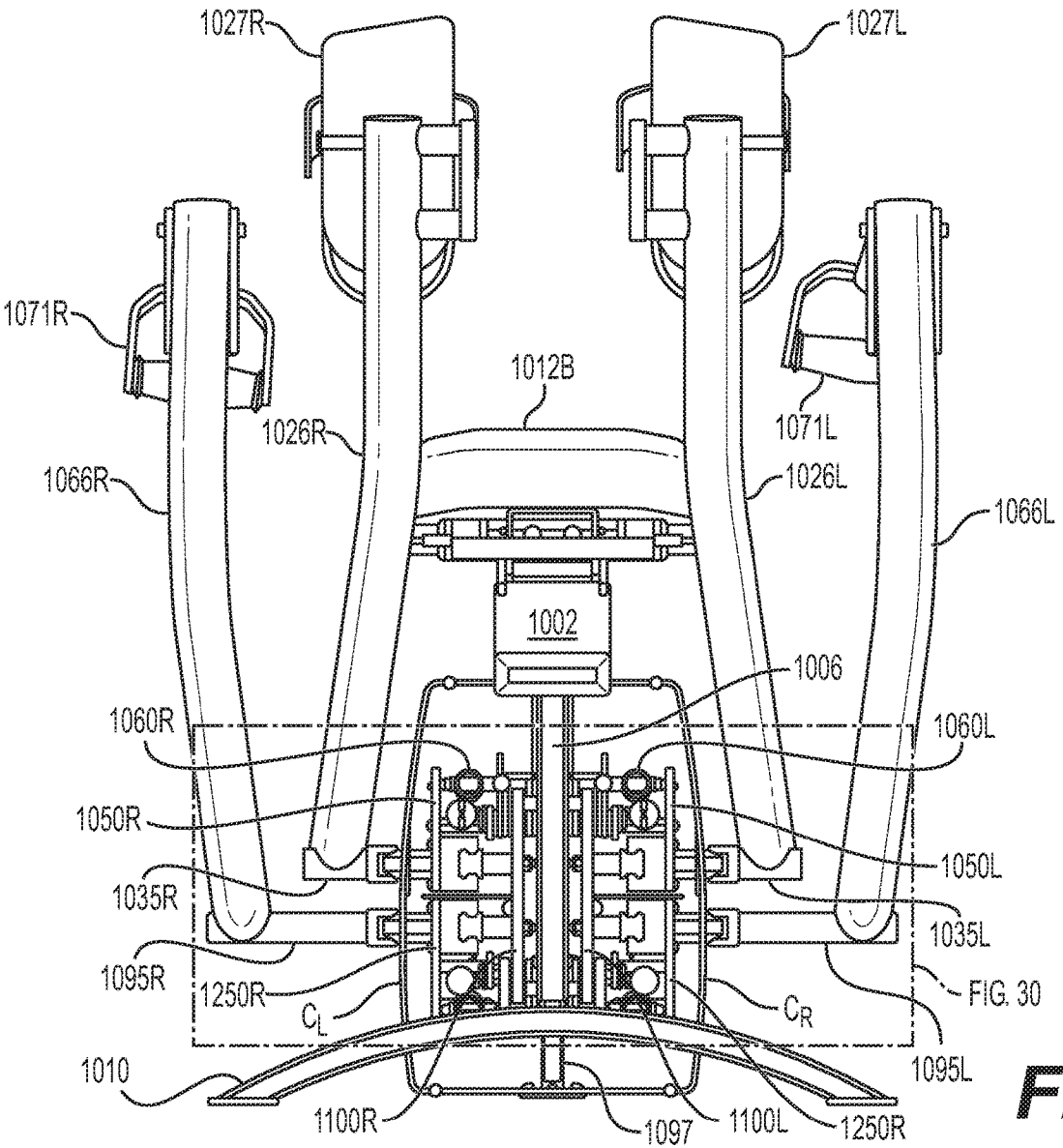
FIG. 27 is front elevational view thereof.
Figure 28:
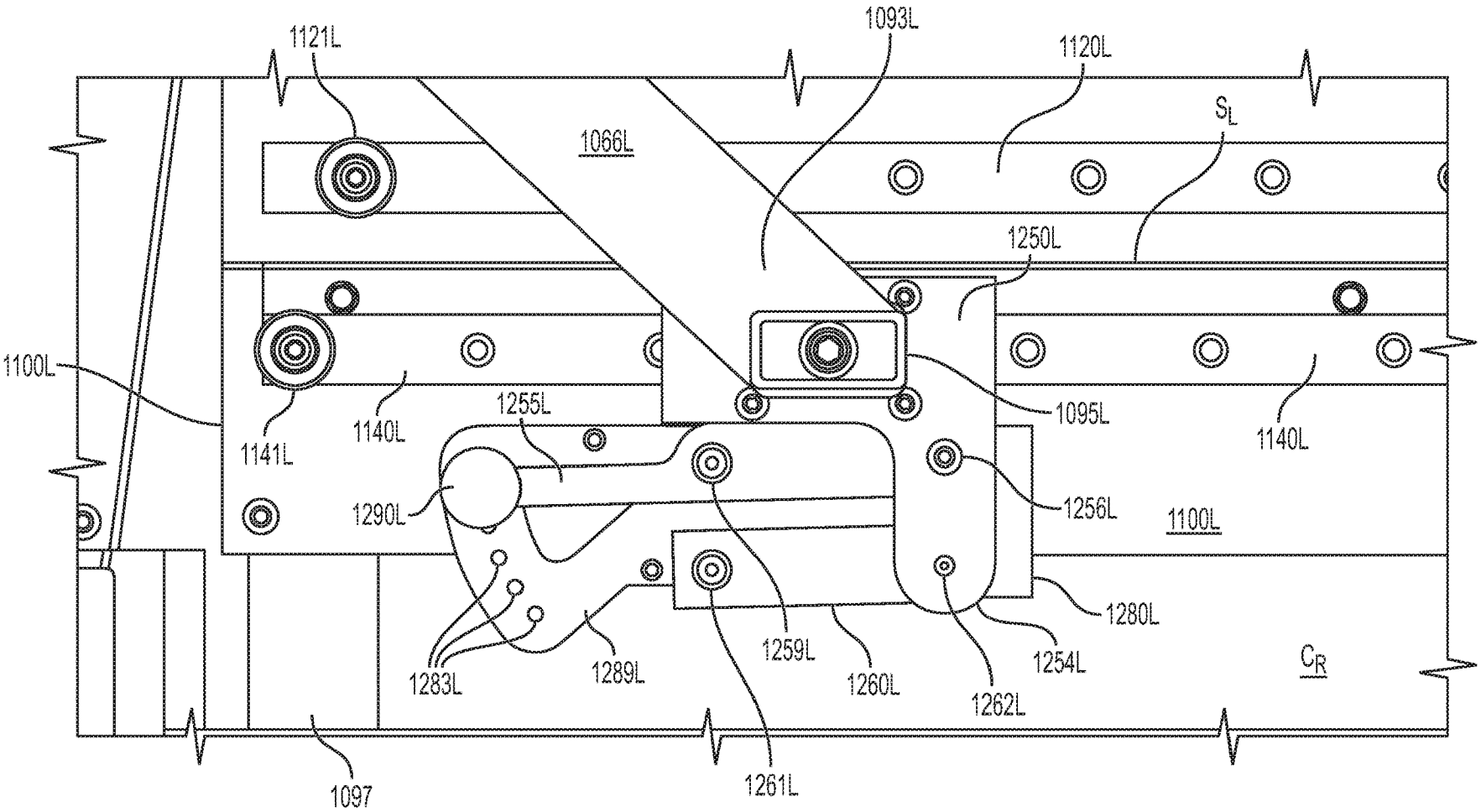
FIG. 28 is an enlargement of the area of detail shown in FIG. 26C.
Figure 29:
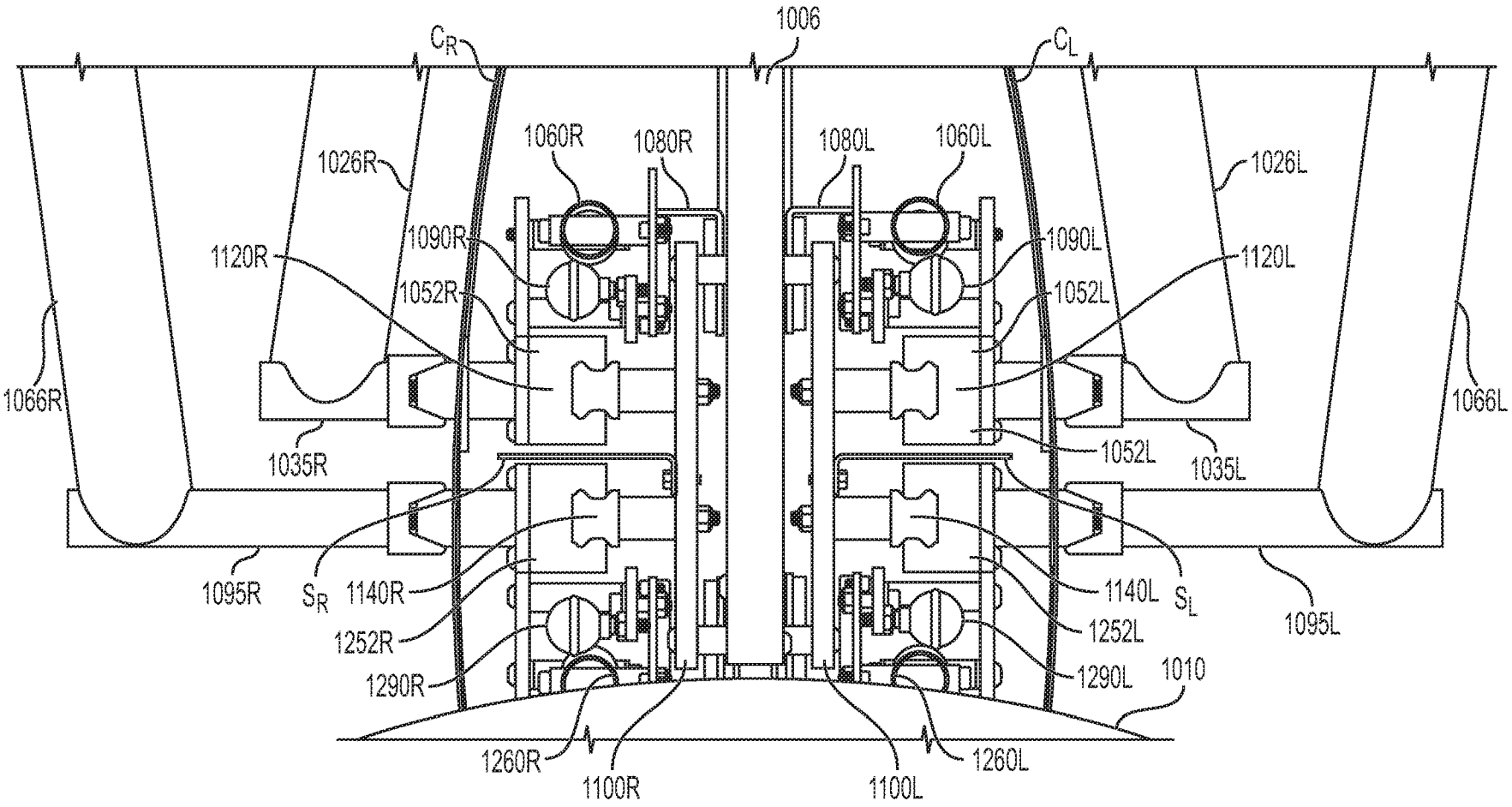
FIG. 29 is a close up view of a portion of the front elevational view of FIG. 27

Correspondingly, as seen in FIGS. 27, 28 and 29, left arm exercise assembly 1070L employs a left arm exercise pylon 1066L the lower or distal end thereof 1093L being connected to a support brace 1095L, which in turn is rigidly fastened to a linear bearing bracket 1250L. A linear bearing slider member 1252L is connected to the linear bearing bracket 1250L. A raised flange 1254L associated with linear bearing bracket 1250L supports a pivotable link 1260L at a first end of said flange 1254L using hinge member or pin 1262L. A second end of said pivotable link 1260L is pivotably connected to a magnet carrier 1280L using hinge member 1261L. A raised flange 1289L provides an extended surface area on magnet carrier 1280L to locate a plurality of adjustment holes 1083L therein.

In embodiments, left arm resistance assembly 1070L employs a linear bearing slide member 1252L which slidably receives linear bearing track 1140L in nested relationship, such that slide member 1252L can translate in sliding engagement on bearing guide 1140L to permit a user to move the left arm assembly 1070L back and forth.

Forward and aft movement limits or stops 1141L and 1142L, and 1141R and 1142R, may be used to prevent the left and right arm braking mechanisms, respectively, from sliding too far while still allowing for full range of motion of the arms of the user. Corresponding forward and aft movement limits or stops 1121R and 1121L, and 1121R and 1122R, may be used to prevent the right and left leg braking mechanisms, respectively, from sliding too far while still allowing for full range of motion of the legs of the user Looking now at FIGS. 30A and 30B, the adjustment structure of each of the four braking mechanisms of embodiments of the invention can be appreciated. Each mechanism employs a right and left magnet carrier 1080R and 1080L for the leg exercise assemblies 1020R and 1020L, and right and left magnet carriers 1280R (not shown but which is a mirror image of the left-side arm braking mechanism) and 1280L for the arm exercising assemblies 1070R and 1070L. Each of the four magnet carriers supports one or more magnet elements 1082 for the legs and 1282 for the arms. As stated previously, the magnets may be of the permanent or electromagnetic type, and may be the same or different strengths for each leg and foot assembly depending on the design criteria.

A process for adjusting the position of magnet elements 1082R relative to the conductive beam 1100R, and thereby adjusting the level of resistance encountered by a user, will now be described. In embodiments, as seen by a comparison of FIGS. 34C, 35C and 36C, the position of the magnet elements 1082R and the corresponding magnet carrier 1080R relative to conductive bean 1100R is designed to be adjustable, so as to vary the resistance imparted on the linear bearing and magnetic resistance assembly during movement of the leg pylon 1026R by a user. This adjustability of the magnet carrier relative to the conductive beam may be utilized for both leg resistance assemblies and both arm resistance assemblies.

Figure 34A:
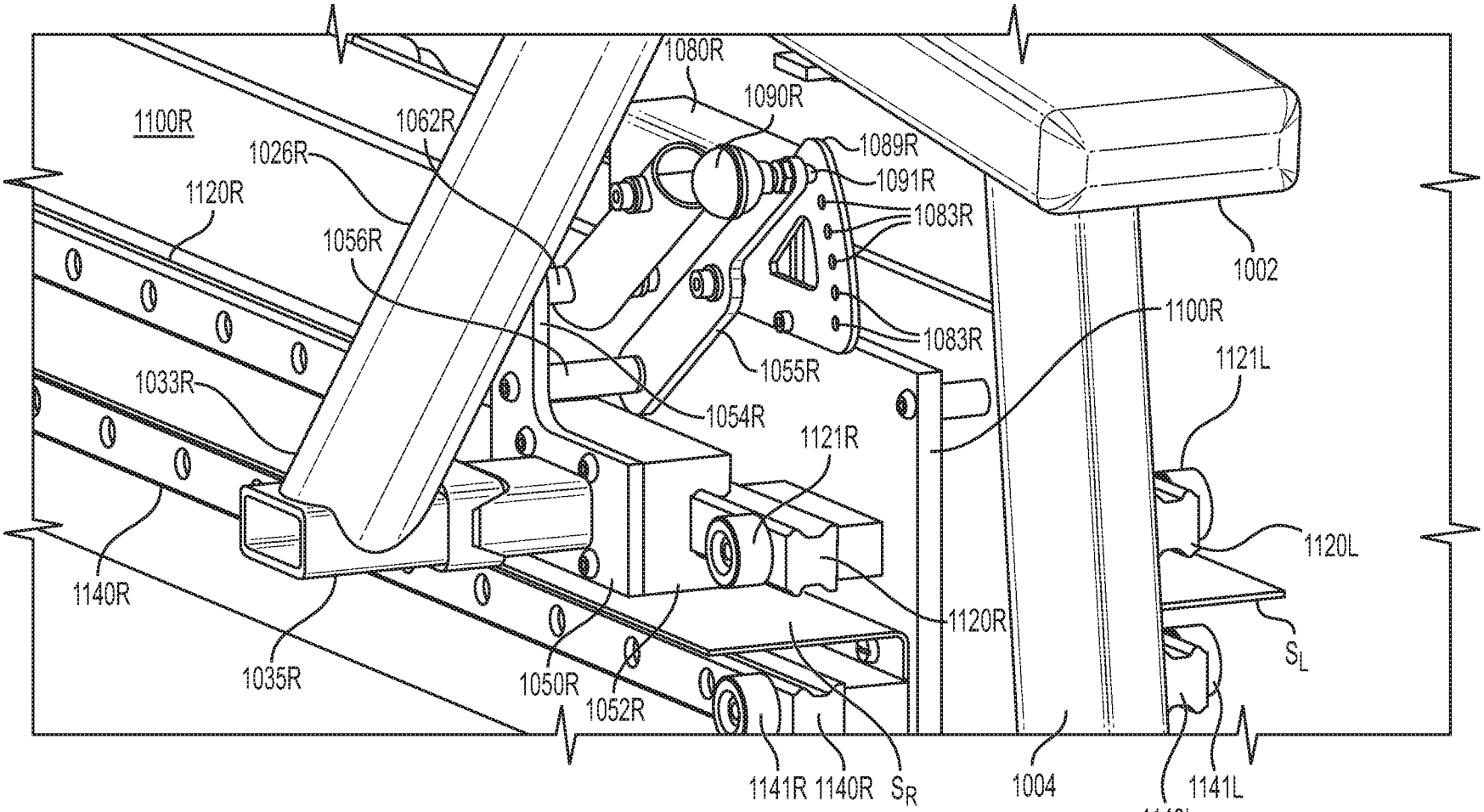
FIG. 34A is a close up of a portion of the right front perspective view of FIG. 23B showing the magnetic brake carrier in a first, raised, adjustment position.
Figure 34B:
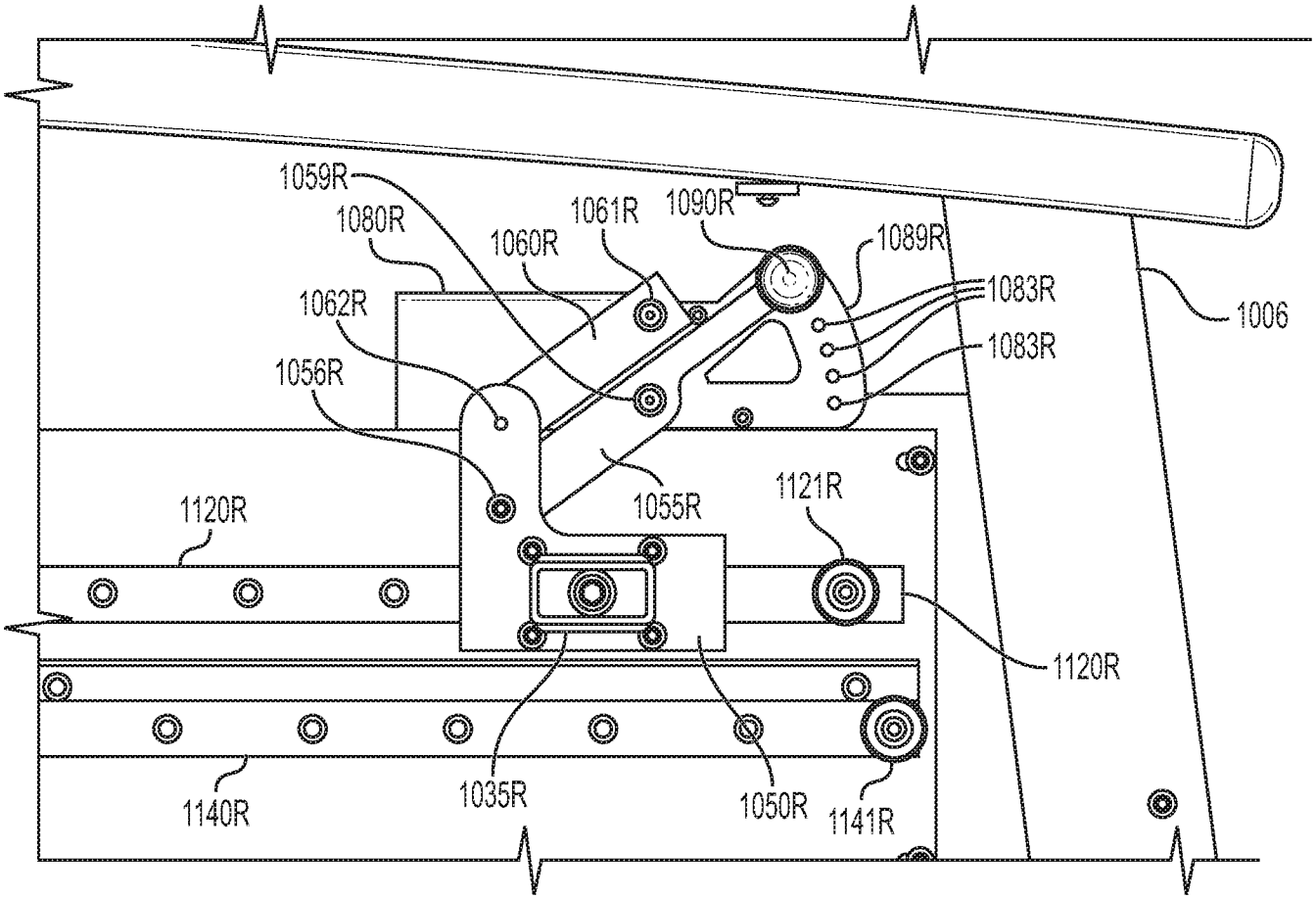
FIG. 34B is a right side elevational view thereof.
Figure 34C:
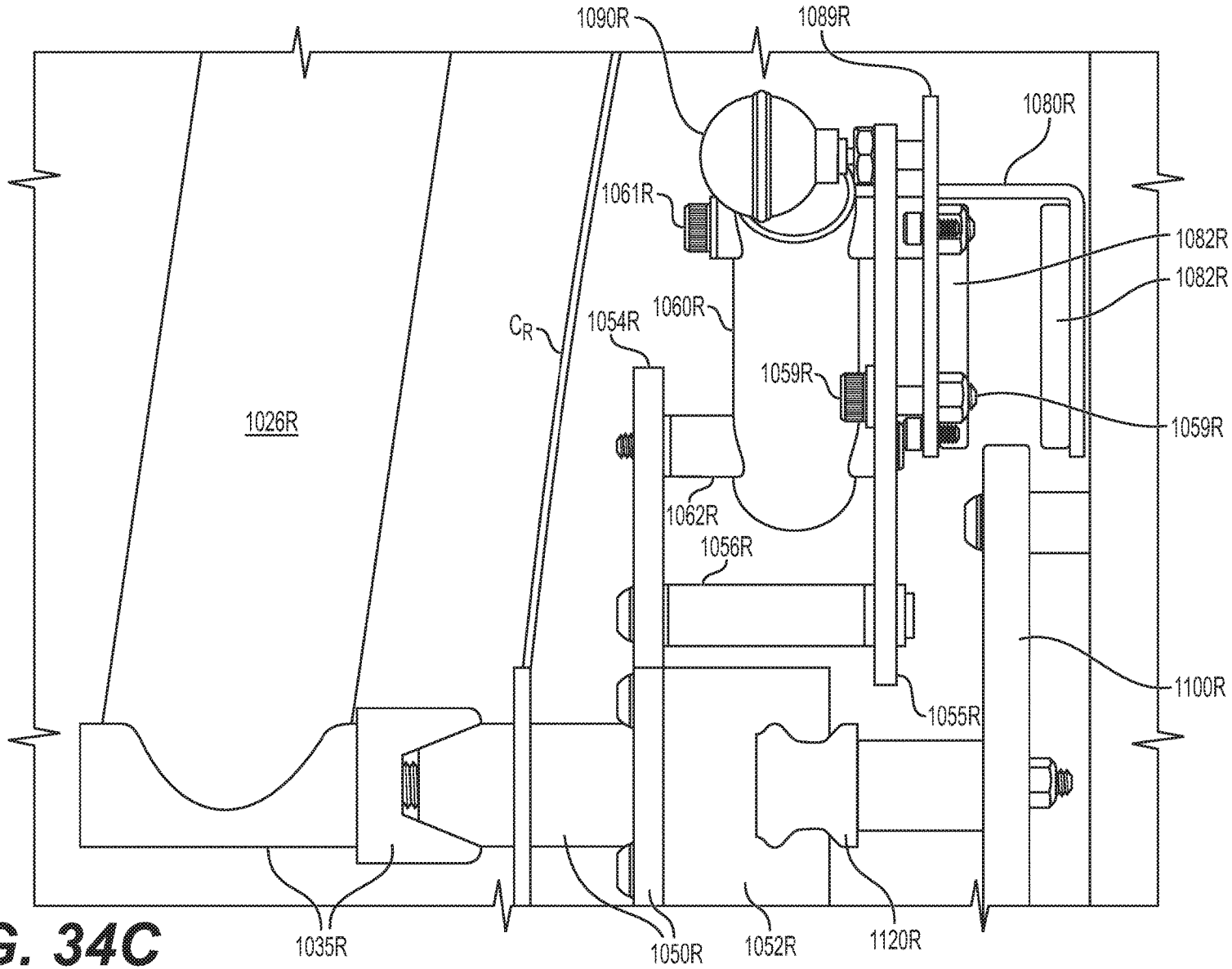
FIG. 34C is a front elevational view thereof.

The position of magnet carrier 1080R, and, hence, magnet elements 1082R shown in FIG. 34C, is in a fully raised position in which Eddy current interaction between magnet elements 1082R and beam 1100R are minimal or non-existent. The position of magnet carrier 1080R, and, hence, magnet elements 1082R shown in FIG. 35C, is in an intermediate position in which Eddy current interaction between magnet elements 1082R and beam 1100R are increased. The position of magnet carrier 1080R, and, hence, magnet elements 1082R shown in FIG. 36C is in a fully lowered position in which Eddy current interaction between magnet elements 1082R and beam 1100R is maximized, and, hence, resistance to movement of leg exercise assembly 1020R is maximized.

Referring back now to FIGS. 30A and 30B, pull knob 1090L on second pivotable link 1055L is normally biased into the locked position shown in FIG. 30A, in which pin 1091L is held in one of adjustment holes 1083L, which retains second pivotable link 1055L and, hence, the magnet carrier in position relative to the conductive plate or beam 1100L. Since the degree of resistance generated in magnet elements 1082L is proportional to, among other things, the degree of overlap between magnet elements 1082L and beam 1100L, the position in which magnet carrier 1080L is held relative to beam 1100L determines the resistance to movement of the user's left leg experienced by the user. As seen in FIG. 30B, pulling out on spring-biased pull knob 1090L removes pin 1091L from engagement within the adjustment hole 1083L, whereupon the pull knob 1090L can be used to move the magnet carrier up or down depending on the direction the user moves the pull knob. The range of motion through which the magnet carriers can be moved during the aforementioned adjustment process can be appreciated by viewing FIGS. 30A-B and 31-36C. Adjustment of the other magnet carriers 1080R, 1280R (not shown but is a mirror image of 1280L shown in FIG. 28) and 1280L of embodiments of the invention is carried out in a similar manner.

Referring now specifically to FIGS. 34A-36C, it can be seen that, in FIGS. 34A-34C, the magnet carrier 1080R is in a fully raised position, such that the magnet elements 1082R are raised above conductive beam 1100R. This relative positioning of the magnets relative to the conductive beam will result in a negligible amount of resistance being generated, if any. Adjustment pull knob 1090R, and, hence magnet carrier 1080R, is in the fully raised position, such that pin 1091R is situated in the upper most adjustment hole 1083R.

To increase the resistance generated by the breaking mechanism, magnet carrier 1080R can be lowered relative to conductive beam 1100R by pulling out on pull knob 1090R, so as to disengage pin 1091R from engagement with any of adjustment holes 1083R, and moving adjustment knob 1090R downwardly, which in turn causes corresponding rotation of second pivotable link 1055R about pin 1056L, which also causes rotational movement of first pivotable link 1060R about pins 1061R and 1062R, which causes consequent movement of magnet carrier 1080R and magnet elements 1082R to overlap beam 1100R such that pin 1091R can be brought into alignment with a different adjustment hole. Releasing adjustment knob 1090R will cause pin 1091R to lockingly enter whatever adjustment hole 1083R that it is in registry with. That will, in turn, cause magnet carrier 1080R to stay locked against vertical movement relative to conductive beam 1100R.

Figure 35A:
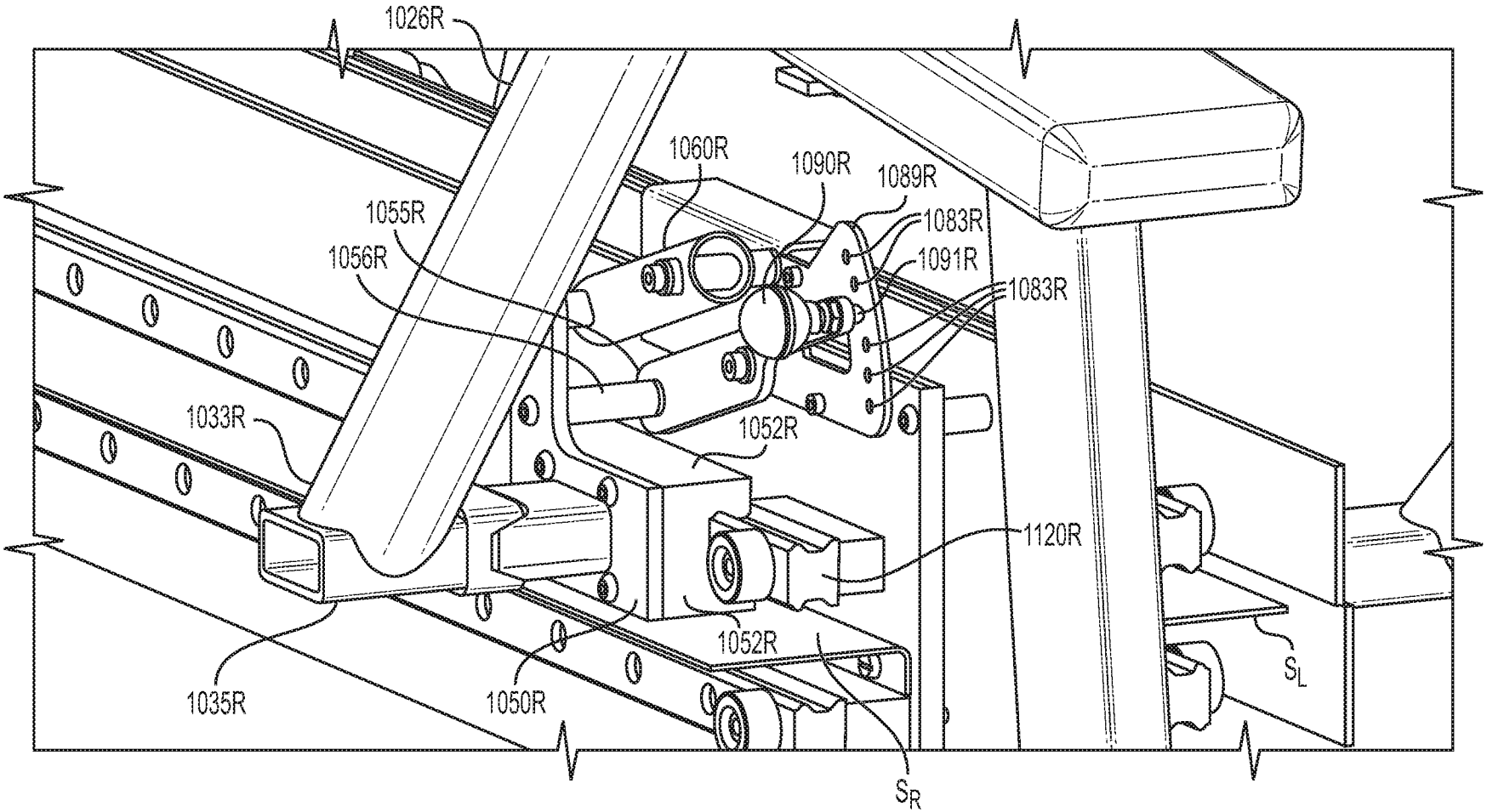
FIG. 35A is a close up of a portion of the right front perspective view of FIG. 23B showing the magnetic brake carrier in a second, intermediate, adjustment position.
Figure 35B:
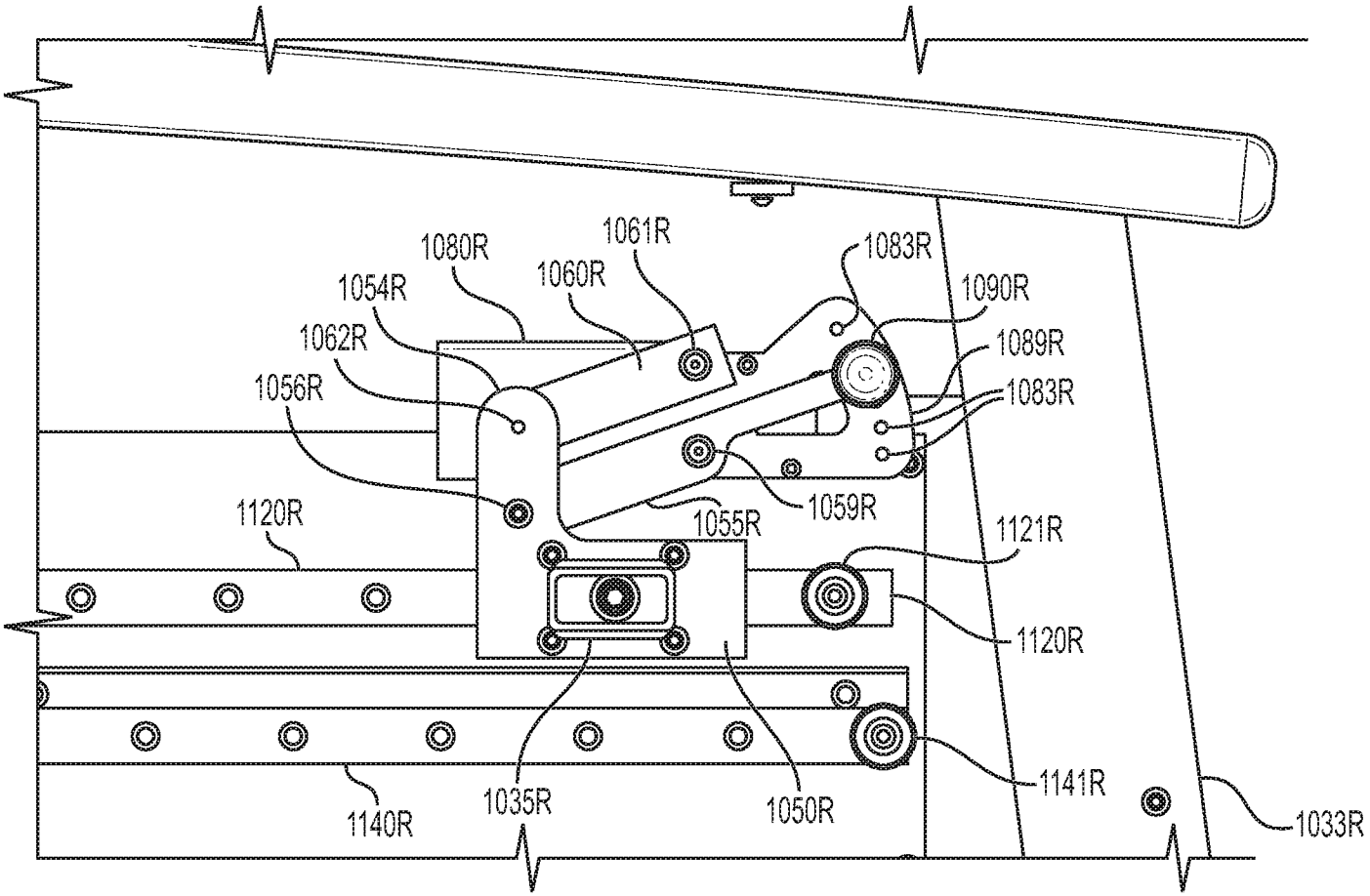
FIG. 35B is a right side elevational view thereof.
Figure 35C:
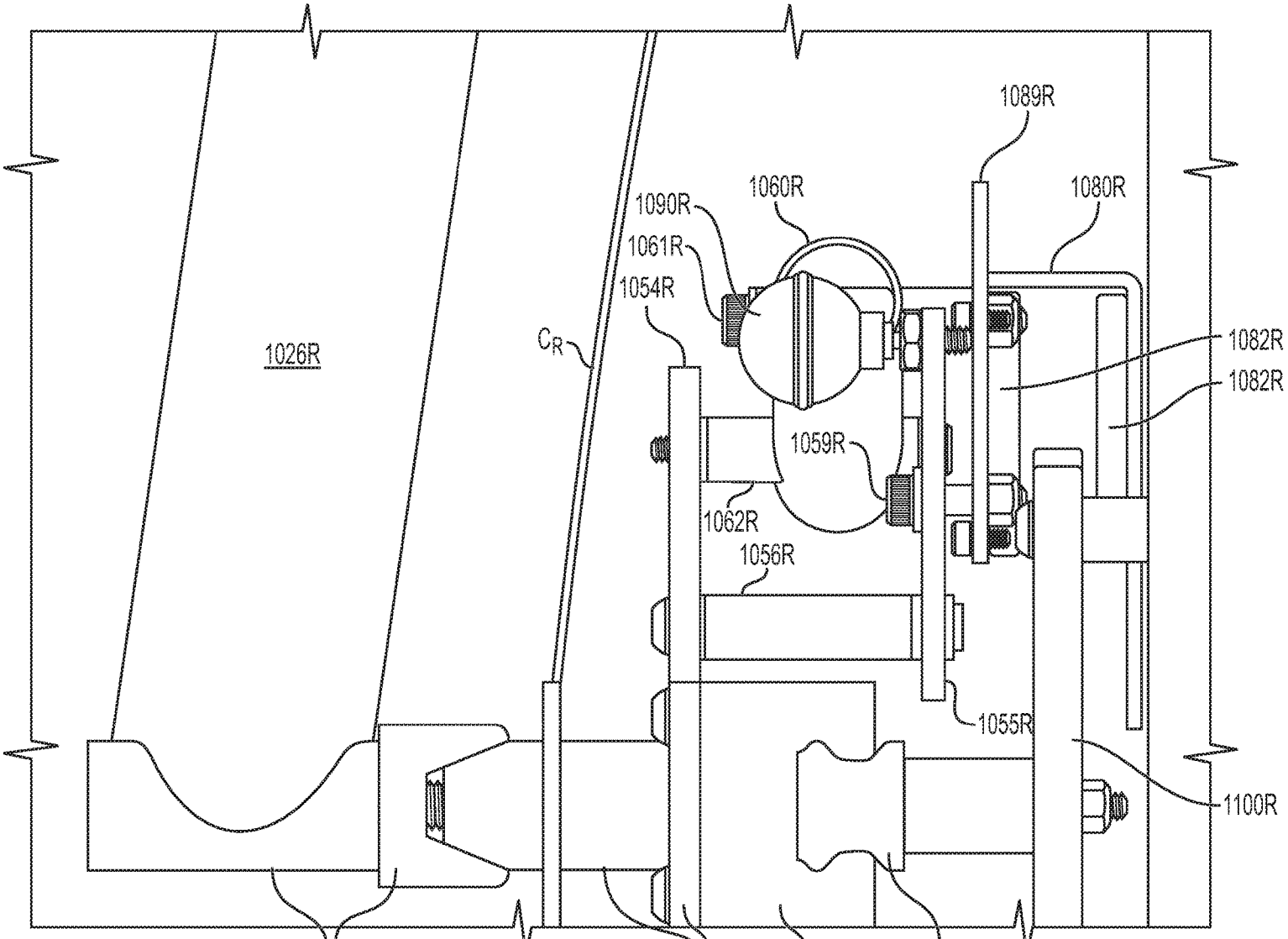
FIG. 35C is a front elevational view thereof.

In the case of FIGS. 35A-35C, pin 1091R is situated in the third hole down from the top. In doing so, magnet carrier 1080R has been lowered relative to conductive beam 1100R, causing magnet elements 1082R to overlap partially with beam 1100R. When the pull knob 1090R is pulled outwardly such that locking pin 1091R is once again disengaged from all of the adjustment holes 1083, up or down movement of pull knob 1090R causes second pivotable link 1055R to rotate about pin 1056R, which in turn causes magnet carrier to move up or down due to the connection of second link pivotable 1055R to magnet carrier via hinge pin 1059L. This movement in turn causes link 1060R to rotate about pin 1062R by virtue of the interconnection of hinge pin 1062R with raised flange 1054R of linear bearing slide bracket 1050R. Link 1060R is also pivotally connected to magnet carrier 1080R via hinge pin 1061R.

Figure 36A:
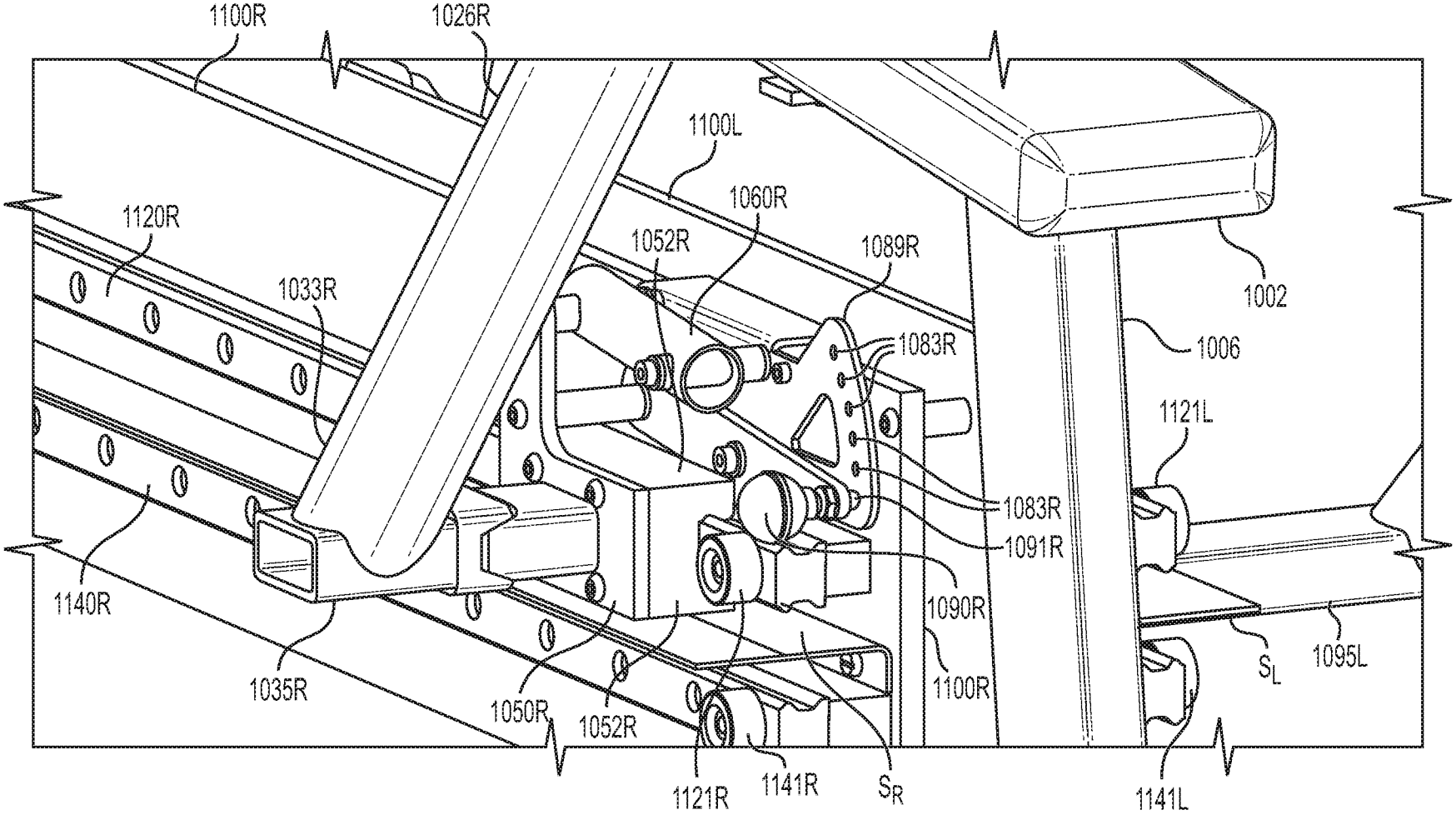
FIG. 36A is a close up of a portion of the right front perspective view of FIG. 23B showing the magnetic brake carrier in a third, lowered, adjustment position.
Figure 36B:
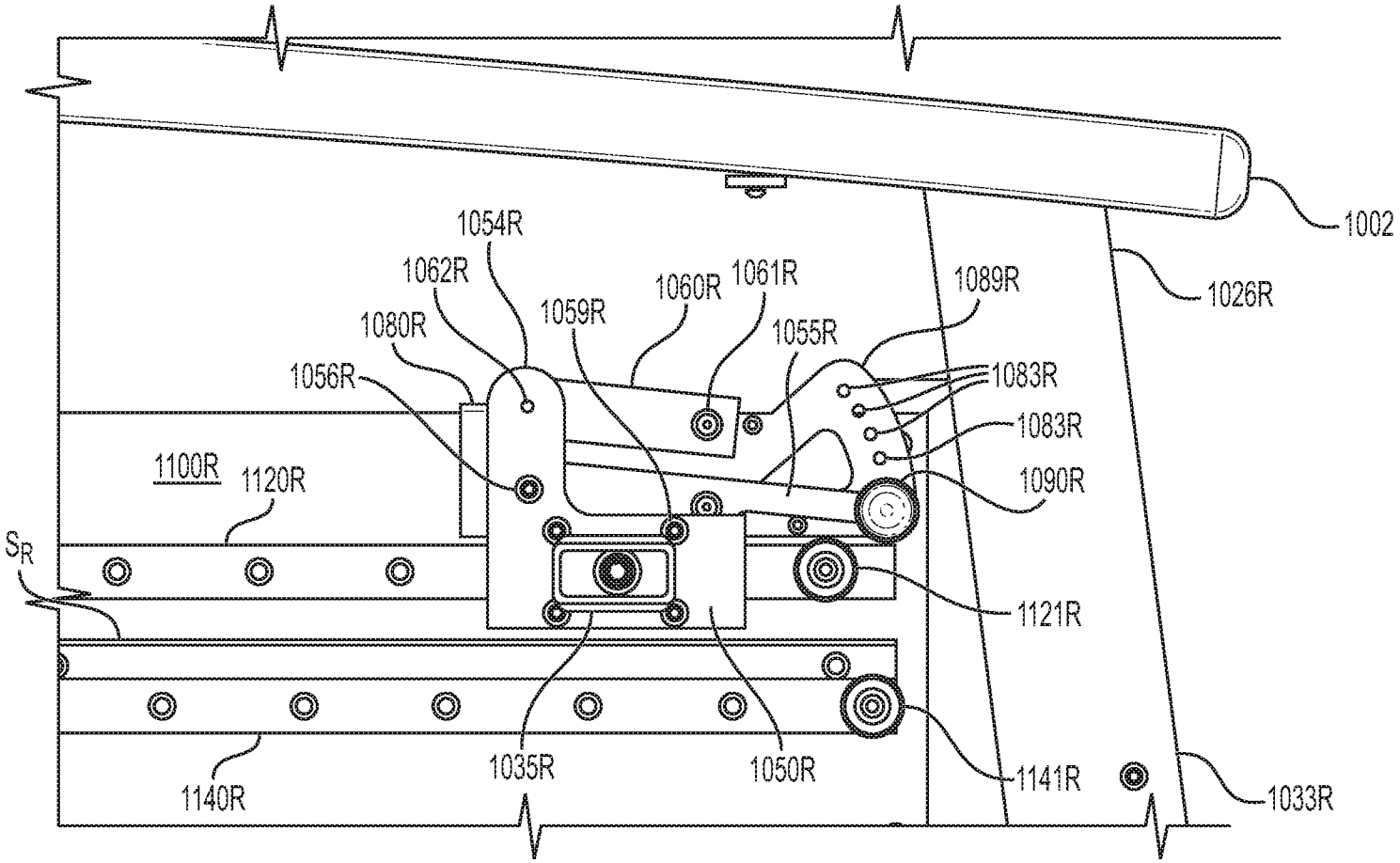
FIG. 36B is a right side elevational view thereof.
Figure 36C:
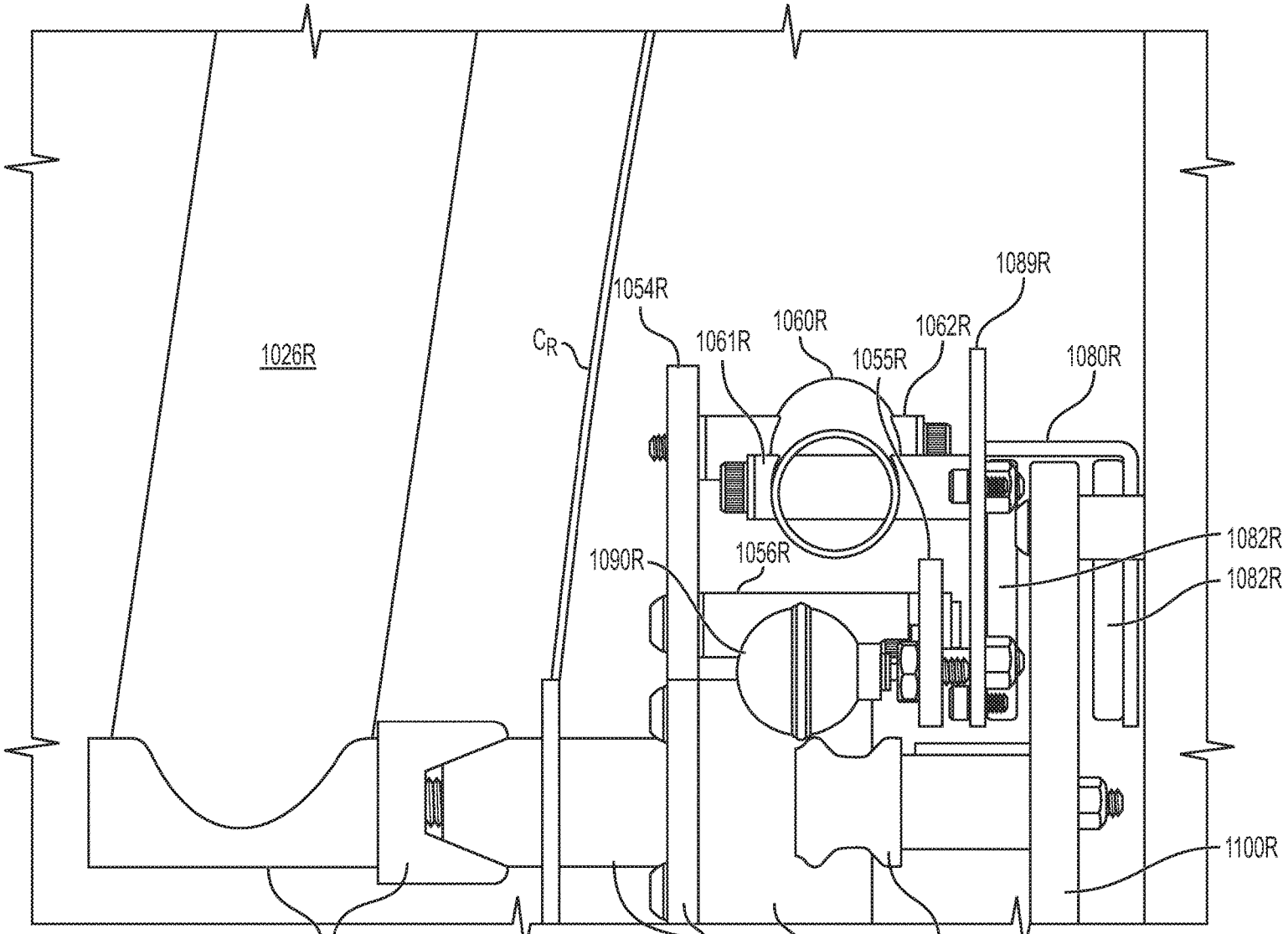
FIG. 36C is a front elevational view thereof.

FIGS. 36A-C show the magnet carrier 1080R having been moved to the fully lowered position, wherein the maximum amount of overlap between magnet elements 1082R and conductive beam 1100R is achieved. This position represents the maximum level of resistance that can be achieved from this embodiment of the invention.

It is to be appreciated that all four magnet carriers in the embodiment of this invention are adjusted in the same manner. It should be understood that arm resistance mechanisms are inverted in their orientation relative to the leg resistance mechanisms as best scene in FIGS. 27 and 29. Both the leg and arm resistance mechanisms of embodiments of the invention share respective conductive beams 1100R and 1100L. In the embodiment shown, the leg resistance mechanisms utilize an upper portion of conductive beams 1100R, 1100L, while arm resistance mechanisms utilize a lower portion of conductive beams 1100R and 1100L. It is to be understood that the arm and leg resistance mechanisms may be transposed, such that the arm resistance mechanisms utilize an upper portion of the right and left conductive beams, and the leg resistance mechanisms utilize a lower portion of said beams.

Elongated sealing members 1029R, 1029L, 1099R and 1099L may be employed in association with right and left cover members $C_R$ and $C_L$ to permit the support braces 1035R, 1035L, 1095R and 1095L to smoothly slide through elongated cutouts in the cover sections $C_R$ and $C_L$ through which support braces 1035R, 1035L, 1095R and 1095L can reciprocally translate during use of the device to protect a user or other person from coming into contact with the sliding linear bearing and braking mechanisms while the device is being used. The sealing members 1029R, 1029L, 1099R and 1099L may be fabricated from any suitable material, such as rubber, plastic, etc.

Right and left safety shields $S_R$ and $S_L$ may be employed to reduce the likelihood that a hand, foot or other item may get entangled in the resistance mechanisms, as well as to act as a shield against dust.

The combination linear bearing and electromagnetic resistance structures disclosed herein may be applied to, and employed in, other exercise apparatus. For example, in other embodiments, the combination linear bearing and electromagnetic resistance structures may be employed in elliptical steppers and gliders, in rowing machines, and in a myriad of other devices or machines in which reciprocal resistance exercising movement is provided for.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. The invention is defined solely by the appended claims including any amendments made during the pendency of this application and all equivalents of those claims as issued. While the invention has been described in its preferred form or embodiment with some degree of particularity, it is understood that this description has been given only by way of example and that numerous changes in the details of construction, fabrication, and use, including the combination of structural arrangement and sizes of features, may be made without departing from the spirit and scope of the invention.

What is claimed is:

1. An exercise apparatus comprising:

a base having left and right electrically conductive beams arranged parallel to one another;

left and right leg exercise assemblies comprised of left and right foot engaging members connected to first ends of corresponding left and right leg pylons and left and right leg linear bearing and magnetic braking assemblies connected to respective second ends of the left and right leg pylons;

left and right arm exercise assemblies comprised of left and right hand engaging members connected to first ends of corresponding left and right arm pylons and left and right arm linear bearing and magnetic braking assemblies connected to respective second ends of the left and right arm pylons;

each of the arm and leg linear bearing and magnetic braking assemblies comprising:

a movable U-shaped magnet carrier to which is attached one or more permanent magnets, the moveable U-shaped magnet carrier being supported for reciprocal translation relative to a corresponding electrically conductive beam by a linkage assembly, the linkage assembly being in turn supported for movement with the movable U-shaped magnet carrier by a linear bearing bracket;

the linear bearing bracket supporting a linear bearing carriage;

an adjustment flange connected to the movable U-shaped magnet carrier defining at least two adjustment apertures;

a spring-loaded locking pin configured to be movable by a user from a locked position wherein the spring-loaded locking pin is situated at least partially in one of the at least two adjustment apertures to an unlocked position wherein the spring-loaded locking pin is not situated in any of the at least two adjustment apertures;

the position of the movable U-shaped magnet carrier being adjustable relative to the corresponding electrically conductive beam by removing the spring-loaded locking pin from any of the least two adjustment apertures, moving the movable U-shaped magnet carrier up or down relative to the corresponding electrically conductive beam while aligning the spring-loaded locking pin with a desired adjustment aperture of the at least two adjustment apertures, and releasing the spring-loaded locking pin to permit the spring-loaded locking pin to at least partially nest within the desired adjustment aperture of the at least two adjustment apertures, thereby locking the movable U-shaped magnet carrier in position relative to the corresponding electrically conductive beam;

a linear bearing slide track connected to one of the corresponding electrically conductive beam, the linear bearing carriage being slidably disposed on the linear bearing slide track to allow coordinated reciprocal movement of the linear bearing bracket and the movable U-shaped magnet carrier upon movement thereof by a user.

2. The exercise apparatus of claim 1, wherein the linkage assembly comprises:

a first pivotable link having a proximal end which is hingedly connected to a distal end of a raised flange defined by the linear bearing bracket;

the first pivotable link having a distal end which is hingedly connected to the movable U-shaped magnet carrier;

a second pivotable link having a proximal end which is hingedly connected to a proximal portion of the raised flange of the linear bearing bracket;

the second pivotable link having an intermediate portion which is hingedly connected to the movable U-shaped magnet carrier and a distal end which is lockingly but removably connectable to the adjustment flange using the spring-loaded locking pin.

3. The exercise apparatus of claim 1, wherein the movable U-shaped magnet carrier supports magnet elements on three sides of a U-shaped internal surface.

4. The exercise apparatus of claim 3, wherein the left leg and left arm exercise assemblies are both associated with the left electrically conductive beam, and the right arm and right leg exercise assemblies are associated with the right electrically conductive beam.

5. The exercise apparatus of claim 1, wherein the left leg and left arm exercise assemblies are both associated with the left electrically conductive beam, and the right arm and right leg exercise assemblies are associated with the right electrically conductive beam.

6. An exercise apparatus for permitting simultaneous exercise of left and right arms and legs of a user, the exercise apparatus comprising:

a frame;

left and right arm exercise assemblies, the left and right arm exercise assemblies including respective left and right hand engaging members connected to left and right proximal ends thereof, respective distal ends of the left and right arm exercise assemblies being connected to respective left and right linear bearing and magnetic braking mechanisms slideably associated with the frame;

left and right leg exercise assemblies, the left and right leg exercise assemblies including respective left and right foot engaging members connected to respective left and right proximal ends thereof, respective distal ends of the left and right leg exercise assemblies being connected to respective left and right linear bearing and magnetic braking mechanisms slideably associated with the frame;

two linkage apparatuses respectively associated with the respective left and right linear bearing and magnetic braking mechanisms of the left and right leg exercise assemblies, and two linkage apparatuses respectively associated with the respective left and right linear bearing and magnetic braking mechanisms of the left and right arm exercise assemblies; and a bench for supporting the user, the bench being connected to the frame by at least one further support structure.

7. The exercise apparatus of claim 6, wherein each linkage apparatus comprises:

a first pivotable link having a proximal end which is hingedly connected to a linear bearing bracket associated with the corresponding linear bearing and magnetic braking mechanism;

the first pivotable link having a distal end which is hingedly connected to a corresponding magnet carrier;

a second pivotable link having a proximal end which is hingedly connected to the linear bearing bracket;

the second pivotable link having an intermediate portion which is hingedly connected to the magnet carrier and a distal end which is lockingly but removably connectable to an adjustment flange portion of the magnet carrier using a locking pin.

8. The exercise apparatus of claim 6, wherein the magnet carrier supports magnet elements on three sides of a U-shaped internal surface.

9. The exercise apparatus of claim 6, further comprising left and right conductive beams, wherein the left arm and left leg exercise assemblies are both associated with the left conductive beam, and the right arm and right leg exercise assemblies are associated with the right conductive beam.

* * * * *